US011141635B2

(12) United States Patent
Schweigert et al.

(10) Patent No.: US 11,141,635 B2
(45) **Date of Patent: *Oct. 12, 2021**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Bradley D. Schweigert, Cave Creek, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/940,806

(22) Filed: Jul. 28, 2020

(65) Prior Publication Data

US 2020/0353327 A1 Nov. 12, 2020

Related U.S. Application Data

(63) Continuation-in-part of application No. 16/866,991, filed on May 5, 2020, which is a continuation of (Continued)

(51) Int. Cl.

| | |
|---|---|
| ***A63B 53/04*** | (2015.01) |
| ***A63B 53/06*** | (2015.01) |
| ***A63B 60/02*** | (2015.01) |

(52) U.S. Cl.

CPC ..... *A63B 53/0487* (2013.01); *A63B 53/065* (2013.01); *A63B 60/02* (2015.10); (Continued)

(58) Field of Classification Search

CPC ... A63B 53/0487; A63B 53/065; A63B 60/02; A63B 53/047; A63B 53/0441; (Continued)

(56) References Cited

U.S. PATENT DOCUMENTS

| | | | | |
|---|---|---|---|---|
| 922,444 A | | 5/1909 | Youds | |
| D57,980 S | * | 5/1921 | Kraeuter ..... | A63B 53/0487 D21/741 |

(Continued)

FOREIGN PATENT DOCUMENTS

| | | |
|---|---|---|
| JP | 2005160691 A | 6/2005 |
| WO | 2006087846 A1 | 8/2006 |

OTHER PUBLICATIONS

TourSpecGolf (Gold's Factory Multi Weighted Custom Putter) [online]. Nov. 20, 2010 [retrieved Apr. 21, 2016]. Retrieved from the internet: http://blog.tourspecgolf.com/golds-factory-multi-weighted-custom-putter/.

(Continued)

*Primary Examiner* — Michael D Dennis

(57) ABSTRACT

Examples of golf club heads and methods to manufacture golf club heads are generally described herein. In one example, a body portion of a golf club head may include a front portion. A face portion may be coupled to the front portion. The face portion may include a central strike portion and a perimeter. A plurality of projections may extend from the face portion to provide a ball striking surface for impacting a golf ball. The plurality of projections may be aligned in one or more directions across the face portion and may progressively increase in size in any direction from the central strike portion to the perimeter of the face portion. Other examples and examples may be described and claimed.

20 Claims, 20 Drawing Sheets

Related U.S. Application Data application No. 16/283,390, filed on Feb. 22, 2019, now Pat. No. 10,646,758, which is a continuation of application No. 14/962,953, filed on Dec. 8, 2015, now Pat. No. 10,258,844, which is a continuation of application No. 14/686,466, filed on Apr. 14, 2015, now Pat. No. 9,233,283, said application No. 16/866,991 is a continuation-in-part of application No. 16/400,128, filed on May 1, 2019, now Pat. No. 10,688,355, which is a continuation of application No. 15/816,517, filed on Nov. 17, 2017, now Pat. No. 10,315,080, which is a continuation of application No. 15/150,006, filed on May 9, 2016, now Pat. No. 10,258,845, which is a continuation-in-part of application No. 14/586,720, filed on Dec. 30, 2014, now Pat. No. 9,440,124, application No. 16/940,806, which is a continuation-in-part of application No. 15/987,731, filed on May 23, 2018, now Pat. No. 10,821,341, and a continuation-in-part of application No. 15/188,661, filed on Jun. 21, 2016, now Pat. No. 10,441,858, which is a continuation of application No. 14/812,212, filed on Jul. 29, 2015, now Pat. No. 9,387,375, said application No. 15/987,731 is a continuation-in-part of application No. 15/489,366, filed on Apr. 17, 2017, now Pat. No. 10,124,221, which is a continuation of application No. 15/078,749, filed on Mar. 23, 2016, now Pat. No. 9,649,540, said application No. 15/987,731 is a continuation-in-part of application No. 15/831,151, filed on Dec. 4, 2017, now Pat. No. 10,478,680, said application No. 15/987,731 is a continuation-in-part of application No. 15/922,506, filed on Mar. 15, 2018, now abandoned, application No. 16/940,806, which is a continuation of application No. 16/006,055, filed on Jun. 12, 2018, now Pat. No. 10,737,153.

(60) Provisional application No. 61/985,351, filed on Apr. 28, 2014, provisional application No. 61/992,379, filed on May 13, 2014, provisional application No. 62/015,297, filed on Jun. 20, 2014, provisional application No. 62/030,820, filed on Jul. 30, 2014, provisional application No. 62/059,108, filed on Oct. 2, 2014, provisional application No. 62/041,553, filed on Aug. 25, 2014, provisional application No. 62/518,715, filed on Jun. 13, 2017, provisional application No. 62/533,481, filed on Jul. 17, 2017, provisional application No. 62/536,266, filed on Jul. 24, 2017, provisional application No. 62/574,071, filed on Oct. 18, 2017, provisional application No. 62/146,114, filed on Apr. 10, 2015, provisional application No. 62/138,925, filed on Mar. 26, 2015, provisional application No. 62/212,462, filed on Aug. 31, 2015, provisional application No. 62/213,933, filed on Sep. 3, 2015, provisional application No. 62/431,157, filed on Dec. 7, 2016, provisional application No. 62/480,338, filed on Mar. 31, 2017, provisional application No. 62/644,233, filed on Mar. 16, 2018, provisional application No. 62/659,060, filed on Apr. 17, 2018.

(52) U.S. Cl.
CPC ..... *A63B 53/047* (2013.01); *A63B 53/0408* (2020.08); *A63B 53/0437* (2020.08); *A63B 53/0441* (2020.08); *A63B 53/0466* (2013.01); *A63B 2053/0491* (2013.01)

(58) Field of Classification Search
CPC ..... A63B 2053/0491; A63B 53/0408; A63B 53/0437; A63B 53/0466
See application file for complete search history.

(56) References Cited

U.S. PATENT DOCUMENTS

| | | | | |
|---|---|---|---|---|
| RE19,178 | E | 5/1934 | Spiker | |
| 3,749,408 | A | 7/1973 | Mills | |
| 4,043,562 | A | 8/1977 | Shillington | |
| 4,340,230 | A | 7/1982 | Churchward | |
| 4,754,977 | A | 7/1988 | Sahm | |
| 4,869,507 | A | 9/1989 | Sahm | |
| 4,927,144 | A | 5/1990 | Stormon | |
| 5,116,047 | A | 5/1992 | Phelan et al. | |
| 5,127,653 | A | 7/1992 | Nelson | |
| 5,137,275 | A | 8/1992 | Nelson | |
| 5,193,806 | A | 3/1993 | Burkly | |
| D335,317 | S | 5/1993 | Shearer | |
| D335,692 | S | 5/1993 | Antonious | |
| D336,757 | S | 6/1993 | Antonious | |
| 5,244,205 | A | 9/1993 | Melanson et al. | |
| 5,275,412 | A | 1/1994 | Innes | |
| D350,582 | S | 9/1994 | Miansian et al. | |
| 5,388,827 | A | 2/1995 | Reynolds | |
| 5,390,918 | A | 2/1995 | Meyers et al. | |
| 5,429,366 | A | 7/1995 | McCabe | |
| D363,101 | S | 10/1995 | Sturm | |
| 5,454,563 | A | 10/1995 | Nagamoto et al. | |
| 5,470,063 | A | 11/1995 | Fisher | |
| D365,864 | S | 1/1996 | Sturm | |
| 5,489,097 | A | 2/1996 | Simmons | |
| D368,751 | S | 4/1996 | Rife | |
| D369,393 | S | 4/1996 | Takahashi et al. | |
| 5,518,235 | A | 5/1996 | Mendenhall | |
| 5,569,098 | A | 10/1996 | Klein | |
| 5,571,053 | A | 11/1996 | Lane | |
| D378,688 | S | 4/1997 | Cameron | |
| D385,609 | S | 10/1997 | Cameron | |
| 5,683,307 | A | 11/1997 | Rife | |
| D388,143 | S | 12/1997 | Huan-Chiang | |
| D389,207 | S | 1/1998 | Cameron | |
| 5,711,719 | A | 1/1998 | Fireman | |
| 5,720,671 | A | 2/1998 | Cheng | |
| 5,749,793 | A | 5/1998 | Lucetti | |
| D398,685 | S | 9/1998 | Masuda | |
| 5,803,824 | A | 9/1998 | Rollingson | |
| D399,290 | S | 10/1998 | Sizemore, Jr. | |
| D399,911 | S | 10/1998 | Nicolette et al. | |
| 5,839,974 | A | 11/1998 | McAllister | |
| D405,836 | S | 2/1999 | Nicolette et al. | |
| 5,890,969 | A | 4/1999 | Bechler | |
| D409,701 | S | 5/1999 | Ashcraft et al. | |
| 5,924,938 | A | 7/1999 | Hines | |
| 6,007,434 | A * | 12/1999 | Baker | A63B 53/04 473/330 |
| 6,039,656 | A | 3/2000 | Fireman | |
| D422,655 | S | 4/2000 | Hicks | |
| 6,050,903 | A | 4/2000 | Lake | |
| D426,276 | S | 6/2000 | Besnard et al. | |
| D431,854 | S | 10/2000 | Cameron | |
| D432,192 | S | 10/2000 | Hicks | |
| D436,151 | S | 1/2001 | Nicolette et al. | |
| D437,374 | S | 2/2001 | Cameron | |
| D441,820 | S | 5/2001 | Nicolette et al. | |
| 6,234,915 | B1 | 5/2001 | Wu | |
| D443,668 | S | 6/2001 | Nicolette et al. | |
| D443,905 | S | 6/2001 | Nicolette et al. | |
| D444,833 | S | 7/2001 | Wells et al. | |
| 6,264,571 | B1 | 7/2001 | Lekavich | |
| 6,277,033 | B1 | 8/2001 | Krumme et al. | |
| D449,664 | S | 10/2001 | Beebe et al. | |
| D449,865 | S | 10/2001 | Fife, Jr. et al. | |
| D450,799 | S | 11/2001 | Nicolette et al. | |
| D451,973 | S | 12/2001 | Wells et al. | |
| 6,348,014 | B1 | 2/2002 | Chiu | |

(56) References Cited

U.S. PATENT DOCUMENTS 6,354,959 B1 3/2002 Nicolette et al.
6,394,910 B1 5/2002 McCarthy
6,478,694 B2 11/2002 Anderson et al.
D472,949 S 4/2003 Serrano
D474,821 S 5/2003 Wells et al.
D474,949 S 5/2003 Schaffeld et al.
6,561,919 B2 5/2003 Edel
D483,086 S 12/2003 Schweigert et al.
6,659,883 B2 12/2003 Nelson et al.
D486,872 S 2/2004 Schweigert et al.
D488,200 S 4/2004 Olsavsky et al.
D498,276 S 11/2004 Schweigert et al.
6,902,496 B2 6/2005 Solheim et al.
6,902,498 B2 6/2005 Sullivan et al.
D512,116 S 11/2005 Miraflor et al.
6,988,956 B2 1/2006 Cover et al.
6,997,819 B2 2/2006 Naylor et al.
D520,088 S 5/2006 Parr
7,077,760 B2 7/2006 Gray
D531,242 S 10/2006 Adams
D532,067 S 11/2006 Soracco et al.
7,153,220 B2 12/2006 Lo
D534,595 S 1/2007 Hasebe
7,156,752 B1 1/2007 Bennett
7,163,465 B2 1/2007 Edel
D536,401 S 2/2007 Kawami
D536,403 S 2/2007 Kawami
D538,371 S 3/2007 Kawami
7,201,668 B1 4/2007 Pamias
7,204,765 B2 4/2007 Cover et al.
D542,869 S 5/2007 Adams
D543,598 S 5/2007 Kuan et al.
D543,601 S 5/2007 Kawami
7,278,926 B2 10/2007 Frame
D555,219 S 11/2007 Lin
D556,277 S 11/2007 Broom
7,309,297 B1 12/2007 Solari
D561,854 S 2/2008 Morris
7,331,876 B2 2/2008 Klein
7,351,162 B2 4/2008 Soracco et al.
D569,461 S 5/2008 Morris
D569,930 S 5/2008 Nehrbas
7,396,289 B2 7/2008 Soracco et al.
7,416,494 B2 8/2008 Edel
D577,085 S 9/2008 Nicolette et al.
D577,086 S 9/2008 Nicolette et al.
D579,506 S 10/2008 Nicolette et al.
D579,995 S 11/2008 Nicolette et al.
D582,497 S 12/2008 Rollinson
7,473,189 B2 1/2009 Schweigert et al.
7,491,131 B2 2/2009 Vinton
D595,793 S 7/2009 Rollinson
D599,425 S 9/2009 Laub
D600,763 S 9/2009 Cameron
7,744,485 B2 6/2010 Jones et al.
D620,993 S 8/2010 Laub
D621,461 S 8/2010 Serrano et al.
D623,709 S 9/2010 Serrano et al.
D631,925 S 2/2011 Broom
7,887,432 B2 2/2011 Jones et al.
7,909,707 B2 3/2011 Klein
7,918,745 B2 4/2011 Morris et al.
D638,891 S 5/2011 Nicolette et al.
D642,643 S 8/2011 Nicolette et al.
D643,485 S 8/2011 Nicolette et al.
D645,104 S 9/2011 Nicolette et al.
8,096,039 B2 1/2012 Soracco et al.
D653,718 S 2/2012 Stokke et al.
8,109,841 B2 * 2/2012 Miyamichi ..... A63B 53/0487 473/340
D661,753 S 6/2012 Cameron et al.
D666,260 S 8/2012 Cynn
8,371,958 B2 * 2/2013 Treadwell ..... A63B 53/04 473/331
8,376,878 B2 2/2013 Bennett et al.
D688,339 S 8/2013 Hilton et al.
D688,341 S 8/2013 Rollinson
D691,226 S 10/2013 Hilton et al.
8,636,607 B2 1/2014 Renna
D699,308 S 2/2014 Rollinson
8,696,492 B1 4/2014 Hocknell et al.
D704,782 S 5/2014 Rollinson
8,721,472 B2 5/2014 Kuan et al.
8,790,193 B2 7/2014 Serrano et al.
D711,483 S 8/2014 Wong
D715,388 S 10/2014 Serrano et al.
8,870,674 B1 10/2014 Abbott
D722,350 S 2/2015 Schweigert
D722,351 S 2/2015 Parsons et al.
D722,352 S 2/2015 Nicolette et al.
D723,120 S 2/2015 Nicolette
D724,164 S 3/2015 Schweigert et al.
D725,208 S 3/2015 Schweigert
D726,265 S 4/2015 Nicolette
D726,846 S 4/2015 Schweigert
D730,462 S 5/2015 Becktor et al.
D732,122 S 6/2015 Becktor
D732,618 S 6/2015 Becktor et al.
D733,234 S 6/2015 Nicolette
9,079,077 B2 7/2015 Wolf
9,108,088 B2 8/2015 Serrano et al.
9,108,092 B1 8/2015 Warner
D738,447 S 9/2015 Schweigert
D738,449 S 9/2015 Schweigert
D739,487 S 9/2015 Schweigert
D741,426 S 10/2015 Schweigert
D748,213 S 1/2016 Parsons et al.
D748,215 S 1/2016 Parsons et al.
9,272,193 B1 3/2016 Yim
D753,252 S 4/2016 Schweigert
9,545,544 B2 1/2017 Jones et al.
9,604,108 B1 3/2017 Dunnell et al.
9,675,854 B2 6/2017 Wang et al.
9,808,680 B1 11/2017 Myers et al.
9,925,427 B2 3/2018 Bischmann et al.
9,956,463 B2 5/2018 Franklin et al.
10,493,331 B2 12/2019 Kroloff et al.
10,632,352 B2 4/2020 Lambeth et al.
10,668,340 B2 6/2020 Lambeth et al.
10,737,153 B2 8/2020 Schweigert et al.
2002/0077193 A1 6/2002 Takeda
2002/0193174 A1 12/2002 Edel
2003/0199332 A1 10/2003 Lindsay
2004/0014532 A1 1/2004 Lee et al.
2004/0138003 A1 7/2004 Grace
2004/0180730 A1 9/2004 Franklin et al.
2006/0052178 A1 3/2006 Franklin et al.
2006/0094522 A1 5/2006 Tang et al.
2006/0223649 A1 10/2006 Rife
2007/0129163 A1 6/2007 Solari
2007/0135232 A1 6/2007 Billings
2007/0142122 A1 6/2007 Bonneau
2007/0207875 A1 9/2007 Kuan et al.
2007/0238548 A1 10/2007 Johnson
2008/0139333 A1 6/2008 Klein
2008/0146372 A1 6/2008 John
2008/0176672 A1 7/2008 Roach et al.
2009/0029800 A1 1/2009 Jones et al.
2009/0156328 A1 * 6/2009 Reese ..... A63B 53/0487 473/331
2009/0163287 A1 6/2009 Vald'Via et al.
2009/0239678 A1 9/2009 Cruz et al.
2010/0035700 A1 2/2010 Yu et al.
2010/0255922 A1 10/2010 Lueders
2010/0317454 A1 12/2010 Sato et al.
2011/0165959 A1 7/2011 Klein
2013/0165256 A1 6/2013 Stevenson
2013/0210537 A1 8/2013 Ainscough et al.
2015/0306477 A1 10/2015 Parsons et al.
2016/0016050 A1 * 1/2016 Rife ..... A63B 53/0487 473/331
2016/0346649 A1 * 12/2016 Jertson ..... A63B 53/0487

(56) References Cited

U.S. PATENT DOCUMENTS

| | | | | |
|---|---|---|---|---|
| 2018/0001163 | A1 | 1/2018 | Becktor et al. | |
| 2018/0311545 | A1* | 11/2018 | Lambeth | B23P 15/00 |
| 2018/0361206 | A1 | 12/2018 | Becktor et al. | |

OTHER PUBLICATIONS

U.S. Appl. No. 29/523,587, Schweigert "Golf Club Head," filed Apr. 10, 2015.

* cited by examiner

GOLF CLUB HEADS AND METHODS TO MANUFACTURE GOLF CLUB HEADS

CROSS REFERENCE

This application is a continuation-in-part of application Ser. No. 16/866,991, filed May 5, 2020, which is a continuation of application Ser. No. 16/283,390, filed Feb. 22, 2019, now U.S. Pat. No. 10,646,758, which is a continuation of application Ser. No. 14/962,953, filed Dec. 8, 2015, now U.S. Pat. No. 10,258,844, which is a continuation of application Ser. No. 14/686,466, filed Apr. 14, 2015, now U.S. Pat. No. 9,233,283, which claims the benefit of U.S. Provisional Application No. 61/985,351, filed Apr. 28, 2014, U.S. Provisional Application No. 61/992,379, filed May 13, 2014, U.S. Provisional Application No. 62/015,297, filed Jun. 20, 2014, U.S. Provisional Application No. 62/030,820, filed Jul. 30, 2014, and U.S. Provisional Application No. 62/059,108, filed Oct. 2, 2014.

U.S. patent application Ser. No. 16/866,991, filed May 5, 2020, is a continuation-in-part of application Ser. No. 16/400,128, filed May 1, 2019, now U.S. Pat. No. 10,688,355, which is a continuation of application Ser. No. 15/816,517, filed Nov. 17, 2017, now U.S. Pat. No. 10,315,080, which is a continuation of application Ser. No. 15/150,006, filed May 9, 2016, now U.S. Pat. No. 10,258,845, which is a continuation-in-part of application Ser. No. 14/586,720, filed Dec. 30, 2014, now U.S. Pat. No. 9,440,124, which claims the benefit of U.S. Provisional Application No. 62/041,553, filed Aug. 25, 2014.

This application is a continuation-in-part of application Ser. No. 15/987,731, filed May 23, 2018, which claims the benefit of U.S. Provisional Application No. 62/518,715, filed Jun. 13, 2017, U.S. Provisional Application No. 62/533,481, filed Jul. 17, 2017, U.S. Provisional Application No. 62/536,266, filed Jul. 24, 2017, and U.S. Provisional Application No. 62/574,071, filed Oct. 18, 2017.

U.S. application Ser. No. 15/987,731 is a continuation-in-part of application Ser. No. 15/188,661, filed Jun. 21, 2016, now U.S. Pat. No. 10,441,858, which is a continuation of application Ser. No. 14/812,212, filed Jul. 29, 2015, now U.S. Pat. No. 9,387,375, which claims the benefit of U.S. Provisional Application No. 62/030,820, filed Jul. 30, 2014, and U.S. Provisional Application No. 62/146,114, filed Apr. 10, 2015.

U.S. application Ser. No. 15/987,731 is a continuation-in-part of application Ser. No. 15/489,366, filed Apr. 17, 2017, now U.S. Pat. No. 10,124,212, which is a continuation of application Ser. No. 15/078,749, filed Mar. 23, 2016, now U.S. Pat. No. 9,649,540, which claims the benefit of U.S. Provisional Application No. 62/138,925, filed Mar. 26, 2015, U.S. Provisional Application No. 62/212,462, filed Aug. 31, 2015, and U.S. Provisional Application No. 62/213,933, filed Sep. 3, 2015.

U.S. application Ser. No. 15/987,731 is a continuation-in-part of application Ser. No. 15/831,151, filed Dec. 4, 2017, now U.S. Pat. No. 10,478,680, which claims the benefit of U.S. Provisional Application No. 62/431,157, filed Dec. 7, 2016.

U.S. application Ser. No. 15/987,731 is a continuation-in-part of application Ser. No. 15/922,506, filed Mar. 15, 2018, now abandoned, which claims the benefit of U.S. Provisional Application No. 62/480,338, filed Mar. 31, 2017.

This application is a continuation of application Ser. No. 16/006,055, filed Jun. 12, 2018, which claims the benefit of U.S. Provisional Application No. 62/518,715, filed Jun. 13, 2017, U.S. Provisional Application No. 62/533,481, filed Jul. 17, 2017, U.S. Provisional Application No. 62/536,266, filed Jul. 24, 2017, U.S. Provisional Application No. 62/644,233, filed Mar. 16, 2018, and U.S. Provisional Application No. 62/659,060, filed Apr. 17, 2018.

The disclosures of the abovementioned U.S. Applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Proper alignment of a golf club head at an address position relative to a golf ball may improve the performance of an individual. Various alignment aids have been used on the golf club heads to improve the individual's visual alignment.

Figure 1:
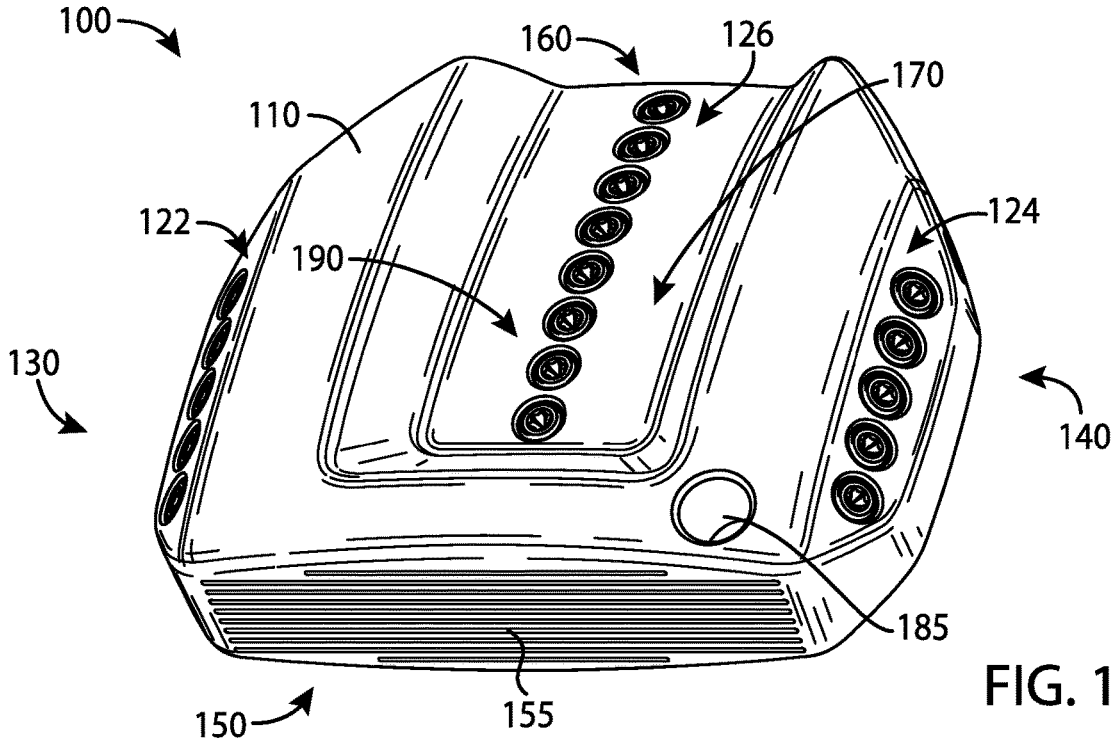
FIG. 1 depicts a front and top perspective view of a golf club head according to an example of the apparatus, methods, and articles of manufacture described herein.
Figure 2:
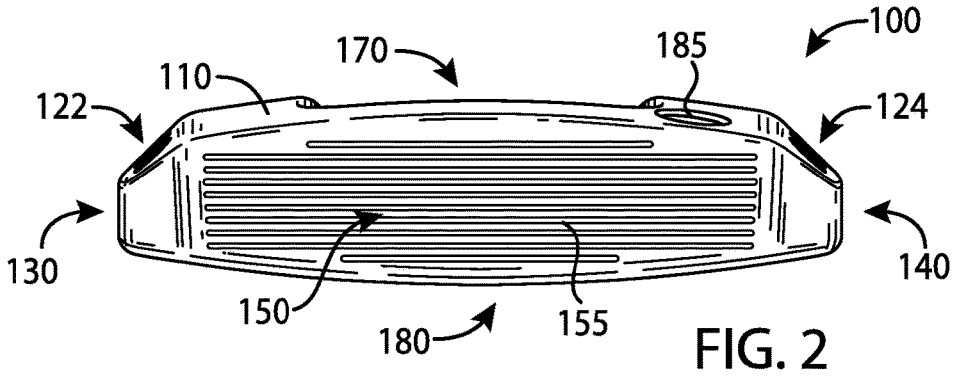
FIG. 2 depicts a front view of the example golf club head of FIG. 1.
Figure 3:
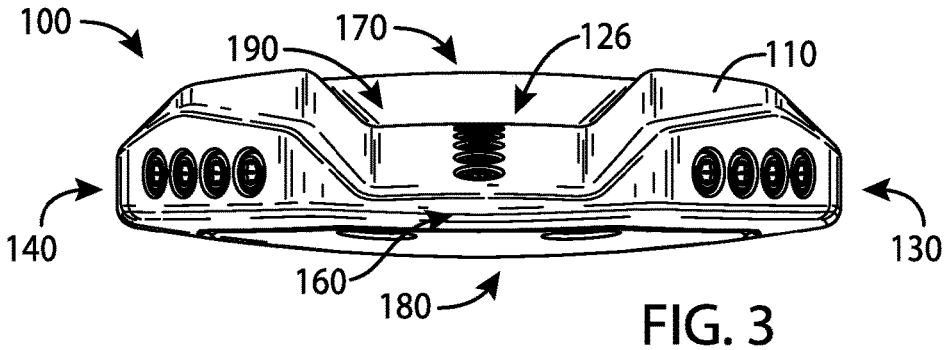
FIG. 3 depicts a rear view of the example golf club head of FIG. 1.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf club heads and methods to manufacture golf club heads are described herein. The apparatus, methods, and articles of manufacture described herein are not limited in this regard.

In the example of FIGS. 1-13, a golf club head 100 may include a body portion 110 and a visual guide portion, which is generally shown as a first visual guide portion 122, a second visual guide portion 124, and a third visual guide portion 126. The body portion 110 may include a toe portion 130, a heel portion 140, a front portion 150, a rear portion 160, a top portion 170, and a sole portion 180. The body portion 110 may also include a bore 185 to receive a shaft (not shown) with a grip (not shown). Alternatively, the body portion 110 may include a hosel (not shown) to receive the shaft. The golf club head 100 and the grip may be located on opposite ends of the shaft to form a golf club. The apparatus, methods, and articles of manufacture described herein are not limited in this regard.

The body portion 110 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 110 may be partially or entirely made of a non-metal material (e.g., composite, plastic, etc.). The golf club head 100 may be a putter-type golf club head (e.g., a blade-type putter, a mid-mallet-type putter, a mallet-type putter, etc.). Based on the type of putter as mentioned above, the body portion 110 may be at least 200 grams. For example, the body portion 110 may be in a range between 300 to 600 grams. The apparatus, methods, and articles of manufacture described herein are not limited in this regard.

The toe and heel portions 130 and 140, respectively, may be on opposite ends of the body portion 110 and may define a width of the body portion 110. The front and rear portions 150 and 160, respectively, may be on opposite ends of the body portion 110 and may define a length of the body portion 110. The front portion 150 may include a face portion 155 (e.g., a strike face), which may be used to impact a golf ball (not shown). The face portion 155 may be an integral portion of the body portion 110. Alternatively, the face portion 155 may be a separate piece or an insert coupled to the body portion 110 via various manufacturing and/or processes (e.g., a bonding process, a welding process, a brazing process, a mechanical locking method, a mechanical fastening method, any combination thereof, or other suitable types of manufacturing methods and/or processes). The face portion 155 may be associated with a loft plane that defines the loft angle of the golf club head 100. The apparatus, methods, and articles of manufacture described herein are not limited in this regard.

Figure 8:
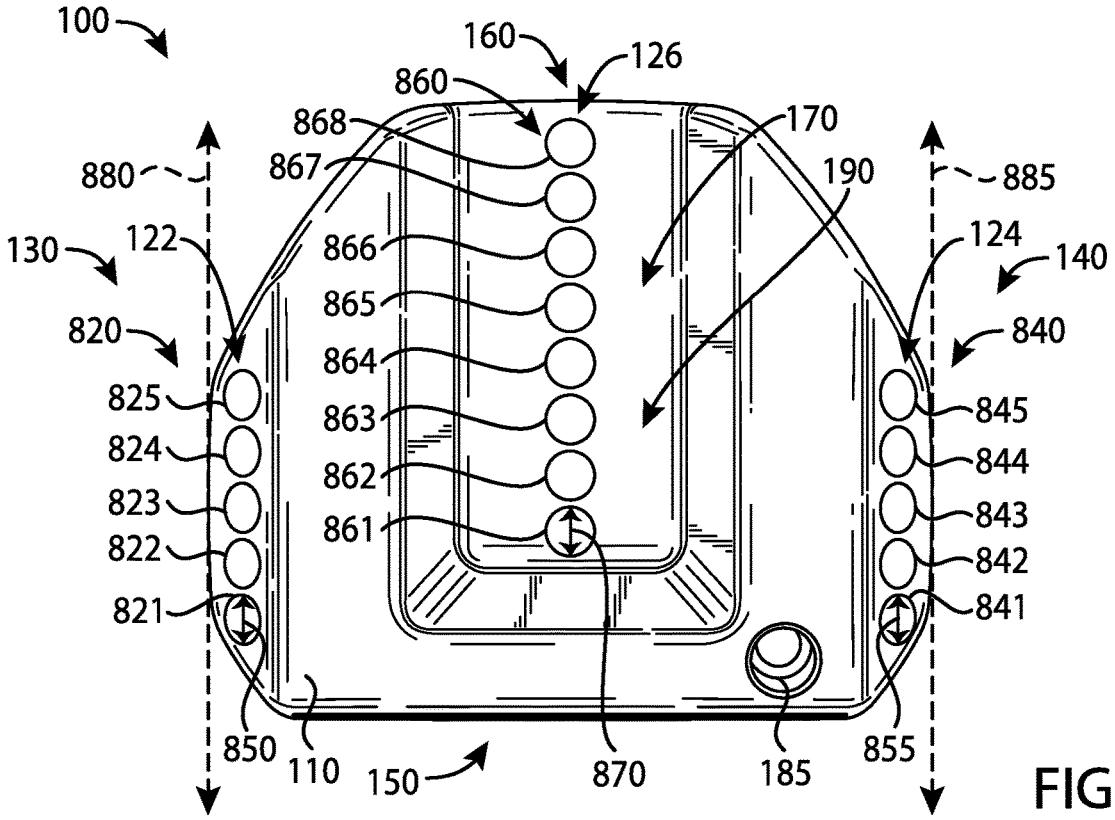
FIG. 8 depicts a top view of a body portion of the example golf club head of FIG. 1.

As illustrated in FIG. 8, for example, the body portion 110 may include two or more weight ports, generally shown as a first set of weight ports 820 (e.g., shown as weight ports 821, 822, 823, 824, and 825) to form the first visual guide portion 122 and a second set of weight ports 840 (e.g., shown as weight ports 841, 842, 843, 844, and 845) to form the second visual guide portion 124. The first and second sets of weight ports 820 and 840, respectively, may be exterior weight ports configured to receive one or more weight portions (e.g., one shown as 1000 in FIG. 10). In particular, the first and second sets of weight ports 820 and 840 may be located at or proximate to a periphery of the golf club head 100. For example, the first and second sets of weight ports 820 and 840, respectively, may be on or proximate to the top portion 170. The first set of weight ports 820 may be at or proximate to the toe portion 130 whereas the second set of weight ports 840 may be at or proximate to the heel portion 140. The apparatus, methods, and articles of manufacture described herein are not limited in this regard.

Each weight port of the first set of weight ports 820 may have a first port diameter ($PD_1$) 850. In particular, a uniform distance of less than the first port diameter 850 may separate any two adjacent weight ports of the first set of weight ports 820 (e.g., (i) weight ports 821 and 822, (ii) weight ports 822 and 823, (iii) weight ports 823 and 824, or (iv) weight ports 824 and 825). In one example, the first port diameter 850 may be about 0.25 inch (6.35 millimeters) and any two adjacent weight ports of the first set of weight ports 820 may be separated by 0.1 inch (2.54 millimeters). In a similar manner, each weight port of the second set of weight ports 840 may have a second port diameter ($PD_2$) 855. A uniform distance of less than the second port diameter 855 may separate any two adjacent weight ports of the second set of weight ports 840 (e.g., (i) weight ports 841 and 842, (ii) weight ports 842 and 843, (iii) weight ports 843 and 844, or (iv) weight ports 844 and 845). For example, the second port diameter 855 may be about 0.25 inch (6.35 millimeters) and any two adjacent weight ports of the second set of weight ports 840 may be separated by 0.1 inch (2.54 millimeters). The first and second port diameters 850 and 855 may be equal (i.e., $PD_1=PD_2$). Alternatively, the first and second port diameters 850 and 855 may be different. The apparatus, methods, and articles of manufacture described herein are not limited in this regard.

As noted above, the visual guide portion may include the third visual guide portion 126. Accordingly, the body portion 110 may include two or more weight ports, generally shown as a third set of weight ports 860 (e.g., shown as weight ports 861, 862, 863, 864, 865, 866, 867, and 868) to form the third visual guide portion 126. In particular, the third visual guide portion 126 may be substantially equidistant from the first and second visual guide portions 122 and 124. For example, the third visual guide portion 126 may extend between the front and rear portions 150 and 160 located at or proximate to a center of the body portion 110. The apparatus, methods, and articles of manufacture described herein are not limited in this regard.

Each weight port of the third set of weight ports 860 may have a third port diameter 870. In one example, the third port diameter 870 may be equal to the first port diameter 850 and/or the second port diameter 855 (e.g., 850=855=870). In another example, the third port diameter 870 may be different from the first port diameter 850 and the second port diameter 855. A uniform distance of less than the third port diameter 870 may separate any two adjacent weight ports of the third set of weight ports 860 (e.g., (i) weight ports 861 and 862, (ii) weight ports 862 and 863, (iii) weight ports 863 and 864, (iv) weight ports 864 and 865, (v) weight ports 865 and 866, (vi) weight ports 866 and 867, or (vii) weight ports 867 and 868). The body portion 110 may also include a U-shape recess portion 190. The third visual guide portion 126 may be located in the U-shape recess portion 190. The apparatus, methods, and articles of manufacture described herein are not limited in this regard.

Figure 9:
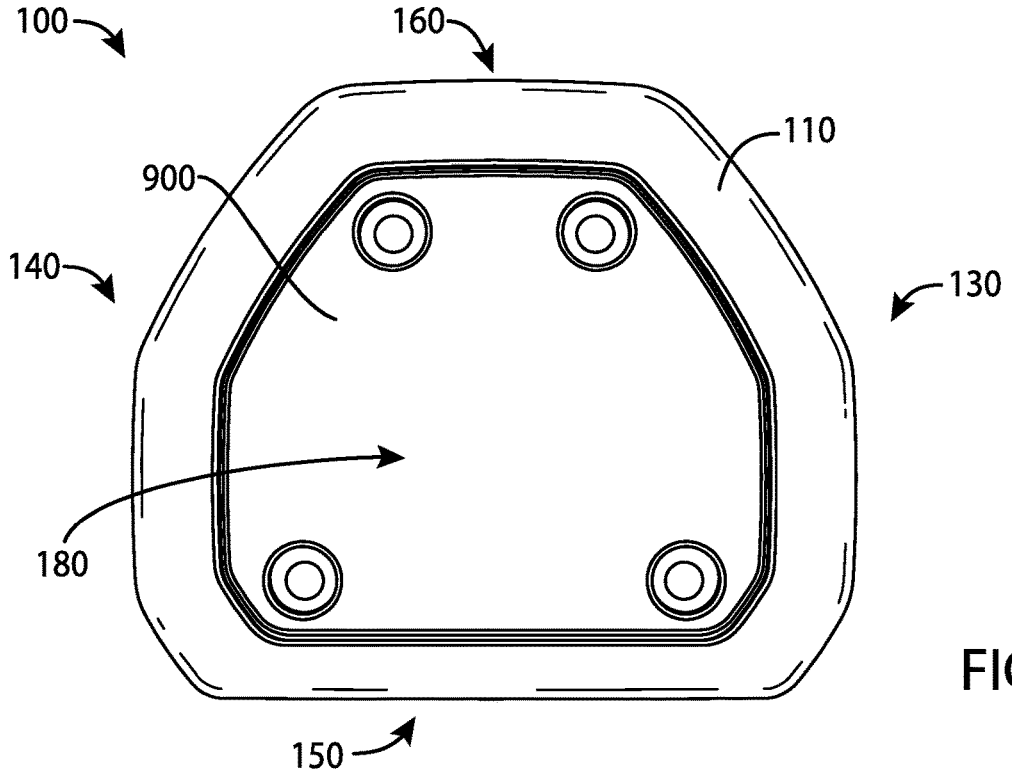
FIG. 9 depicts a bottom view of the example body portion of FIG. 8.

Further, as shown in FIG. 9, the body portion 110 may include an interior cavity 900. The interior cavity 900 may be partially or entirely filled with a polymer material, an elastic polymer or elastomer material, a thermoplastic elastomer material (TPE), a thermoplastic polyurethane material (TPU), and/or other suitable types of materials to absorb shock, isolate vibration, and/or dampen noise. A plate portion 500 (FIG. 5) may cover the interior cavity 900 from the sole portion 180. The plate portion 500 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the plate portion 500 may be partially or entirely made of a non-metal material (e.g., composite, plastic, etc.) with one shown as 1300 in FIG. 13. The apparatus, methods, and articles of manufacture described herein are not limited in this regard.

As illustrated in FIG. 8, the first and second visual guide portions 122 and 124, respectively, may be located a distance from a first vertical plane 880 and a second vertical plane 885, respectively. For example, the first visual guide portion 122 may be located less than one inch (25.4 millimeters) from the first vertical plane 880 and the second visual guide portion 124 may be located less than one inch (25.4 millimeters) from the second vertical plane 885. Further, a distance 400 (FIG. 4) may separate the first and second visual guide portions 122 and 124, which may be greater than a diameter of a golf ball (e.g., 1.68 inches or 42.67 millimeters). In one example, the distance 400 may be greater than three inches (76.2 millimeters). In another example, the distance 400 may be about 3.75 inches (95.25 millimeters). The apparatus, methods, and articles of manufacture described herein are not limited in this regard.

The first and second visual guide portions 122 and 124 may be located relative to the periphery of the golf club head 100. In one example, the first visual guide portion 122 may be located less than 0.5 inch (12.7 millimeters) from the periphery at or proximate to the toe portion 130 whereas the second visual guide portion 124 may be located less than 0.5 inch (12.7 millimeters) from the periphery at or proximate to the heel portion 140. In one example, each of the first and second visual guide portions 122 and 124 may extend about a maximum length 405 between the front and rear portions 150 and 160. In another example, each of the first and second visual guide portions 122 and 124 may extend less than 50% of the maximum length 405 between the front and rear portions 150 and 160. In yet another example, each of the first and second visual guide portions 122 and 124 may extend between 50% and 100% of the maximum length 405 between the front and rear portions 150 and 160. The apparatus, methods, and articles of manufacture described herein are not limited in this regard.

Each of the first and second visual guide portions 122 and 124, respectively, may be dotted lines formed by two or more weight portions, generally shown as a first set of weight portions 420 (e.g., shown as weight portions 421, 422, 423, 424, and 425) and a second set of weight portions 440 (e.g., shown as weight portions 441, 442, 443, 444, and 445). In a similar manner, the third visual guide portion 126 may be a dotted line formed by two or more weight portions, generally shown as a third set of weight portions 460 (e.g., shown as weight portions 461, 462, 463, 464, 465, 466, 467, and 468). The first, second, and third sets of weight portions 420, 440, and 460, respectively, may be partially or entirely made of a high-density material such as a tungsten-based material or suitable types of materials. Alternatively, the first, second, and third sets of weight portions 420, 440, and 460, respectively, may be partially or entirely made of any metal material or non-metal material (e.g., composite, plastic, etc.). The apparatus, methods, and articles of manufacture described herein are not limited in this regard.

Figure 10:
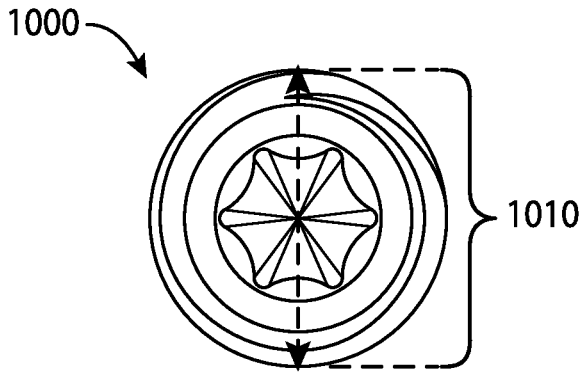
FIG. 10 depicts a top view of a weight portion associated with the example golf club head of FIG. 1.
Figure 11:
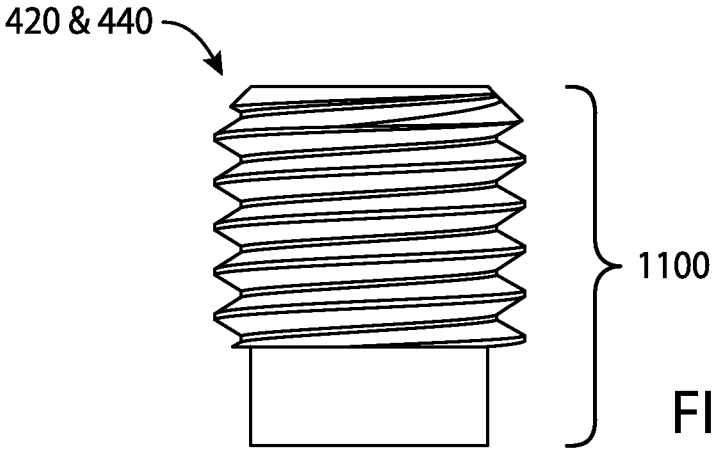
FIG. 11 depicts a side view of a weight portion associated with the example golf club head of FIG. 1.
Figure 12:
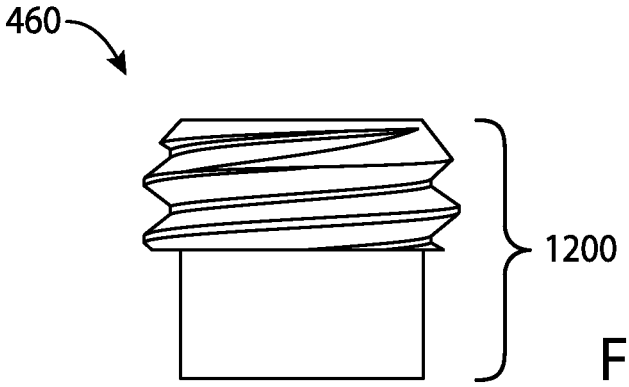
FIG. 12 depicts a side view of another weight portion associated with the example golf club head of FIG. 1.
Figure 13:
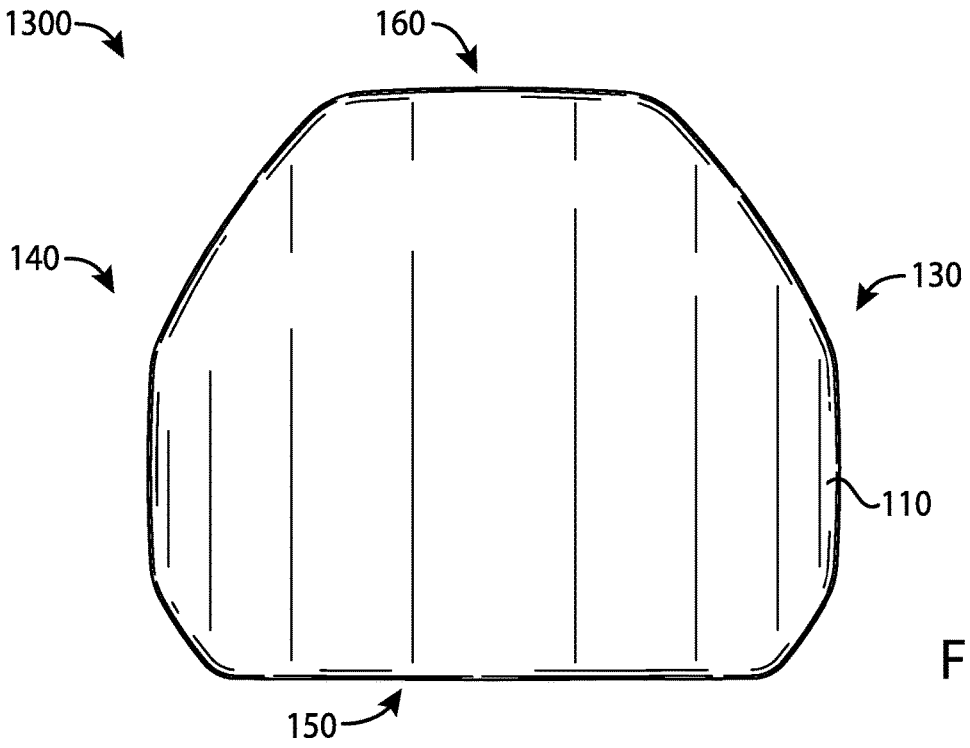
FIG. 13 depicts a bottom view of another example body portion of FIG. 1.

The first, second, and third sets of weight portions 420, 440, and 460, respectively, may have similar or different physical properties (e.g., density, shape, mass, volume, size, color, etc.). In the illustrated example as shown in FIGS. 10-12, each of the weight portions of the first, second, and third sets of weight portions 420, 440, and 460 may have a cylindrical shape (e.g., a circular cross section). Alternatively, each of the weight portions of the first and second sets of weight portions 420 and 440 may have a first shape (e.g., a cylindrical shape) whereas each of the weight portions of the third set of weight portions 460 may have a second shape (e.g., a rectangular shape). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

Further, each of the weight portions of the first, second, and third sets of weight portions 420, 440, and 460, respectively, may have a diameter 1010 (FIG. 10) of about 0.25 inch (6.35 millimeters) but the first, second, and third sets of weight portions 420, 440, and 460, respectively, may be different in height. In particular, each of the weight portions of the first and second sets of weight portions 420 and 440 may be associated with a first height 1100 (FIG. 11), and each of the weight portions of the third set of weight portions 460 may be associated with a second height 1200 (FIG. 12). The first height 1100 may be relatively longer than the second height 1200. In one example, the first height 1100 may be about 0.3 inch (7.62 millimeters) whereas the second height 1200 may be about 0.16 inch (4.06 millimeters). Alternatively, the first height 1100 may be equal to or less than the second height 1200. The apparatus, methods, and articles of manufacture described herein are not limited in this regard.

The first and second sets of weight portions 420 and 440, respectively, may include threads to secure in the weight ports. For example, each weight portion of the first and second sets of weight portions 420 and 440 may be a screw. The first and second sets of weight portions 420 and 440, respectively, may not be readily removable from the body portion 110 with or without a tool. Alternatively, the first and second sets of weight portions 420 and 440, respectively, may be readily removable (e.g., with a tool) so that a relatively heavier or lighter weight portion may replace one or more of the weight portions of the first and second sets 420 and 440, respectively. In another example, the first and second sets of weight portions 420 and 440, respectively, may be secured in the weight ports of the body portion 110 with epoxy or adhesive so that the first and second sets of weight portions 420 and 440, respectively, may not be readily removable. In yet another example, the first and second sets of weight portions 420 and 440, respectively, may be secured in the weight ports of the body portion 110 with both epoxy and threads so that the first and second sets of weight portions 420 and 440, respectively, may not be readily removable. The apparatus, methods, and articles of manufacture described herein are not limited in this regard.

Figure 4:
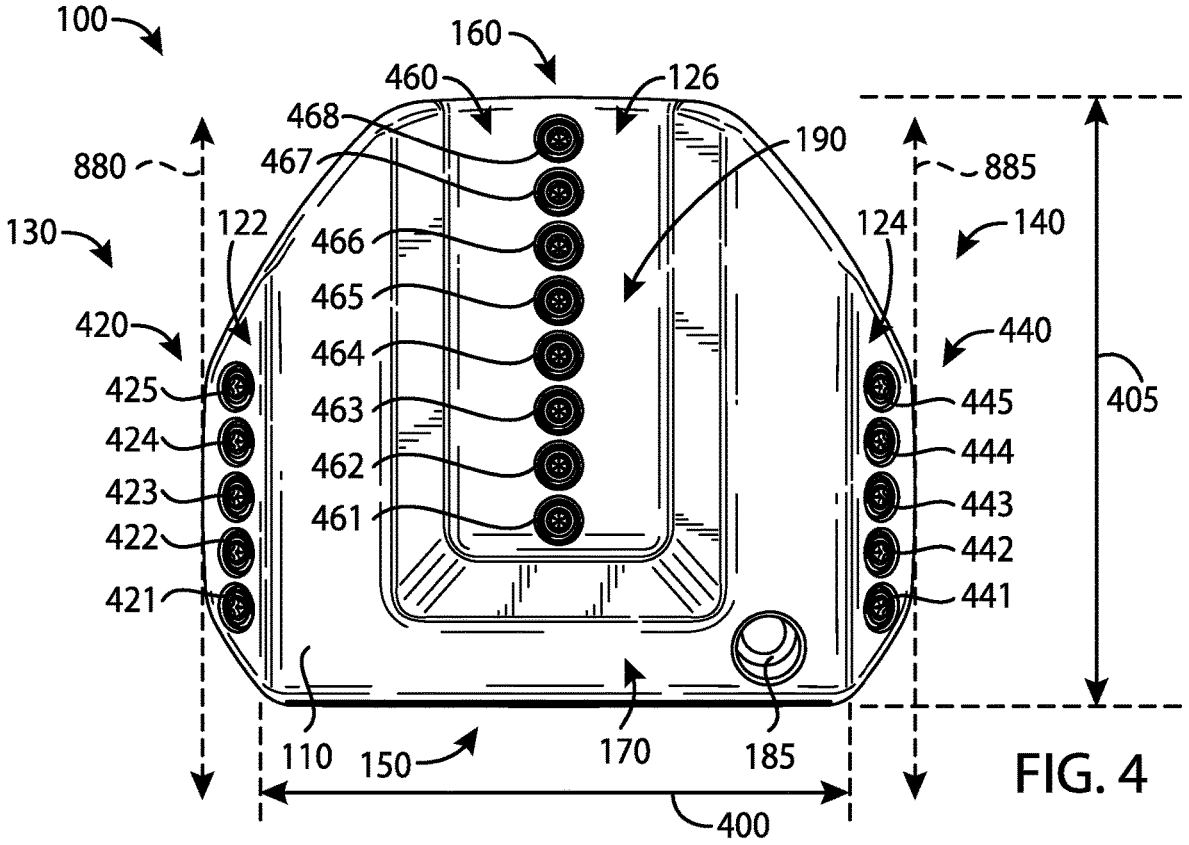
FIG. 4 depicts a top view of the example golf club head of FIG. 1.
Figure 5:
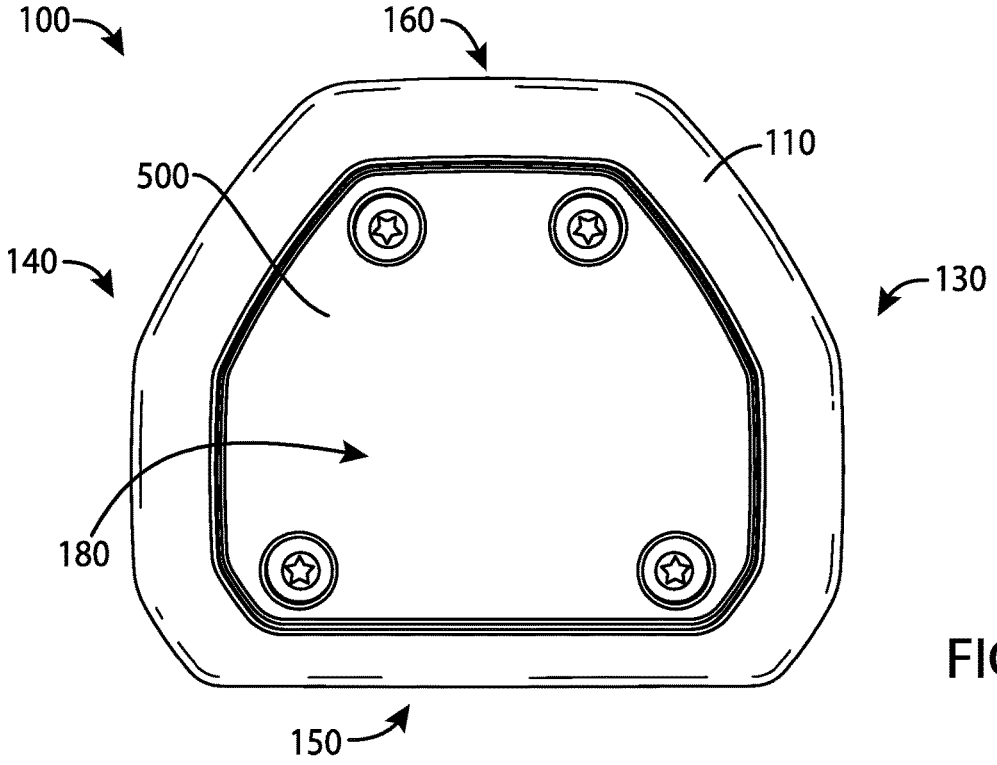
FIG. 5 depicts a bottom view of the example golf club head of FIG. 1.
Figure 6:
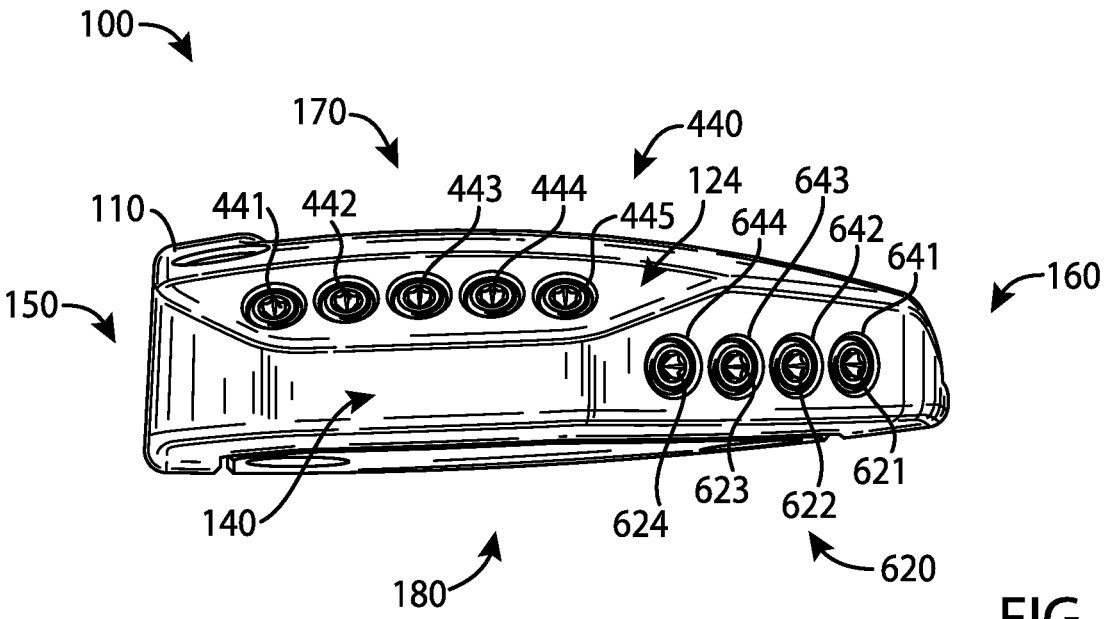
FIG. 6 depicts a left view of the example golf club head of FIG. 1.
Figure 7:
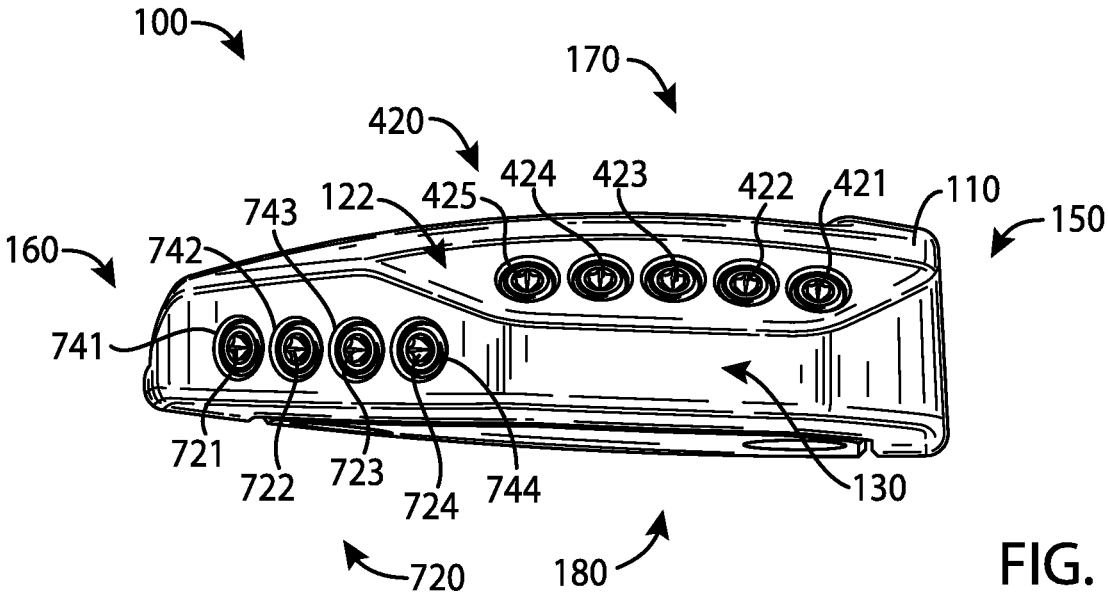
FIG. 7 depicts a right view of the example golf club head of FIG. 1.

As illustrated in FIGS. 6 and 7, the golf club head 100 may also include a fourth set of weight portions 620 (e.g., shown as weight portions 621, 622, 623, and 624) and a fifth set of weight portions 720 (e.g., shown as weight portions 721, 722, 723, and 724). Although both the fourth and fifth sets of weight portions 620 and 720 may be located at or proximate to the rear portion 160, the fourth set of weight portions 620 may be located at or proximate to the heel portion 140 whereas the fifth set of weight portions 720 may be at or proximate to the toe portion 130. Each of the fourth and fifth sets of weight portions 620 and 720 may include at least three weight portions. Each weight portion of the fourth and fifth sets of weight portions 620 and 720 may be coupled (e.g., via threads) to a corresponding weight port (e.g., shown as weight ports 641, 642, 643, 644, 741, 742, 743, and 744) on the periphery of the body portion 110. The corresponding weight ports may be spaced apart and have port diameters similar or different to any one or more of the first, second, and third port diameters 850, 855, and 870 associated with the first, second, and third sets of weight ports 820, 840, and 860. In one example, as shown in FIG. 4, the fourth and fifth sets of weight portions 620 and 720 and the corresponding weight ports may not be visible when the club head 100 is directly viewed from the top. The apparatus, methods, and articles of manufacture described herein are not limited in this regard.

Figure 14:
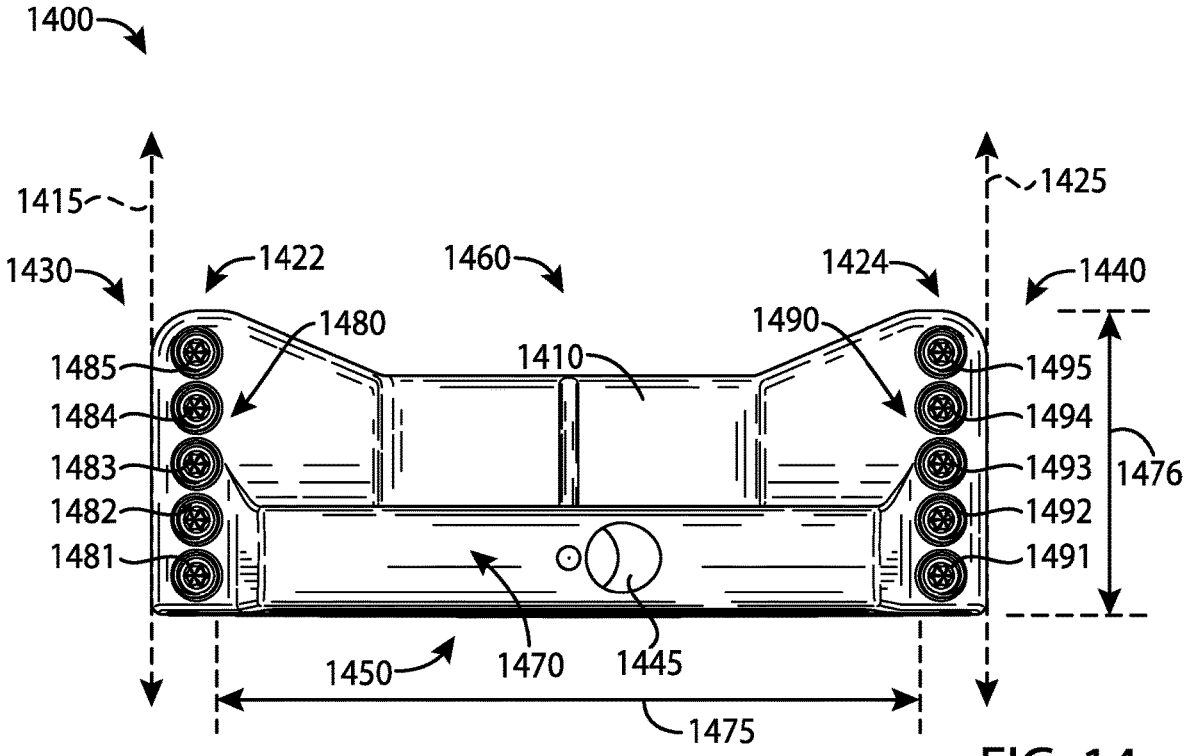
FIG. 14 depicts a top view of a golf club head according to another example of the apparatus, methods, and articles of manufacture described herein.

Although the above examples may describe a particular number of visual guide portions, weight ports, and weight portions, the apparatus, methods, and articles of manufacture described herein may include more or less visual guide portions, weight ports, and/or weight portions. While the golf club head 100 illustrated in FIGS. 1-9 may depict a particular type of putter club head (e.g., a mallet-type putter club head), the apparatus, methods, and articles of manufacture described herein may be applicable to other types of putters. For example, as illustrated in FIG. 14, the apparatus, methods, and articles of manufacture described herein may be applicable to a blade-type putter golf club head 1400. The golf club head 1400 may include a body portion 1410, and a visual guide portion, generally shown as a first visual guide portion 1422 and a second visual guide portion 1424. The body portion 1410 may include a toe portion 1430, a heel portion 1440, a front portion 1450, a rear portion 1460, a sole portion (not shown), and a top portion 1470. The body portion 1410 may also include a bore 1445 to receive a shaft (not shown). Alternatively, the body portion 1410 may include a hosel (not shown) to receive a shaft. The body portion 1410 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 1410 may be partially or entirely made of a non-metal material (e.g., composite, plastic, etc.). The apparatus, methods, and articles of manufacture described herein are not limited in this regard.

The first and second visual guide portions 1422 and 1424, respectively, may be located a particular distance from a first vertical plane 1415 and a second vertical plane 1425, respectively. For example, the first visual guide portion 1422 may be located less than one inch (25.4 millimeters) from the first vertical plane 1415 and the visual guide portion 1424 may be located less than one inch (25.4 millimeters) from the second vertical plane 1425. Further, a distance 1475 may separate the first and second visual guide portions 1422 and 1424, which may be greater than a diameter of a golf ball. In one example, the distance 1475 may be greater than three inches (76.2 millimeters). In another example, the distance 1475 may be about 3.75 inches (95.25 millimeters).

The first and second visual guide portions 1422 and 1424 may be located relative to a periphery of the golf club head 1400. In one example, the first visual guide portion 1422 may be located less than 0.5 inch (12.7 millimeters) from the periphery at or proximate to the toe portion 1430 whereas the second visual guide portion 1424 may be located less than 0.5 inch (12.7 millimeters) from the periphery at or proximate to the heel portion 1440. In one example, each of the first and second visual guide portions 1422 and 1424 may extend about a maximum length 1476 between the front and rear portions 1450 and 1460. In another example, each of the first and second visual guide portions 1422 and 1424 may extend less than 50% of the maximum length 1476 between the front and rear portions 1450 and 1460. In yet another example, each of the first and second visual guide portions 1422 and 1424 may extend between 50% and 100% of the maximum length 1476 between the front and rear portions 1450 and 1460. The apparatus, methods, and articles of manufacture described herein are not limited in this regard.

Each of the first and second visual guide portions 1422 and 1424, respectively, may be dotted lines formed by two or more weight portions, generally shown as a first set of weight portions 1480 (e.g., shown as weight portions 1481, 1482, 1483, 1484, and 1485) and a second set of weight portions 1490 (e.g., shown as weight portions 1491, 1492, 1493, 1494, and 1495). The first and second sets of weight portions 1480 and 1490, respectively, may be partially or entirely made of a high-density material such as a tungsten-based material or suitable types of materials. Alternatively, the first and second sets of weight portions 1480 and 1490, respectively, may be partially or entirely made of a non-metal material (e.g., composite, plastic, etc.). The apparatus, methods, and articles of manufacture described herein are not limited in this regard.

The first and second sets of weight portions 1480 and 1490, respectively, may have similar or different physical properties (e.g., density, shape, mass, volume, size, color, etc.). In the illustrated example as shown in FIGS. 10-12, each of the weight portions of the first and second sets of weight portions 1480 and 1490 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

The first and second sets of weight portions 1480 and 1490, respectively, may include threads to secure in the weight ports, which may also have corresponding threads. For example, each weight portion of the first and second sets of weight portions 1480 and 1490 may be a screw. The first and second sets of weight portions 1480 and 1490, respectively, may not be readily removable from the body portion 1410 with or without a tool. Alternatively, the first and second sets of weight portions 1480 and 1490, respectively, may be readily removable (e.g., with a tool) so that a relatively heavier or lighter weight portion may replace one or more of the weight portions of the first and second sets of weight portions 1480 and 1490, respectively. In another example, the first and second sets of weight portions 1480 and 1490, respectively, may be secured in the weight ports of the body portion 1410 with epoxy or adhesive so that the first and second sets of weight portions 1480 and 1490, respectively, may not be readily removable. In yet another example, the first and second sets of weight portions 1480 and 1490, respectively, may be secured in the weight ports of the body portion 1410 with both epoxy and threads so that the first and second sets of weight portions 1480 and 1490, respectively, may not be readily removable. The apparatus, methods, and articles of manufacture described herein are not limited in this regard.

Figure 15:
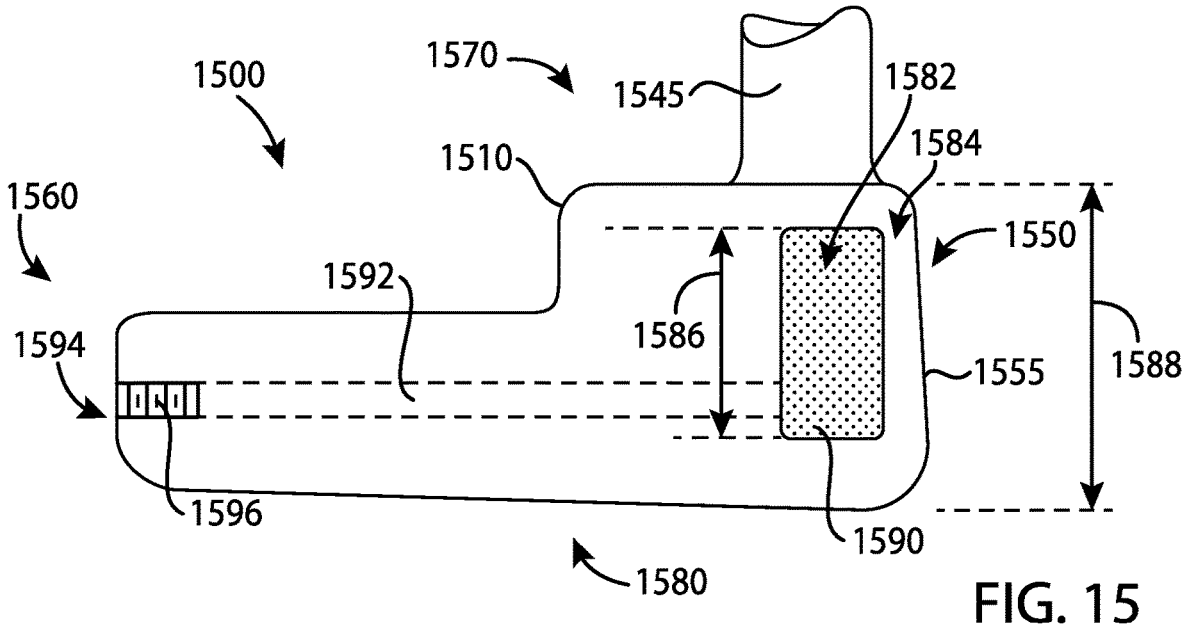
FIG. 15 depicts a schematic cross-sectional view of a golf club head according to yet another example of the apparatus, methods and articles of manufacture described herein.
Figure 16:
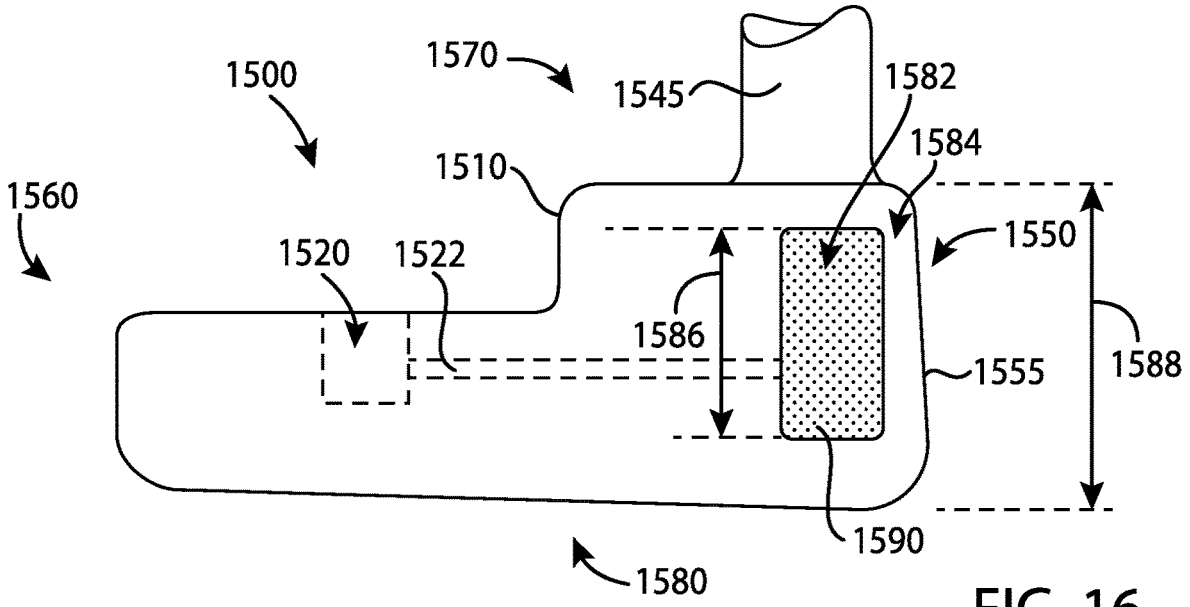
FIG. 16 depicts a schematic cross-sectional view of another example of the golf club head of FIG. 15.

In the example of FIGS. 15 and 16, a golf club head 1500 may include a body portion 1510. The body portion 1510 may include a toe portion (not shown), a heel portion (not shown), a front portion 1550, a rear portion 1560, a top portion 1570, and a sole portion 1580. The body portion 1510 may be manufactured via various manufacturing methods and/or processes (e.g., a casting process, a forging process, a milling process, a cutting process, a grinding process, a welding process, a combination thereof, etc.). The body portion 1510 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 1510 may be partially or entirely made of non-metal material (e.g., composite, plastic, etc.). The golf club head 1500 may be a putter-type golf club head (e.g., a blade-type putter, a mid-mallet-type putter, a mallet-type putter, etc.). Based on the type of putter as mentioned above, the body portion 1510 may be at least 200 grams. For example, the body portion 1510 may be in a range between 300 to 600 grams. Although FIGS. 15 and 16 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 1510 may include a hosel portion 1545 configured to receive a shaft (not shown) with a grip (not shown). The golf club head 1500 and the grip may be located on opposite ends of the shaft to form a golf club. The front and rear portions 1550 and 1560, respectively, may be on opposite ends of the body portion 1510. The front portion 1550 may include a face portion 1555 (e.g., a strike face). The face portion 1555 may be used to impact a golf ball. The face portion 1555 may be an integral portion of the body portion 1510. Alternatively, the face portion 1555 may be a separate piece or an insert coupled to the body portion 1510 via various manufacturing methods and/or processes (e.g., a bonding process, a welding process, a brazing process, a mechanical locking method, a mechanical fastening method, any combination thereof, or other suitable types of manufacturing methods and/or processes). The face portion 1555 may be associated with a loft plane that defines the loft angle of the golf club head 1500. The apparatus, methods, and articles of manufacture described herein are not limited in this regard.

The body portion 1510 may include one or more weight ports and one or more weight portions similar to any of the golf club heads described herein. For example, a weight port 1520 is shown in FIG. 16. For example, the body portion 1510 may include a first set of weight ports (not shown) similar to the first set of weight ports 820 of the golf club head 100 and a second set of weight ports (not shown) similar to the second set of weight ports 840 of the golf club head 100 that are configured to receive a plurality of weight portions. Accordingly, a detailed description of the weight ports and weight portions of the golf club 1500 is not described. Alternatively, the body portion 1510 may not include any weight ports and/or weight portions.

The body portion 1510 may be a hollow body including an interior cavity 1582 extending between the front portion 1550 and the rear portion 1560. Further, the interior cavity 1582 may extend between the top portion 1570 and the sole portion 1580. A cavity wall portion 1584 may separate the interior cavity 1582 and the face portion 1555. The interior cavity 1582 may be associated with a cavity height 1586 ($H_C$) and the body portion 1510 may be associated with a body height 1588 ($H_B$). While the cavity height 1586 and the body height 1588 may vary between the toe and heel portions, the cavity height 1586 may be at least 50% of the body height 1588 ($H_C>0.5*H_B$). For example, the cavity height 1586 may vary between 70% and 85% of the body height 1588. With the cavity height 1586 of the interior cavity 1582 being greater than 50% of the body height 1588, the golf club head 1500 may produce relatively more consistent feel, sound, and/or result when the golf club head 1500 strikes a golf ball via the face portion 1555 than a golf club head with a cavity height of less than 50% of the body height. However, the cavity height 1586 may be less than 50% of the body height 1588. The apparatus, methods, and articles of manufacture described herein are not limited in this regard.

In one example, the interior cavity 1582 may be unfilled (i.e., empty space). Alternatively, the interior cavity 1582 may be partially or entirely filled with a filler material (e.g., generally shown as 1590). The filler material 1590 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 1582 may be filled with a TPE material to absorb shock, isolate vibration, and/or dampen noise when the golf club head 1500 strikes a golf ball via the face portion 1555. The apparatus, methods, and articles of manufacture described herein are not limited in this regard.

In another example, the filler material 1590 may be a polymer material such as an ethylene copolymer material to absorb shock, isolate vibration, and/or dampen noise when the golf club head 1500 strikes a golf ball via the face portion 1555. In particular, at least 50% of the interior cavity 1582 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material 1590 may be injected into the interior cavity 1582 by an injection molding process via a port 1592 on the body portion 1510 as shown in FIG. 15. The port 1592 may have an opening 1594 on the body portion 1510 to allow injection of the filler material into the interior cavity 1582 through the port 1592. The port 1592 may have a plug 1596, by which the opening 1594 may be closed after injection of the filler material 1590 into the interior cavity 1582. Alternatively, as shown in the example of FIG. 16, at least one of the weight ports (e.g., 1520) on the body portion 1510 may be connected to the interior cavity 1582 through a connection port 1522 that may be similar to the port 1592. Accordingly, the filler material may be injected into the interior cavity 1582 from the at least one weight port (e.g., 1520) through the connection port 1522. The apparatus, methods, and articles of manufacture described herein are not limited in this regard.

For example, at least 50% of the interior cavity 1582 may be filled with a TPE material to absorb shock, isolate vibration, dampen noise, and/or provide structural support when the golf club head 1500 strikes a golf ball via the face portion 1555. With the support of the cavity wall portion 1584 and filling at least a portion of the interior cavity 1582 with an elastic polymer material, the face portion 1555 may be relatively thin without degrading the structural integrity, sound, and/or feel of the golf club head 1500. In one example, the face portion 1555 may have a thickness of less than or equal to 0.075 inch or 1.905 millimeters (e.g., the thickness of the cavity wall portion 1584). In another example, the face portion 1555 may have a thickness of less than or equal to 0.060 inch (1.524 millimeters). In yet another example, the face portion 1555 may have a thickness of less than or equal to 0.050 inch (1.270 millimeters). Further, the face portion 1555 may have a thickness of less than or equal to 0.030 inch (0.762 millimeters). The apparatus, methods, and articles of manufacture described herein are not limited in this regard.

Figure 17:
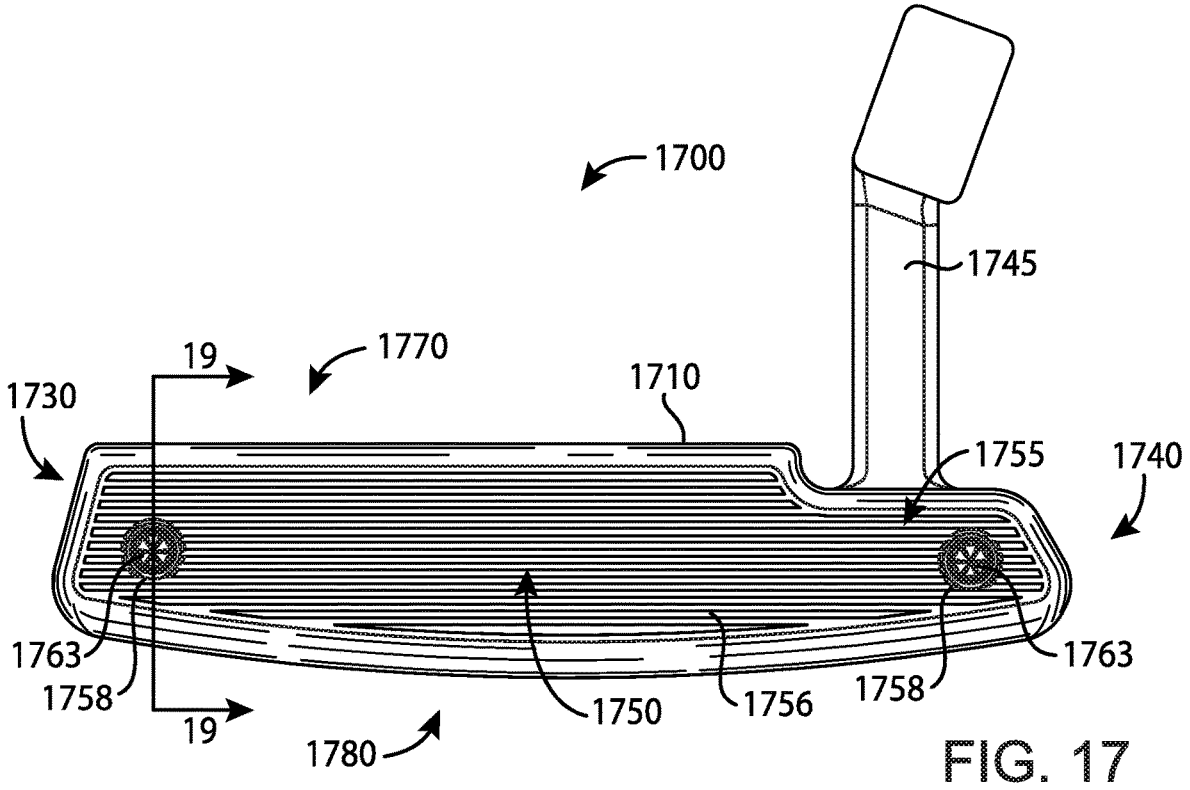
FIG. 17 depicts a front view of a golf club head according to yet another example of the apparatus, methods, and articles of manufacture described herein.
Figure 18:
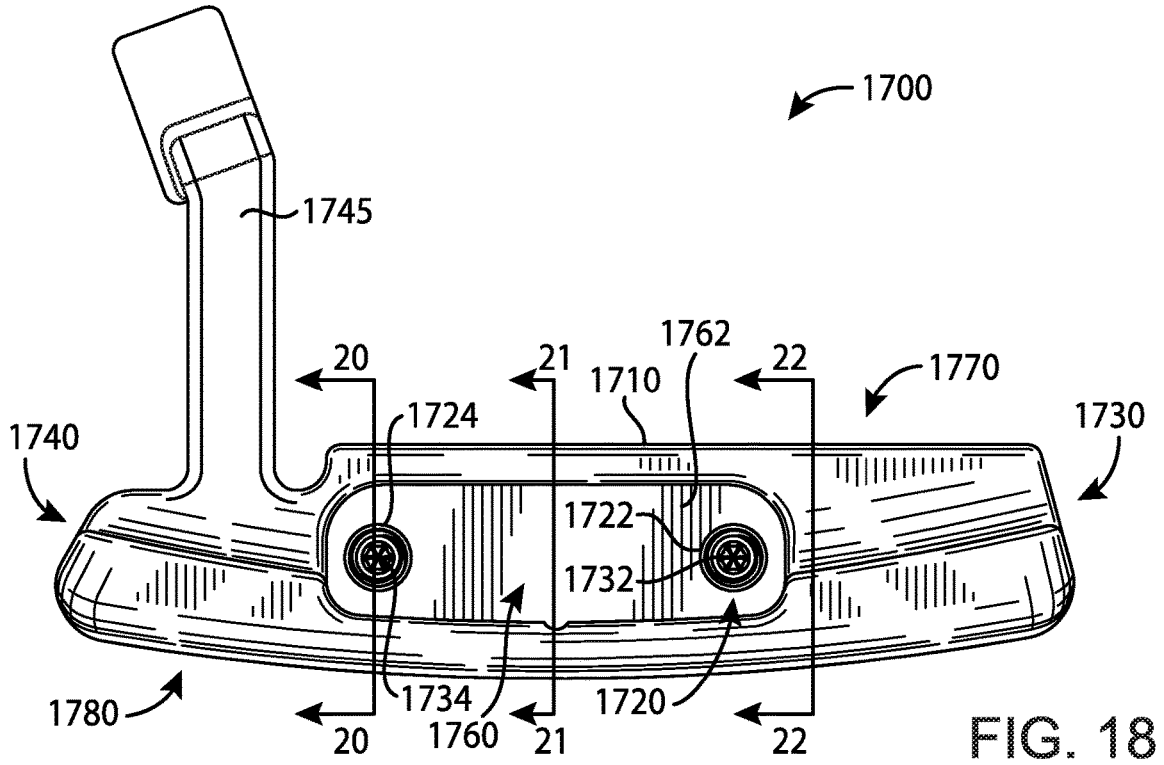
FIG. 18 depicts a rear view of the golf club head of FIG. 17.
Figure 19:
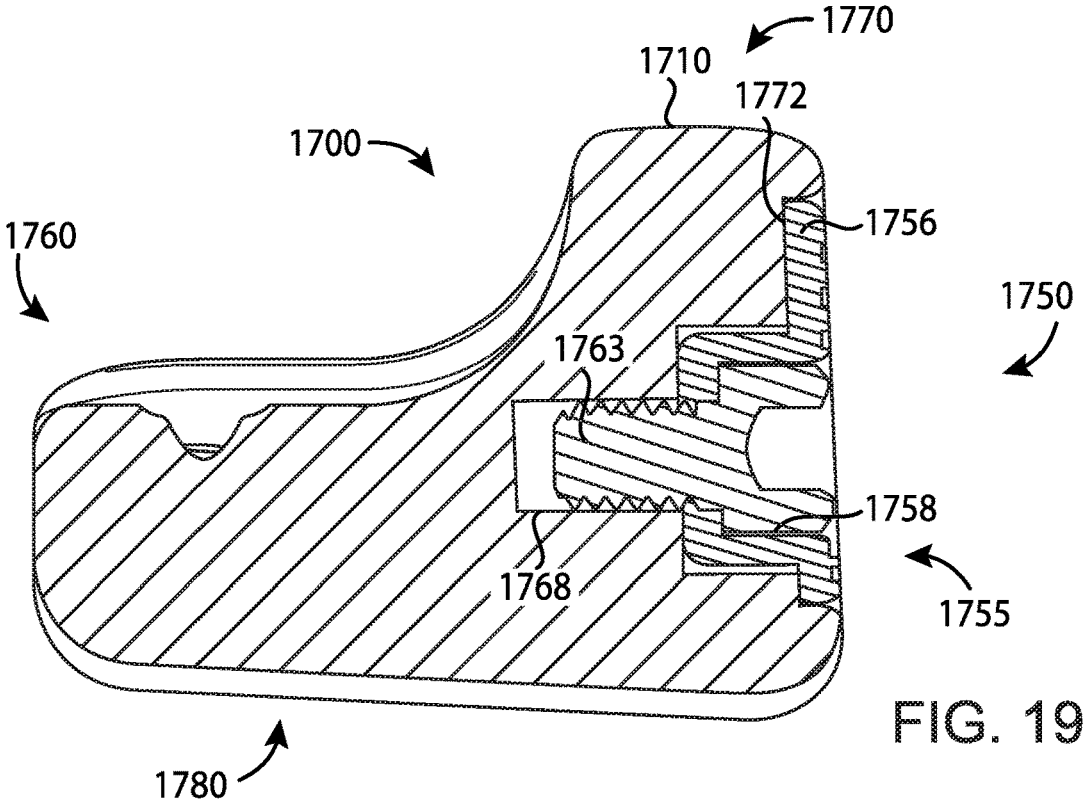
FIG. 19 depicts a cross-sectional view of the golf club head of FIG. 17 at lines 19-19 of FIG. 17.

In the example of FIGS. 17 and 18, a golf club head 1700 may include a body portion 1710. The body portion 1710 may include a toe portion 1730, a heel portion 1740, a front portion 1750, a rear portion 1760, a top portion 1770, and a sole portion 1780. The body portion 1710 may be manufactured via various manufacturing methods and/or processes (e.g., a casting process, a forging process, a milling process, a cutting process, a grinding process, a welding process, a combination thereof, etc.). The body portion 1710 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 1710 may be partially or entirely made of non-metal material (e.g., composite, plastic, etc.). The golf club head 1700 may be a putter-type golf club head (e.g., a blade-type putter, a mid-mallet-type putter, a mallet-type putter, etc.). Based on the type of putter as mentioned above, the body portion 1710 may be at least 200 grams. For example, the body portion 1710 may be in a range between 300 to 600 grams. Although FIGS. 17 and 18 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 1710 may include a hosel portion 1745 configured to receive a shaft (not shown) with a grip (not shown). The golf club head 1700 and the grip may be located on opposite ends of the shaft to form a golf club. The front and rear portions 1750 and 1760, respectively, may be on opposite ends of the body portion 1710. The front portion 1750 may include a face portion 1755 (e.g., a strike face). The face portion 1755 may be used to impact a golf ball. The face portion 1755 may be associated with a loft plane that defines the loft angle of the golf club head 1700. The apparatus, methods, and articles of manufacture described herein are not limited in this regard.

The body portion 1710 may include one or more weight ports and one or more weight portions similar to any of the golf club heads described herein. For example, the body portion 1710 may include a first set of weight ports 1720 at or proximate the rear portion 1760. In the examples of FIGS. 17-22, the rear portion 1760 may include a back wall portion 1762 having a first weight port 1722 of the first set of weight ports 1720 and a second weight port 1724 of the first set of weight ports 1720. The first weight port 1722 may be closer to the toe portion 1730 than the second weight port 1724. The second weight port 1724 may be closer to the heel portion 1740 than the first weight port 1722. The first and second weight ports 1722 and 1724, respectively, may be at any location on the back wall portion 1762 or the rear portion 1760. Alternatively, the body portion 1710 may not include any weight ports on the back wall portion 1762. The apparatus, methods, and articles of manufacture described herein are not limited in this regard.

Figure 20:
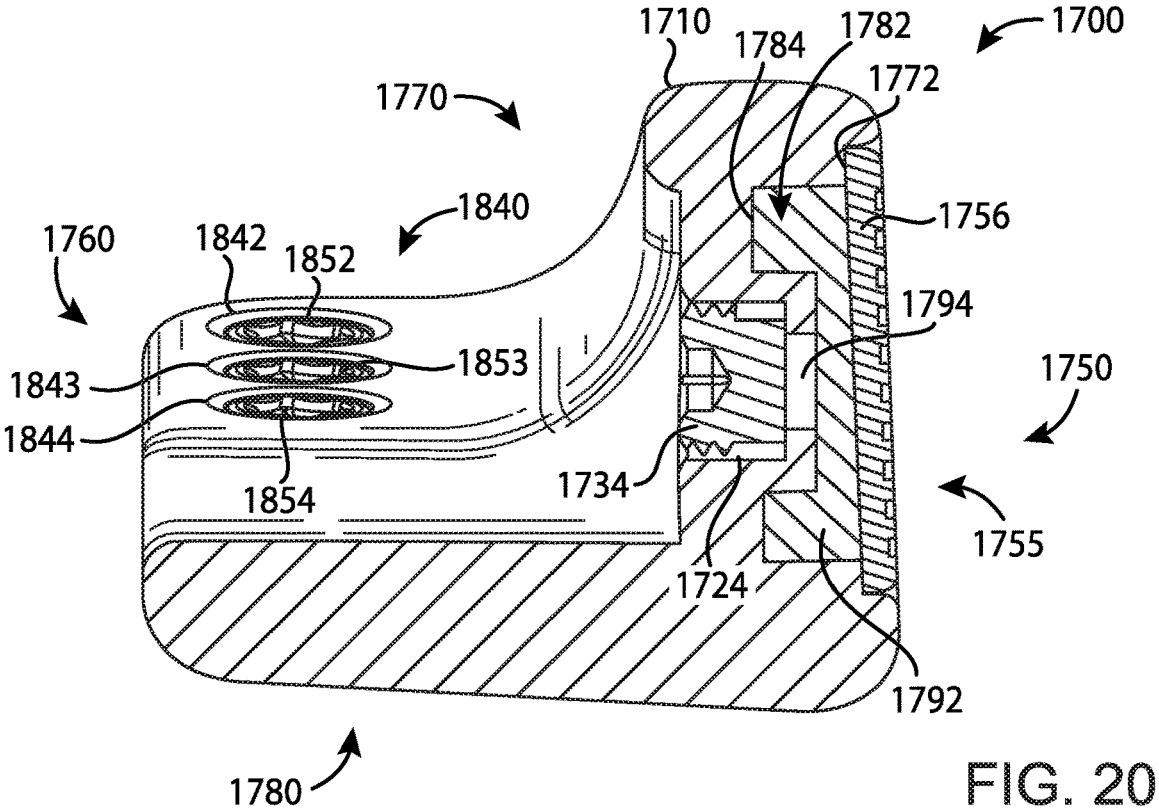
FIG. 20 depicts a cross-sectional view of the golf club head of FIG. 17 at lines 20-20 of FIG. 18.

In the example of FIGS. 17-22, the body portion 1710 may include a second set of weight ports 1840 as shown in FIG. 20 proximate to the heel portion 1740 and extending between the toe portion 1730 and the heel portion 1740. The second set of weight ports 1840 may include any number of weight ports, such as three weight ports as shown in FIG. 20 as weight ports 1842, 1843, and 1844. The body portion 1710 may include a third set of weight ports 1860 that may be located near the toe portion 1730 and extend between the toe portion 1730 and the heel portion 1740. The third set of weight ports 1860 may include any number of weight ports, such as three weight ports similar to the weight ports of the second set of weight ports 1840. The second and third sets of weight ports 1840 and 1860, respectively, may be similar to each other and symmetrically arranged relative to a midpoint of the body portion 1710. The apparatus, methods, and articles of manufacture described herein are not limited in this regard.

Figure 22:
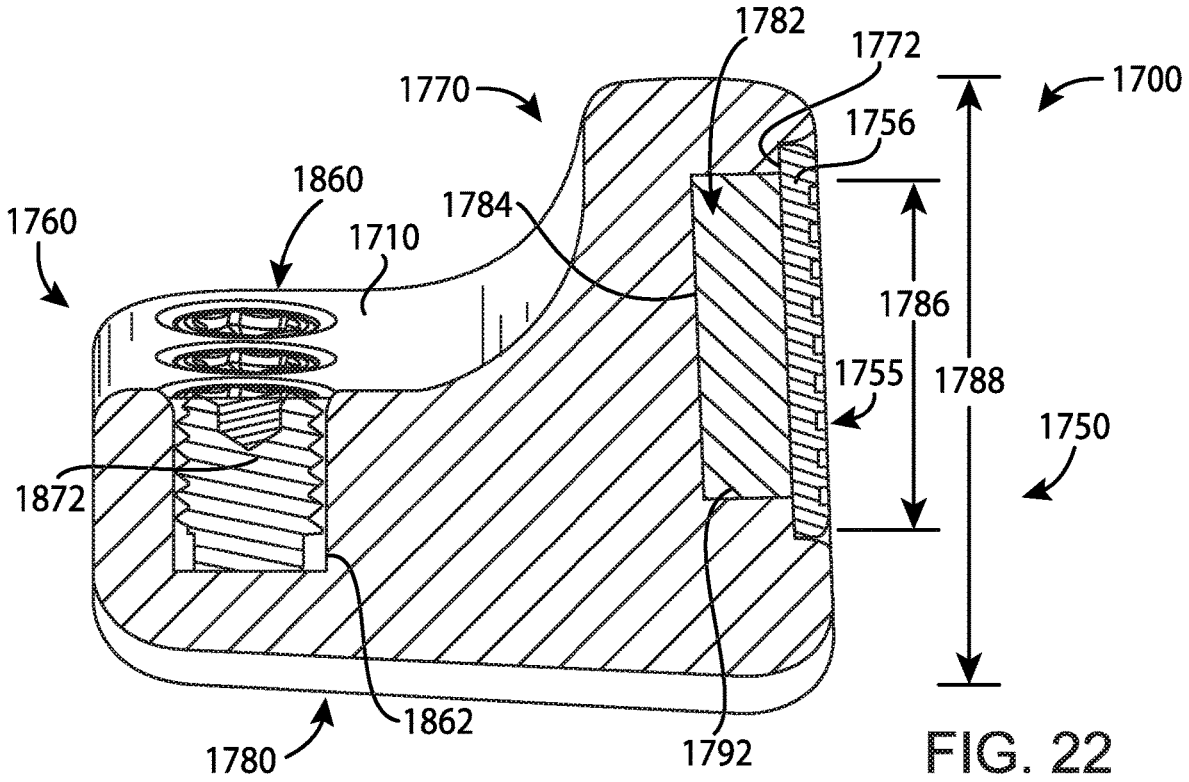
FIG. 22 depicts a cross-sectional view of the golf club head of FIG. 17 at lines 22-22 of FIG. 18.

The golf club head 1700 may include a plurality of weight portions. Each weight port of the first, second, and third sets of weight ports 1720, 1840, and 1860 may be configured to receive a weight portion. For example, the first and second weight ports 1722 and 1724 of the first set of weight ports 1720 may receive weight portions 1732 and 1734, respectively. The weight ports 1842, 1843, and 1844 of the second set of weight ports 1840 may receive weight portions 1852, 1853, and 1854, respectively. The weight ports of the third set of weight ports 1860 may receive weight portions similar to the second set of weight ports 1840. In the example of FIG. 22, a weight port 1862 of the third set of weight ports 1860 is shown to have received a weight portion 1872. The configurations of the weight ports and the weight portions (e.g., inner diameter, outer diameter, size, shape, distance from an adjacent weight port or weight portion, etc.) of the golf club head 1700 may be similar in many respects to the weight ports and weight portions of any of the golf club heads descried herein. Accordingly, a detailed description of the weight ports and weight portions of the golf club 1700 is not described. Alternatively, the body portion 1710 may not include any weight ports and/or weight portions. The apparatus, methods, and articles of manufacture described herein are not limited in this regard.

In the example of FIGS. 17-22, the face portion 1755 may include a separate piece or an insert coupled to the body portion 1710. The face portion 1755 may include a face insert 1756, which may be attached to the front portion 1750 via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIGS. 17 and 19, the face insert 1756 may include two fastener holes 1758 proximate to the toe portion and heel portion of the face insert 1756. Each of the fastener holes 1758 may be configured to receive a fastener 1763 for attachment of the face insert 1756 to the body portion 1710. The body portion 1710 may include two fastener ports 1768 (one fastener port 1768 shown in FIG. 19) configured to receive the fasteners 1763. Each fastener port 1768 may have internal threads that are configured to engage external threads on the fasteners 1763. The apparatus, methods, and articles of manufacture described herein are not limited in this regard.

The face portion 1755 may include a peripheral recessed portion 1772 configured to receive the face insert 1756. As shown by example in FIGS. 19-22, the depth of the peripheral recessed portion 1772 may be similar to the thickness of the face insert 1756 such that when the face insert 1756 is fastened to the body portion 1710, the face insert 1756 is positioned flush or substantially flush with the face portion 1755. Alternatively, the face insert 1756 may project from the face portion 1755. The apparatus, methods, and articles of manufacture described herein are not limited in this regard.

The fasteners 1763 may have similar or different weights to balance and/or provide heel or toe weight bias for the golf club 1700. For example, the weight of the body portion 1710 may be increased or decreased by similarly increasing or decreasing, respectively, the weights of the fasteners 1763. In one example, the golf club head 1700 may be provided with a toe-biased weight configuration by having the fastener 1763 that is closer to the toe portion 1730 be heavier than the fastener 1763 that is closer to the heel portion 1740. Conversely, the golf club head 1700 may be provided with a heel-biased weight configuration by having the fastener 1763 that is closer to the heel portion 1740 be heavier than the fastener 1763 that is closer to the toe portion 1730. The apparatus, methods, and articles of manufacture described herein are not limited in this regard.

To attach the face insert 1756 to the body portion 1710, the face insert 1756 may be inserted in the peripheral recessed portion 1772, thereby generally aligning the fastener holes 1758 of the face insert 1756 and the fastener ports 1768 of the body portion 1710. The fasteners 1763 can be inserted through the fastener holes 1758 and screwed into the fastener ports 1768 to securely attach the face insert 1756 to the body portion 1710. The face insert 1756 may be constructed from any material such as metal, metal alloys, plastic, wood, composite materials or a combination thereof to provide a certain ball striking characteristic to the golf club head 1700. The material from which the face insert 1756 is manufactured may affect ball speed and spin characteristics. Accordingly, the face insert 1756 may be selected to provide a certain ball speed and spin characteristics for an individual. Thus, the face insert 1756 may be interchangeable with other face inserts having different ball speed and spin characteristics. The face insert 1756 may be coupled to the body portion 1710 by other methods or devices, such as by bonding, welding, adhesive and/or other types of fastening devices and/or methods. The apparatus, methods, and articles of manufacture described herein are not limited in this regard.

Figure 21:
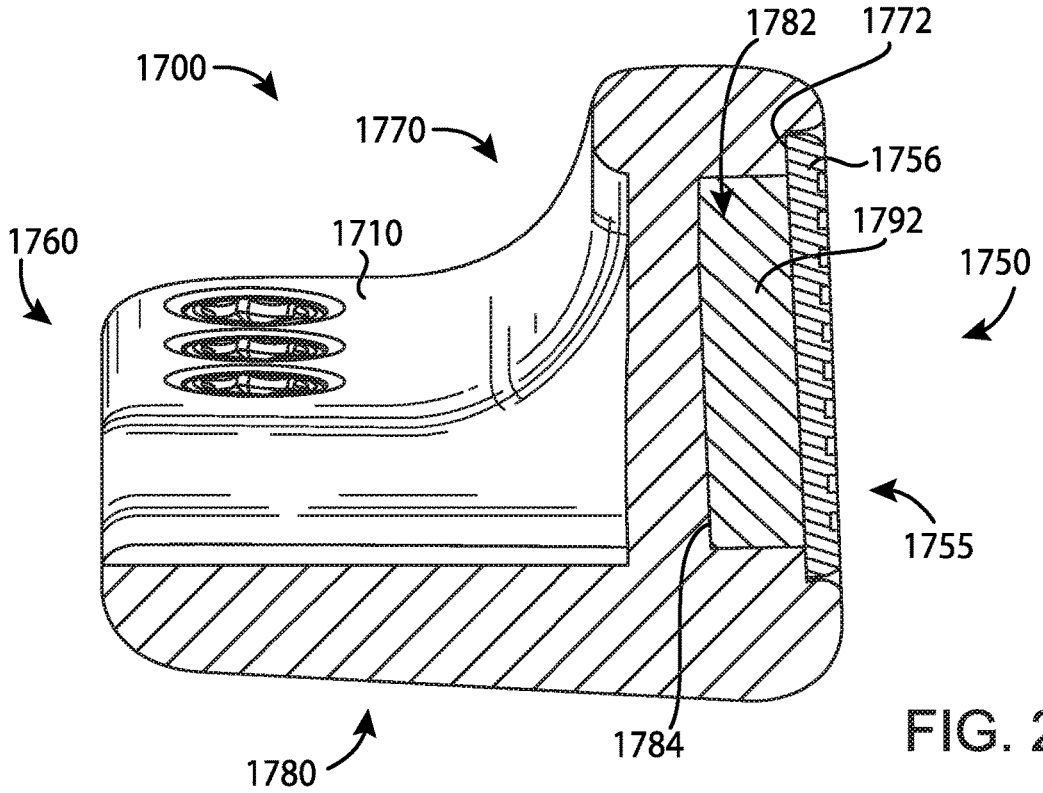
FIG. 21 depicts a cross-sectional view of the golf club head of FIG. 17 at lines 21-21 of FIG. 18.

The body portion 1710 may include an interior cavity 1782 extending between the front portion 1750 and the rear portion 1760 and between the toe portion 1730 and the heel portion 1740. In one example as shown in FIGS. 20-22, the interior cavity 1782 may be defined by a recess 1784 in the front portion 1750 that is covered by the face insert 1756. The recess 1784 may extend from near the toe portion 1730 to near the heel portion 1740 and from near the top portion 1770 to near the sole portion 1780. Alternatively, the recess 1784 may extend between the fastener ports 1768 of the body portion 1710. In one example, the recess 1784 may be located in and/or near the regions of the face portion 1755 that generally strike a golf ball. The apparatus, methods, and articles of manufacture described herein are not limited in this regard.

The interior cavity 1782 may be associated with a cavity height 1786 ($H_C$) and the body portion 1710 may be associated with a body height 1788 ($H_B$). While the cavity height 1786 and the body height 1788 may vary between the toe and heel portions 1730 and 1740, the cavity height 1786 may be at least 50% of a body height 1788 ($H_C>0.5*H_B$). For example, the cavity height 1786 may vary between 70% and 85% of the body height 1788. With the cavity height 1786 of the interior cavity 1782 being greater than 50% of the body height 1788, the golf club head 1700 may produce relatively more consistent feel, sound, and/or result when the golf club head 1700 strikes a golf ball via the face portion 1755 than a golf club head with a cavity height of less than 50% of the body height. However, the cavity height 1786 may be less than 50% of the body height 1788. The apparatus, methods, and articles of manufacture described herein are not limited in this regard.

In one example, the interior cavity 1782 may be unfilled (i.e., empty space). Alternatively, the interior cavity 1782 may be partially or entirely filled with a filler material 1792 to absorb shock, isolate vibration, and/or dampen noise when the face portion 1755 strikes a golf ball. The filler material 1792 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 1782 may be filled with a TPE material to absorb shock, isolate vibration, and/or dampen noise when the golf club head 1700 strikes a golf ball via the face portion 1755. The apparatus, methods, and articles of manufacture described herein are not limited in this regard.

In another example, the filler material 1792 may be a polymer material such as an ethylene copolymer material to absorb shock, isolate vibration, and/or dampen noise when the golf club head 1700 strikes a golf ball via the face portion 1755. In particular, at least 50% of the interior cavity 1782 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 1782 may be partially or fully filled with the filler material 1792. In one example, the recess 1784 may be filled with the filler material 1792 prior to attaching the face insert 1756 to the face portion 1755. In one example, the interior cavity 1782 may be filled with the filler material 1792 via any one of the first and second weight ports 1722 or 1724 of the first set of weight ports 1720. In one example as shown in FIG. 20, the second weight port 1724 may be connected to the interior cavity 1782 via an opening 1794. Similarly, the first weight port 1722 may be connected to the interior cavity 1782 via an opening (not shown). The filler material 1792 may be injected in the interior cavity 1782 from the second weight port 1724 via the opening 1794. As the filler material 1792 fills the interior cavity 1782, the air inside the interior cavity 1782 that is displaced by the filler material 1792 may exit the interior cavity 1782 from the first weight port 1722 through the opening (not shown) that connects the first weight port 1722 to the interior cavity 1782. Accordingly, the first weight port 1722 may function as an exit port for the displaced air inside the interior cavity 1782. After the interior cavity 1782 is partially or fully filled with the filler material 1792, the first and second weight ports 1722 and 1724 may be closed by inserting and securing weight portions 1732 and 1734, respectively, therein as described in detail herein. Alternatively, the filler material 1792 may be injected in the interior cavity 1782 from the first weight port 1722 while the second weight port 1724 functions as an exit port for the displaced air inside the interior cavity 1782. The apparatus, methods, and articles of manufacture described herein are not limited in this regard.

For example, at least 50% of the interior cavity 1782 may be filled with the filler material 1792 to absorb shock, isolate vibration, dampen noise, and/or provide structural support when the golf club head 1700 strikes a golf ball via the face portion 1755. With the support of the back wall portion 1762 and filling at least a portion of the interior cavity 1782 with the filler material 1792, the face portion 1755 may be relatively thin without degrading the structural integrity, sound, and/or feel of the golf club head 1700. In one example, the face portion 1755 may have a thickness of less than or equal to 0.075 inch (1.905 millimeters). In another example, the face portion 1755 may have a thickness of less than or equal to 0.060 inch (1.524 millimeters). In yet another example, the face portion 1755 may have a thickness of less than or equal to 0.050 inch (1.270 millimeters). Further, the face portion 1755 may have a thickness of less than or equal to 0.030 inch (0.762 millimeters). The apparatus, methods, and articles of manufacture described herein are not limited in this regard.

In one example, the face portion 1755 may be in one-piece with the body portion 1710 or be an integral part of the body portion 1710 (not shown). The body portion 1710 may include an interior cavity near the face portion 1755 that may be similar in many respects to the interior cavity 1782. However, unlike the interior cavity 1782 which may be partially defined by the face insert 1756, an interior cavity of the body portion 1710 having a one-piece face portion 1755 may be an integral part of the body portion 1710. The interior cavity may be partially or fully filled with a filler material 1792 via the first and second weight ports 1722 and/or 1724 as described in detail herein. The apparatus, methods, and articles of manufacture described herein are not limited in this regard.

In the example of FIGS. 23-31, a golf club head 2300 may include a body portion 2310. The body portion 2310 may include a toe portion 2330, a heel portion 2340, a front portion 2350, a rear portion 2360, a top portion 2370, and a sole portion 2380. The body portion 2310 may be manufactured via various manufacturing methods and/or processes (e.g., a casting process, a forging process, a milling process, a cutting process, a grinding process, a welding process, a combination thereof, etc.). The body portion 2310 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 2310 may be partially or entirely made of non-metal material (e.g., composite, plastic, etc.). The golf club head 2300 may be a putter-type golf club head (e.g., a blade-type putter, a mid-mallet-type putter, a mallet-type putter, etc.). Based on the type of putter as mentioned above, the body portion 2310 may be at least 200 grams. For example, the body portion 2310 may be in a range between 300 to 600 grams. Although FIGS. 23-31 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 2310 may include a hosel portion 2345 configured to receive a shaft (not shown) with a grip (not shown). The golf club head 2300 and the grip may be located on opposite ends of the shaft to form a golf club. Alternatively, the body portion 2310 may include a bore (not shown) for receiving the shaft (not shown). The front and rear portions 2350 and 2360, respectively, may be on opposite ends of the body portion 2310. The front portion 2350 may include a face portion 2355 (e.g., a strike face). The face portion 2355 may be used to impact a golf ball. The face portion 2355 may be associated with a loft plane that defines the loft angle of the golf club head 2300. The apparatus, methods, and articles of manufacture described herein are not limited in this regard.

Figure 23:
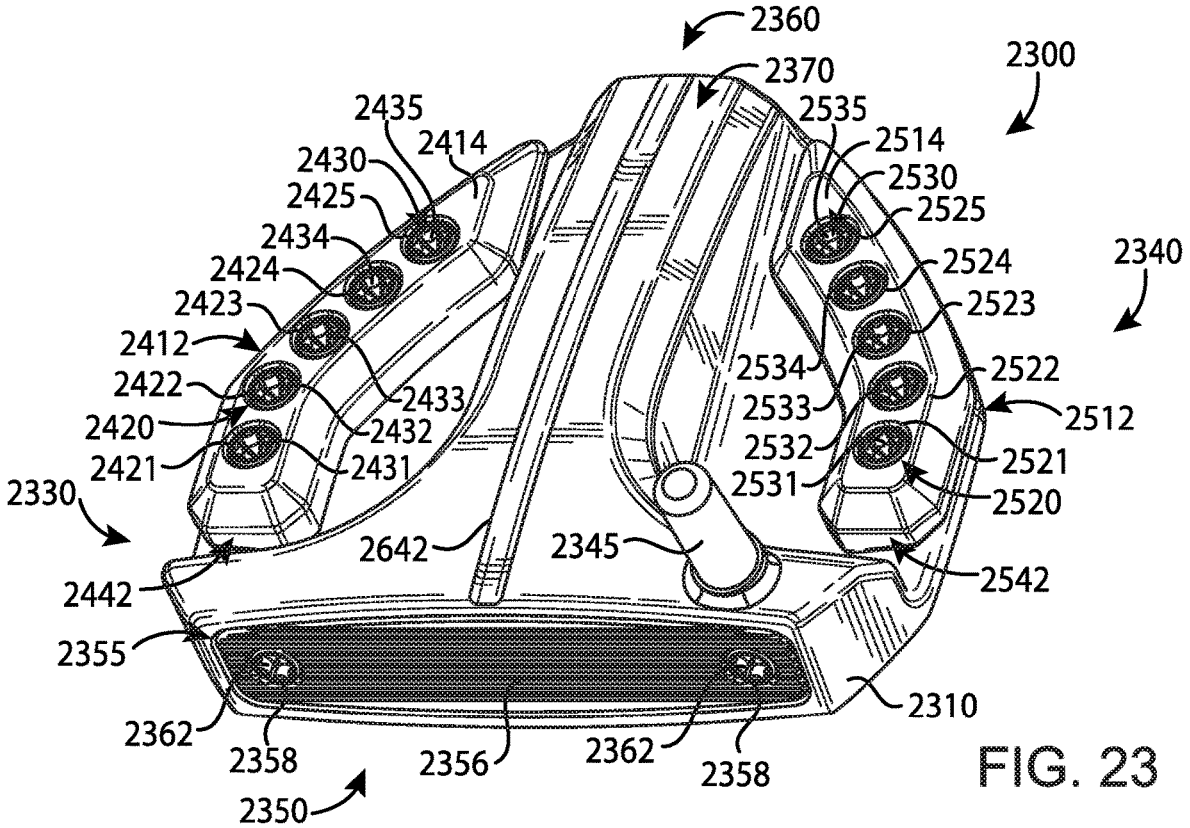
FIG. 23 depicts a front and top perspective view of a golf club head according to yet another example of the apparatus, methods, and articles of manufacture described herein.
Figure 24:
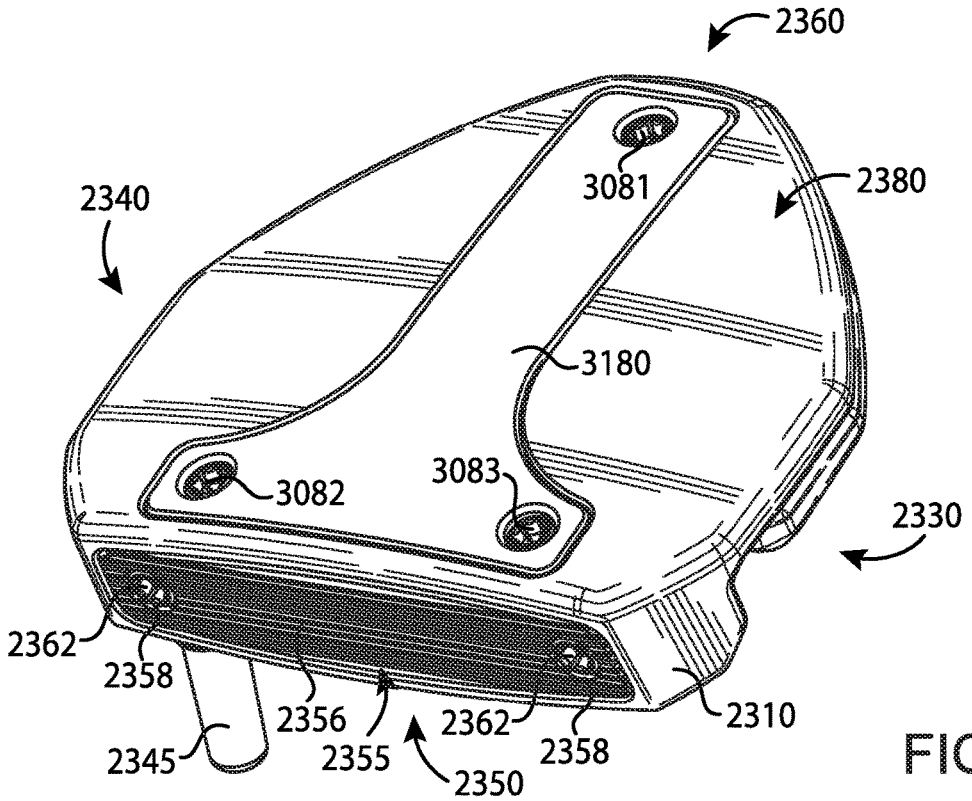
FIG. 24 depicts a front and bottom perspective view of the golf club head of FIG. 23.
Figure 25:
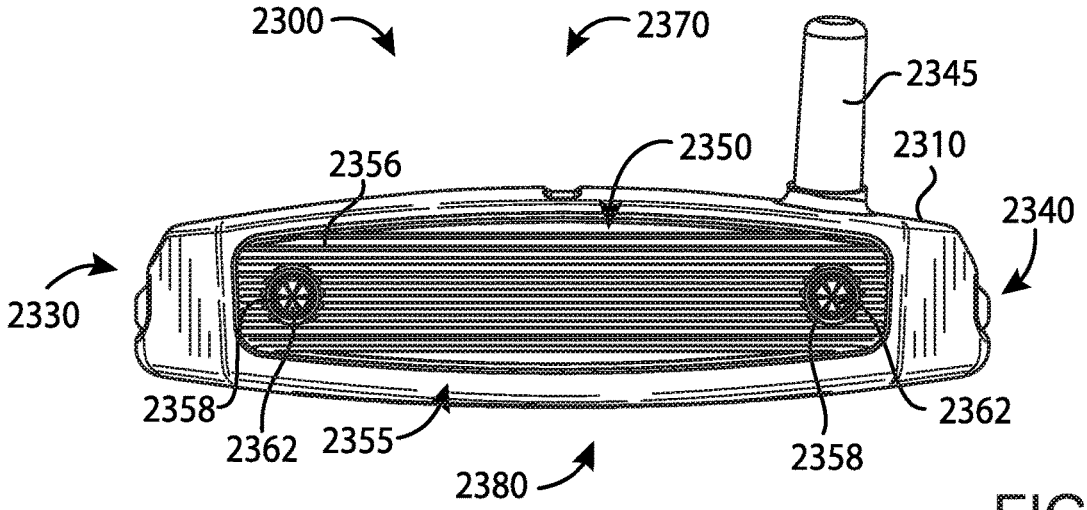
FIG. 25 depicts a front view of the golf club head of FIG. 23.
Figure 26:
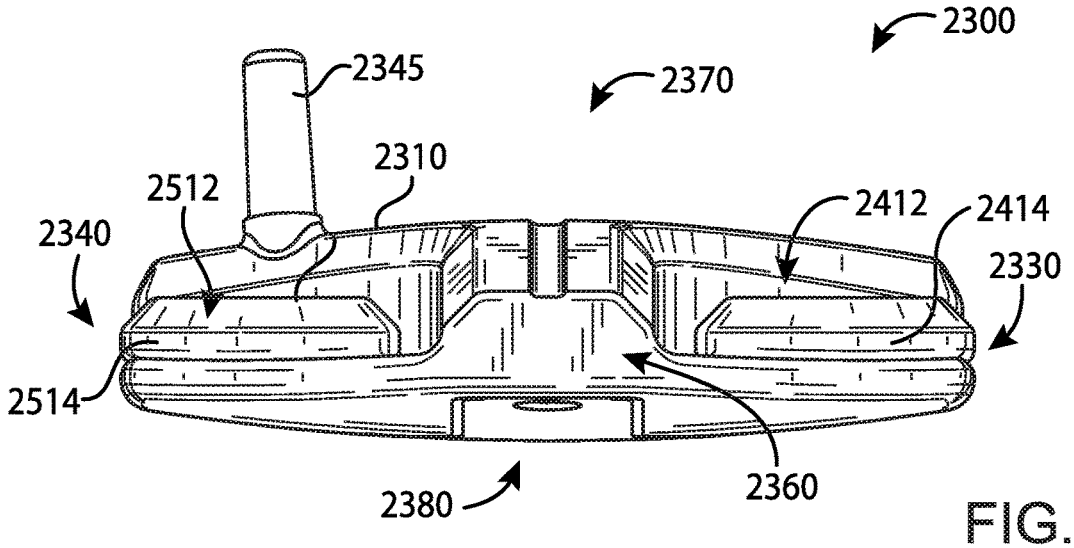
FIG. 26 depicts a rear view of the golf club head of FIG. 23.
Figure 27:
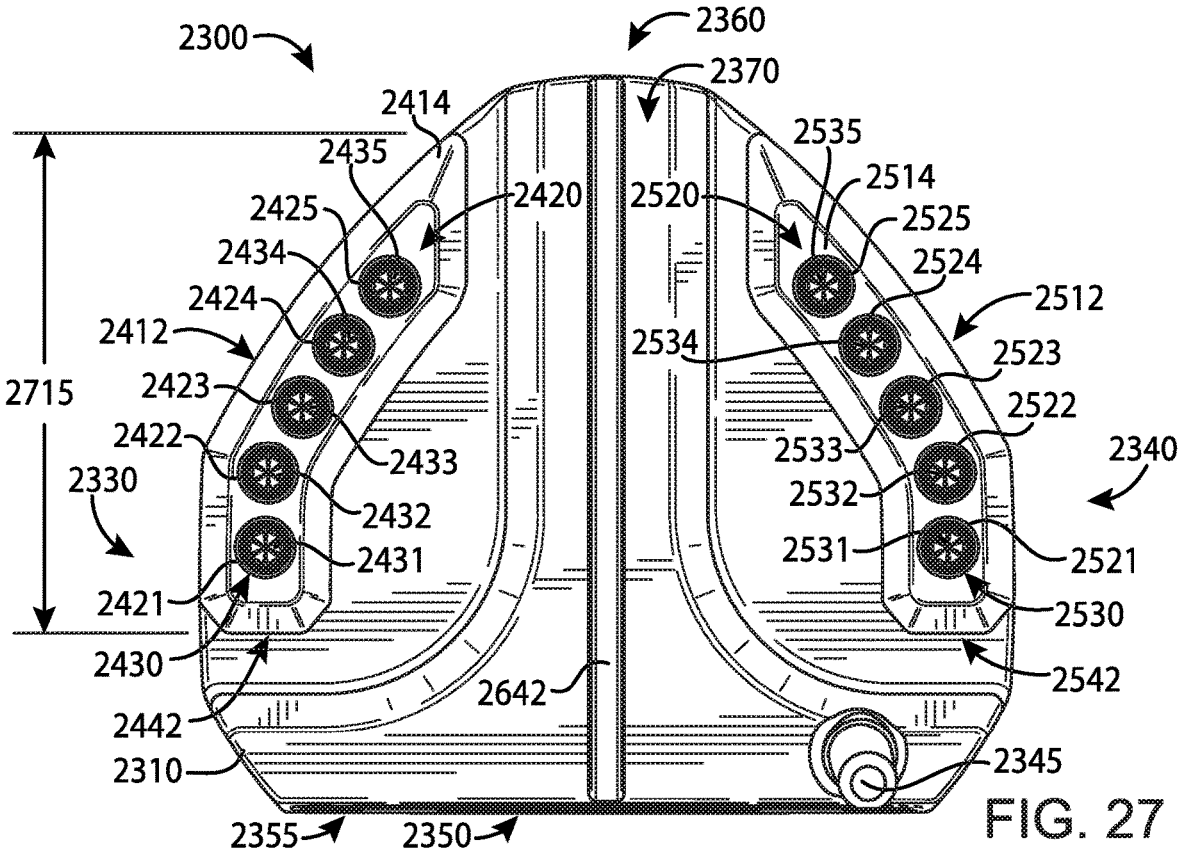
FIG. 27 depicts a top view of the golf club head of FIG. 23.

As illustrated in FIGS. 23 and 27, for example, the body portion 2310 may include two or more weight regions, generally shown as a first weight region 2412 and a second weight region 2512. The first weight region 2412 may include a first weight platform portion 2414 having a first set of weight ports 2420 (e.g., shown as weight ports 2421, 2422, 2423, 2424, and 2425). Each weight port of the first set of weight ports 2420 is configured to receive a weight portion of a first set of weight portions 2430 (e.g. shown as weight portions 2431, 2432, 2433, 2434 and 2435). The second weight region 2512 may include a second weight platform portion 2514 having a second set of weight ports 2520 (e.g., shown as weight ports 2521, 2522, 2523, 2524, and 2525). Each weight port of the second set of weight ports 2520 is configured to receive a weight portion of a second set of weight portions 2530 (e.g. shown as weight portions 2531, 2532, 2533, 2534 and 2535). Each weight portion of the first set of weight portions 2430 may be interchangeable with each weight portion of the second set of weight portions 2530. Accordingly, each weight port of the first set of weight ports 2420 and the second set of weight ports 2520 may be configured to interchangeably receive any of the weight portions of the first set of weight portions 2430 or the second set of weight portions 2530. The apparatus, methods, and articles of manufacture described herein are not limited in this regard.

Figure 28:
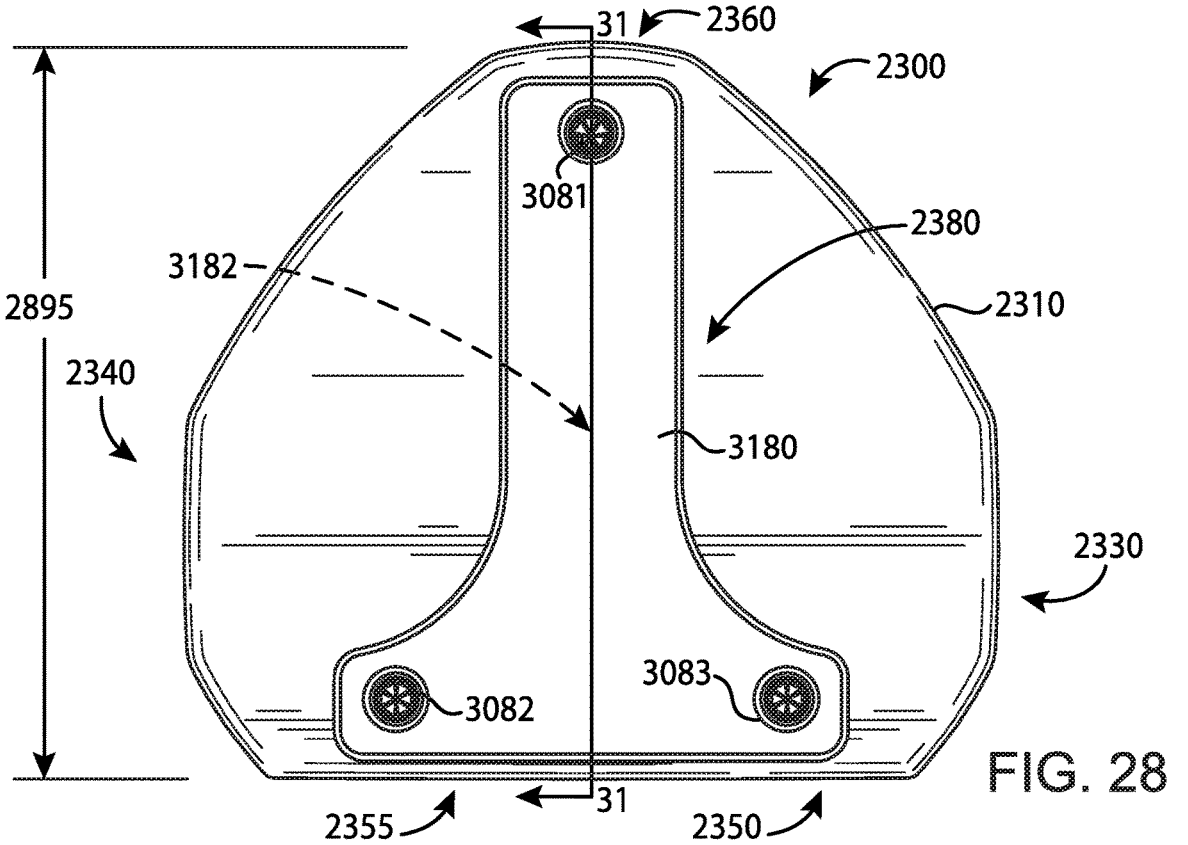
FIG. 28 depicts a bottom view of the golf club head of FIG. 23.
Figure 29:
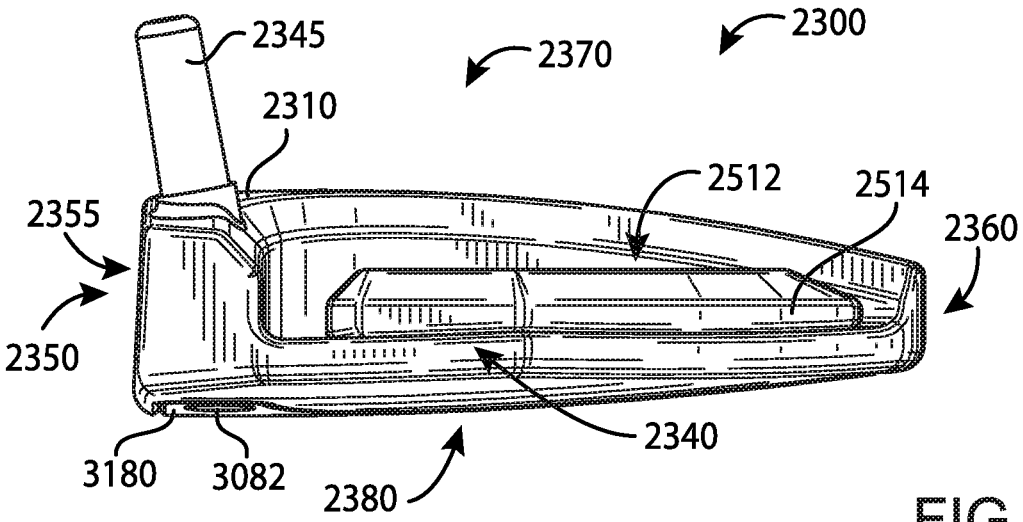
FIG. 29 depicts a left view of the golf club head of FIG. 23.
Figure 30:
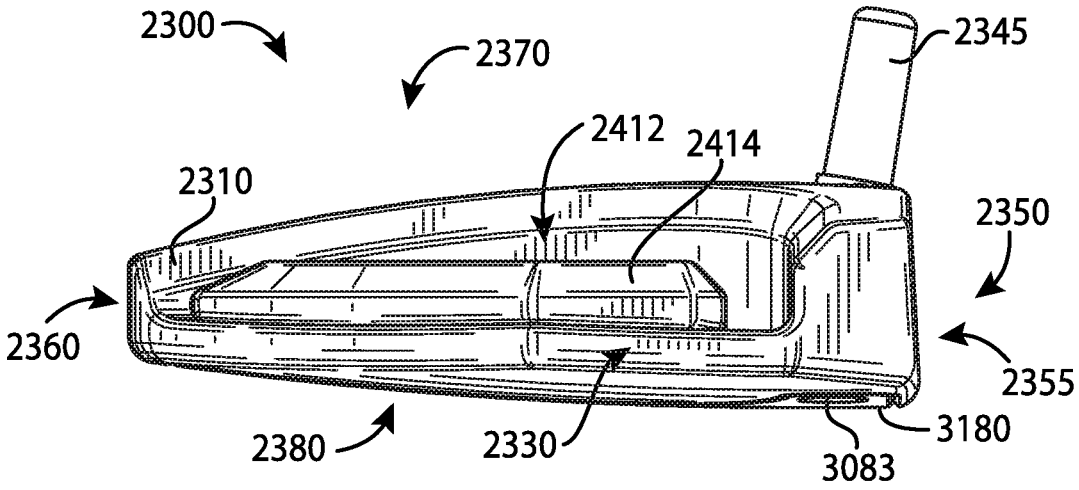
FIG. 30 depicts a right view of the golf club head of FIG. 23.

The first weight platform portion 2414 and the second weight platform portion 2514 may have a weight platform portion length ($L_{wp}$) 2715 that may be greater than about 40% of a body portion length ($L_B$) 2895 (FIG. 28). In one example, the weight platform portion length 2715 may be greater than 50% of the body portion length 2895. In one example, the weight platform portion length 2715 may be greater than 60% of the body portion length 2895. In one example, the weight platform portion length 2715 may be greater than 70% of the body portion length 2895. Accordingly, the mass of each of the first and second weight platform portions 2414 and 2514 may be distributed along a substantial portion of the body portion length 2895. The apparatus, methods, and articles of manufacture described herein are not limited in this regard.

The masses of the first and second weight platform portions 2414 and 2514 may be moved laterally outward on the body portion 2310. The mass of each of the first and second weight platform portions 2414 and 2514 may be between 5% and 30% of the mass of the body portion 2310 including the mass of the first weight platform portion 2414 and the second weight platform portion 2514. In one example, the mass of each of the first and second weight platform portions 2414 and 2514 may be between about 3% and about 13% of the mass of the body portion 2310 if the first and second weight platform portions 2414 and 2514 are made from relatively lighter metals such as metals including titanium or titanium alloys. In another example, the mass of each of the first and second weight platform portions 2414 and 2514 may be between about 8% and about 21% of the mass of the body portion 2310 if the first and second weight platform portions 2414 and 2514 are made from metals including steel. In yet another example, the mass of each of the first and second weight platform portions 2414 and 2514 may be between about 10% and about 30% of the mass of the body portion 2310 if the first and second weight platform portions 2414 and 2514 are made from relatively heavier metals such as metals including magnesium or magnesium alloys. Accordingly, between about 3% and about 30% of the mass of the body portion 2310 may be redistributed to the toe portion 2330 and the heel portion 2340 by the first and second weight platform portions 2414 and 2514 from other parts of the body portion 2310. Further, the first weight platform portion 2414 may be located at or proximate to the periphery of the toe portion 2330 and the second weight platform portion 2514 may be located at or proximate to the periphery of the heel portion 2340. The apparatus, methods, and articles of manufacture described herein are not limited in this regard.

Each weight port of the first set of weight ports 2420 may have a first port diameter ($PD_1$). In particular, a uniform distance of less than the first port diameter may separate any two adjacent weight ports of the first set of weight ports 2420 (e.g., (i) weight ports 2421 and 2422, (ii) weight ports 2422 and 2423, (iii) weight ports 2423 and 2424, or (iv) weight ports 2424 and 2425). In one example, the first port diameter may be about 0.25 inch (6.35 millimeters) and any two adjacent weight ports of the first set of weight ports 2420 may be separated by 0.1 inch (2.54 millimeters). Each weight port of the second set of weight ports 2520 may have a second port diameter ($PD_2$). A uniform distance of less than the second port diameter may separate any two adjacent weight ports of the second set of weight ports 2520 (e.g., (i) weight ports 2521 and 2522, (ii) weight ports 2522 and 2523, (iii) weight ports 2523 and 2524, or (iv) weight ports 2524 and 2525). For example, the second port diameter may be about 0.25 inch (6.35 millimeters) and any two adjacent weight ports of the second set of weight ports 2520 may be separated by 0.1 inch (2.54 millimeters). The first and second port diameters may be equal to each other (i.e., $PD_1=PD_2$). Alternatively, the first and second port diameters may be different. The apparatus, methods, and articles of manufacture described herein are not limited in this regard.

The first weight platform portion 1414, the first set of weight ports 2420 (weight ports 2421, 2422, 2423, 2424, and 2425), and/or the first set of weight portions 2430 (weight portions 2431, 2432, 2433, 2434, and 2435) may form a first visual guide portion 2442. The second weight platform portion 2514, the second set of weight ports 2520 (weight ports 2521, 2522, 2523, 2524, and 2525), and/or the second set of weight portions 2530 (weight portions 2531, 2532, 2533, 2534, and 2535) may form a second visual guide portion 2542. The first weight region 2412 may be located at or proximate to a periphery of the toe portion 2330 of the golf club head 2300. Accordingly, the first visual guide portion 2442 may be located at or proximate to the periphery of the toe portion 2330. The second weight region 2512 may be located at or proximate to the periphery of the heel portion 2340 of the golf club head 2300. Accordingly, the second visual guide portion 2542 may be located at or proximate to the periphery of the heel portion 2340. The first weight platform portion 2414 and/or any of the weight portions of the first set of weight portions 2430 may have distinct colors, markings and/or other visual features so as to be visually distinguished from the surrounding portions of the body portion 2310. Similarly, the second weight platform portion 2514 and/or any of the weight portions of the second set of weight portions 2530 may have distinct colors, markings and/or other visual features so as to be visually distinguished from the surrounding portions of the body portion 2310. The apparatus, methods, and articles of manufacture described herein are not limited in this regard.

The golf club head 2300 may also include a third visual guide portion 2642, which may be substantially equidistant from the first and second visual guide portions 2442 and 2542. For example, the third visual guide portion 2642 may extend between the front and rear portions 2350 and 2360 located at or proximate to a center of the body portion 2310. The third visual guide portion 2642 may be the same as or different from the first and/or second visual guide portions 2442 and 2542, respectively. In one example, the third visual guide portion 2642 may be a recessed line portion having a certain color. In another example, the third visual guide portion 2642 may include a plurality of weight ports (not shown) with a plurality of weight portions (not shown) received therein. Alternatively, the third visual guide portion 2642 may be defined by a raised portion of the top portion 2370. The third visual guide portion 2642 may be similar in many respects to any of the visual guide portions described herein. Therefore, a detailed description of the third visual guide portion 2642 is not provided. The apparatus, methods, and articles of manufacture described herein are not limited in this regard.

The first and second sets of weight portions 2430 and 2530, respectively, may have similar or different physical properties (e.g., density, shape, mass, volume, size, color, etc.). The first and second sets of weight portions 2430 and 2530, respectively, may include threads to secure in the weight ports of the first and second sets of weight ports 2420 and 2520, respectively. The physical properties of the weight portions of the first and second sets of weight portions 2430 and 2530, respectively, may be similar in many respects to any of the weight portions described herein. Therefore, a detailed description of the physical properties of the weight portions of the first and second sets of weight portions 2430 and 2530, respectively, is not provided. The apparatus, methods, and articles of manufacture described herein are not limited in this regard.

The first weight platform portion 2414 may be attached to the body portion 2310 with any one or more weight portions of the first set of weight portions 2430 or the second set of weight portions 2530. The body portion 2310 may include a plurality of toe side threaded bores (not shown) on the top portion 2370 at or proximate to the toe portion 2330. When the first weight platform portion 2414 is placed on the top portion 2370 at or proximate to the periphery of the toe portion 2330 as shown in FIGS. 23 and 27, for example, the toe side threaded bores may generally align with the weight ports of the first set of weight ports 2420. When a weight portion of the first set of weight portions 2430 or the second set of weight portions 2530 is inserted in a weight port of the first set of weight ports 2420, the weight portion extends through a corresponding one of the toe side threaded bores of the body portion 2310 such that the threads on the weight portion engage the corresponding threads in the toe side threaded bore. The weight portion can then be screwed into the corresponding toe side threaded bore to fasten the first weight platform portion 2414 on the body portion 2310. The apparatus, methods, and articles of manufacture described herein are not limited in this regard.

The second weight platform portion 2514 may be attached to the body portion 2310 with any one or more weight portions of the first set of weight portions 2430 or the second set of weight portions 2530. The body portion 2310 may include a plurality of heel side threaded bores (not shown) on the top portion 2370 at or proximate to the heel portion 2340. When the second weight platform portion 2514 is placed on the top portion 2370 at or proximate to the periphery of the heel portion 2340 as shown in FIGS. 23 and 27, for example, the heel side threaded bores generally align with the weight ports of the second set of weight ports 2520. When a weight portion of the first set of weight portions 2430 or the second set of weight portions 2530 is inserted in a weight port of the second set of weight ports 2520, the weight portion extends through a corresponding one of the heel side threaded bores of the body portion 2310 such that the threads on the weight portion engage the corresponding threads in the heel side threaded bore. The weight portion can then be screwed into the corresponding heel side threaded bore to fasten the second weight platform portion 2514 on the body portion 2310. The apparatus, methods, and articles of manufacture described herein are not limited in this regard.

Each of the weight portions of the first and second sets of weight portions 2430 and 2530, respectively, may have sufficient length to extend through a weight port and into a corresponding threaded bore of the body portion 2310 as described herein to fasten the first weight platform portion 2414 and the second weight platform portion 2514 to the body portion 2310. One or more weight portions of the first set of weight portions 2430 and/or one or more weight portions of the second set of weight portions 2530 may function both as weights for configuring a weight distribution of the golf club head 2300 and as fasteners for fastening the first weight platform portion 2414 and/or the second weight platform portion 2514 on the body portion 2310. Alternately, the first weight platform portion 2414 and/or the second weight platform portion 2514 may be fastened on the body portion 2310 by using other types of fastening mechanisms such that one or more weight portions of the first set of weight portions 2430 and/or one or more weight portions of the second set of weight portions 2530 may only function as weight portions. The apparatus, methods, and articles of manufacture described herein are not limited in this regard.

Each of the first and second weight platform portions 2414 and 2514, respectively, may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The first and second weight platform portions 2414 and 2514, respectively, may have a similar mass or different masses to optimally affect the weight distribution, center or gravity location, and/or moment of inertia of the golf club head 2300. Each of the first and second weight platform portions 2414 and 2514 may function as an added weight for the body portion 2310 and as a platform for receiving additional weights for the body portion 2310 in the form of the first and second sets of weight portions 2430 and 2530. Thus, the physical properties and the materials of construction of the first and second weight platform portions 2414 and/or 2514 may be determined to optimally affect the weight, weight distribution, center of gravity, moment of inertia characteristics, structural integrity and/or or other static and/or dynamic characteristics of the golf club head 2300. The apparatus, methods, and articles of manufacture described herein are not limited in this regard.

In one example, the face portion 2355 may be in one-piece with the body portion 2310 or be an integral part of the body portion 2310 (not shown). The face portion 2355 may include a separate piece or an insert coupled to the body portion 2310. The face portion 2355 may include a face insert 2356, which may be attached to the front portion 2350 via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIGS. 23-25, the face insert 2356 may include two fastener holes 2358 proximate to the toe portion and heel portion of the face insert 2356. Each of the fastener holes 2358 may be configured to receive a fastener 2362 for attachment of the face insert 2356 to the body portion 2310. The body portion 2310 may include two fastener ports (not shown) configured to receive the fasteners 2362. The fasteners 2362 may be similar or substantially similar to the weight portions of the first set of weight portions 2430 and/or the weight portions of the second set of weight portions 2530. Accordingly, the fasteners 2362 may function both as weights for configuring a weight distribution of the golf club head 2300 and as fasteners for fastening the face insert 2356 to the face portion 2355. Each fastener port may have internal threads that are configured to engage external threads on the fasteners 2362. The fastener ports of the body portion 2310 may be similar in many respects to the fastener ports 1768 of the golf club head 1700 described herein. The apparatus, methods, and articles of manufacture described herein are not limited in this regard.

The face portion 2355 may include a peripheral recessed portion 3172 (shown in FIG. 31) configured to receive the face insert 2356. As shown by example in FIG. 31, the depth of the peripheral recessed portion 3172 may be similar to the thickness of the face insert 2356 such that when the face insert 2356 is fastened to the body portion 2310, the face insert 2356 is positioned flush or substantially flush with the face portion 2355. Alternatively, the face insert 2356 may project from the face portion 2355. The apparatus, methods, and articles of manufacture described herein are not limited in this regard.

As described, the fasteners 2362 may be similar or substantially similar to the weight portions of the first set of weight portions 2430 and/or the weight portions of the second set of weight portions 2530 so that the fasteners 2362 may function to configure the weight distribution of the golf club head 2300. Accordingly, the fasteners 2362 may have similar or different weights to balance and/or provide heel or toe weight bias for the golf club 2300. For example, the weight of the body portion 2310 may be increased or decreased by similarly increasing or decreasing, respectively, the weights of the fasteners 2362. In one example, the golf club head 2300 may be provided with a toe-biased weight configuration by having the fastener 2362 that is closer to the toe portion 2330 be heavier than the fastener 2362 that is closer to the heel portion 2340. Conversely, the golf club head 2300 may be provided with a heel-biased weight configuration by having the fastener 2362 that is closer to the heel portion 2340 be heavier than the fastener 2362 that is closer to the toe portion 2330. The apparatus, methods, and articles of manufacture described herein are not limited in this regard.

To attach the face insert 2356 to the body portion 2310, the face insert 2356 may be inserted in the peripheral recessed portion 3172, thereby generally aligning the fastener holes 2358 of the face insert 2356 and the fastener ports (not shown) of the body portion 2310. The fasteners 2362 can be inserted through the fastener holes 2358 and screwed into the fastener ports of the body portion 2310 to securely attach the face insert 2356 to the body portion 2310. The face insert 2356 may be constructed from any material such as metal, metal alloys, plastic, wood, composite materials or a combination thereof to provide a certain ball striking characteristic to the golf club head 2300. The material from which the face insert 2356 is manufactured may affect ball speed and spin characteristics. Accordingly, the face insert 2356 may be selected to provide a certain ball speed and spin characteristics for an individual. Thus, the face insert 2356 may be interchangeable with other face inserts having different ball speed and spin characteristics. The face insert 2356 may be coupled to the body portion 2310 by other methods or devices, such as by bonding, welding, adhesive and/or other types of fastening devices and/or methods. The apparatus, methods, and articles of manufacture described herein are not limited in this regard.

The body portion 2310 may include an interior cavity 3182 (shown in FIG. 31) extending between the front portion 2350 and the rear portion 2360 and between the toe portion 2330 and the heel portion 2340. The interior cavity 3182 may be open or accessible at the face portion 2355 and/or at the sole portion 2380. Accordingly, the interior cavity 3182 may have a first opening 3176 at the face portion 2355 and/or a second opening 3178 at the sole portion 2380. The interior cavity 3182 allows the mass of the body portion 2310 to be removed at or around the center portion of the body portion 2310 so that removed mass may be redistributed to the toe portion 2330 and the heel portion 2340 using the first weight platform portion 2414 and the second weight platform portion 2514 without affecting or substantially affecting the overall mass of the golf club head 2300. The apparatus, methods, and articles of manufacture described herein are not limited in this regard.

Figure 31:
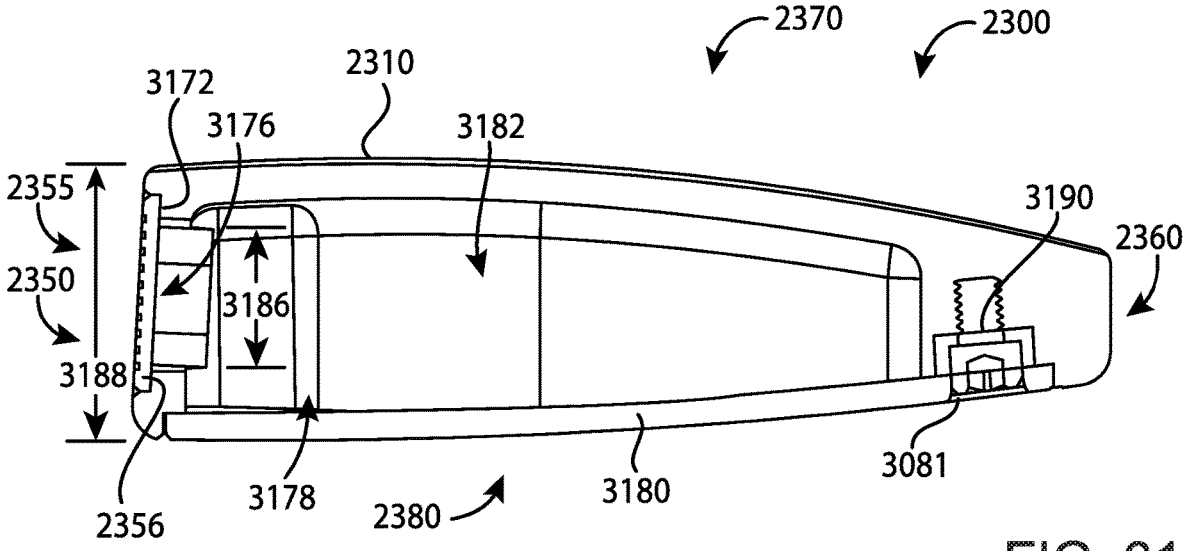
FIG. 31 depicts a cross-sectional view of the golf club head of FIG. 23 taken at lines 31-31 of FIG. 31.

In one example as shown in FIGS. 28 and 31, the interior cavity 3182 may be covered at the face portion 2355 by the face insert 2356 and at the sole portion 2380 by a cover or sole plate 3180. In one example, the sole plate 3180 may have a mass between 7% and 17% of the mass of the golf club head 2300. In one example, the sole plate 3180 may have a mass between 10% and 15% of the mass of the golf club head 2300. As described herein, the interior cavity 3182 allows the mass of the body portion 2310 to be removed at or around the center portion of the body portion 2310. The removed mass can be also redistributed to the sole portion 2380 using the sole plate 3180 to lower the center of gravity of the golf club head 2300 without affecting or substantially affecting the overall mass of the golf club head 2300. The apparatus, methods, and articles of manufacture described herein are not limited in this regard.

The sole plate 3180 may be attached to the sole portion 2380 with one or more fasteners. In the example of FIGS. 24 and 28-31, the sole plate 3180 may be attached to the sole portion 2380 with fasteners 3081, 3082, and 3083 to cover the second opening 3178 of the interior cavity 3182 at the sole portion 2380. Each of the fasteners 3081, 3082, and 3083 may have a threaded portion that is configured to engage a correspondingly threaded bore 3190 (shown in FIG. 31) in the body portion 2310. The fasteners 3081, 3082, and/or 3083 may be similar or substantially similar to the weight portions of the first set of weight portions 2430 and/or the weight portions of the second set of weight portions 2530. Accordingly, the fasteners 3081, 3082, and/or 3083 may function both as weights for configuring a weight distribution of the golf club head 2300 and as fasteners for fastening the sole plate 3180 to the sole portion 2380. The fasteners 3081, 3082, and/or 3083 may also lower the center of gravity of the golf club head 2300 by adding more mass to the sole portion 2380 without affecting or substantially affecting the overall mass of the golf club head 2300 as described herein with respect to the sole plate 3180. The apparatus, methods, and articles of manufacture described herein are not limited in this regard.

The sole plate 3180 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The physical properties and the materials of construction of the sole plate 3180 may be determined to optimally affect the weight, weight distribution, center of gravity, moment of inertia characteristics, structural integrity and/or or other static and/or dynamic characteristics of the golf club head 2300. The apparatus, methods, and articles of manufacture described herein are not limited in this regard.

The interior cavity 3182 may extend from near the toe portion 2330 to near the heel portion 2340 and from near the top portion 2370 to near the sole portion 2380. Alternatively, the interior cavity 3182 may extend between the front portion 2350 and the rear portion 2360 and include a portion of the body portion 2310 between the toe portion 2330 and near the heel portion 2340 and between the top portion 2370 and near the sole portion 2380. In one example, a portion of the interior cavity 3182 may be located proximate to the regions of the face portion 2355 that generally strike a golf ball. In one example, the interior cavity 3182 may be only at the face portion 2355 similar to the interior cavity 1782 of the golf club head 1700 described herein. The apparatus, methods, and articles of manufacture described herein are not limited in this regard.

The interior cavity 3182 proximate to the face portion 2355 may be associated with a cavity height 3186 ($H_C$), and the body portion 2310 proximate to the face portion 2355 may be associated with a body height 3188 ($H_B$). While the cavity height 3186 and the body height 3188 may vary between the toe and heel portions 2330 and 2340, the front and rear portions 2350 and 2360, and the top and sole portions 2370 and 2380, the cavity height 3186 may be at least 50% of the body height 3188 ($H_C>0.5*H_B$) proximate to the face portion 2355 or an any location of the interior cavity 3182. For example, the cavity height 3186 may vary between 70% and 85% of the body height 3188. With the cavity height 3186 of the interior cavity 3182 being greater than 50% of the body height 3188, the golf club head 2300 may produce relatively more consistent feel, sound, and/or result when the golf club head 2300 strikes a golf ball via the face portion 2355 than a golf club head with a cavity height of less than 50% of the body height. However, the cavity height 3186 may be less than 50% of the body height 3188. The apparatus, methods, and articles of manufacture described herein are not limited in this regard.

In one example, the interior cavity 3182 may be unfilled (i.e., empty space). Alternatively, the interior cavity 3182 may be partially or entirely filled with a filler material (not shown) to absorb shock, isolate vibration, and/or dampen noise when the face portion 2355 strikes a golf ball. The filler material may be an elastic polymer or elastomer material (e.g., a viscoelastic urethane polymer material such as Sorbothane material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 3182 may be filled with a TPE material to absorb shock, isolate vibration, and/or dampen noise when the golf club head 2300 strikes a golf ball via the face portion 2355. In one example, the mass of the filler material (e.g., TPE, TPU, etc.) may be between 3% and 13% of the mass of the golf club head 2300. In one example, the mass of the filler material may be between 6% and 10% of the mass of the golf club head 2300. The apparatus, methods, and articles of manufacture described herein are not limited in this regard.

In another example, the filler material may be a polymer material such as an ethylene copolymer material to absorb shock, isolate vibration, and/or dampen noise when the golf club head 2300 strikes a golf ball via the face portion 2355. In particular, at least 50% of the interior cavity 3182 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 3182 may be partially or fully filled with the filler material. In one example, the interior cavity 3182 may be filled with the filler material from the first opening 3176 and/or the second opening 3178 prior to attaching the face insert 2356 and/or the sole plate 3180, respectively, to the body portion 2310. In one example, the interior cavity 3182 may be filled with the filler material after the face insert 2356 and the sole plate 3180 are attached to the body portion 2310 by injecting the filler material into the interior cavity 3182 through one or more ports (not shown) on the sole plate 3180. The filler material may be injected into the interior cavity 3182 from one or more ports on the sole plate 3180 while the air inside the interior cavity 3182 that is displaced by the filler material may exit the interior cavity 3182 from one or more other ports on the sole plate 3180. The apparatus, methods, and articles of manufacture described herein are not limited in this regard.

For example, at least 50% of the interior cavity 3182 may be filled with the filler material to absorb shock, isolate vibration, dampen noise, and/or provide structural support when the golf club head 2300 strikes a golf ball via the face portion 2355. With the filler material, the face portion 2355 may be relatively thin without degrading the structural integrity, sound, and/or feel of the golf club head 2300. In one example, the face portion 2355 may have a thickness of less than or equal to 0.075 inch (1.905 millimeters). In another example, the face portion 2355 may have a thickness of less than or equal to 0.060 inch (1.524 millimeters). In yet another example, the face portion 2355 may have a thickness of less than or equal to 0.050 inch (1.270 millimeters). Further, the face portion 2355 may have a thickness of less than or equal to 0.030 inch (0.762 millimeters). The apparatus, methods, and articles of manufacture described herein are not limited in this regard.

In the example of FIGS. 32-38, a face portion 3200 of a golf club head may include a strike portion 3210, a toe portion 3230 having a toe edge 3231, a heel portion 3240 having a heel edge 3241, a top portion 3270 having a top edge 3271, a sole portion 3280 having a sole edge 3281, and a central strike portion 3285. The toe edge 3231, the heel edge 3241, the top edge 3271, and the sole edge 3281 may define a periphery or perimeter 3290 of the face portion 3200. The central strike portion 3285 may be located inside the perimeter 3290 and may include a geometric center 3286 of the face portion 3200. The face portion 3200 may be used with any golf club head including any of the golf club heads described herein. In one example, the face portion 3200 may be co-manufactured with a body portion (e.g., one shown as 2310) of a golf club head (e.g., one shown as 2300) to be an integral part of the body portion of the golf club head (e.g., milling and/or other techniques such as grinding, etching, laser milling, etc. to the body portion). In another example, the face portion 3200 may be a separate piece from a body portion of a golf club and attached to the body portion by welding, soldering, adhesive bonding, press fitting, and/or other suitable attachment methods. In yet another example, the face portion 3200 may be a separate piece from a body portion of a golf club head and attached to the body portion by one or more fasteners such as bolts and/or screws. The apparatus, methods, and articles of manufacture described herein are not limited in this regard.

In the example of FIGS. 32-38, the strike portion 3210 may include a plurality of projections 3330 (e.g., two projections generally shown in FIGS. 32-36 as 3331 and 3332). In the example of FIGS. 32-38, the entire strike portion 3210 of the face portion 3200 may include the plurality of projections 3330. In another example, the strike portion 3210 of the face portion 3200 may partially include the plurality of projections 3330. In one example, the face portion 3200 may be a separate piece and the strike portion 3210 may be located opposite a back portion 3220 (FIG. 34) of the face portion 3200. The back portion 3220 may be coupled to and/or in contact with a filler material that may at least partially structurally support the face portion 3200, dampen noise, and/or reduce vibration when the face portion 3200 strikes a golf ball as described herein. The apparatus, methods, and articles of manufacture described herein are not limited in this regard.

Figure 34:
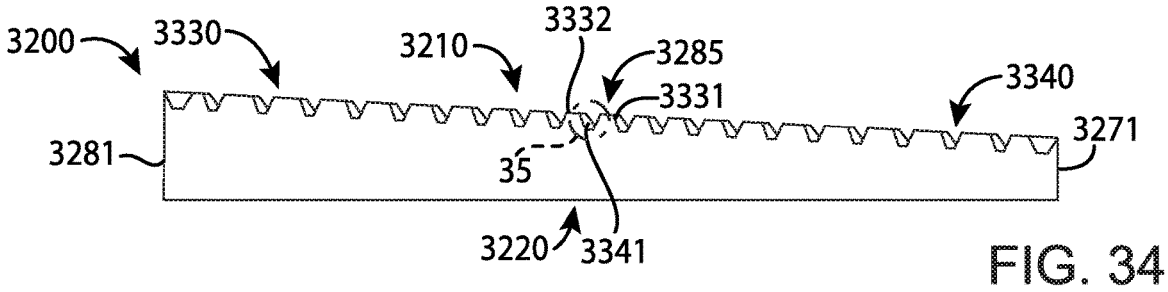
FIG. 34 depicts a perspective cross-sectional view of the face portion of FIG. 32.
Figure 35:
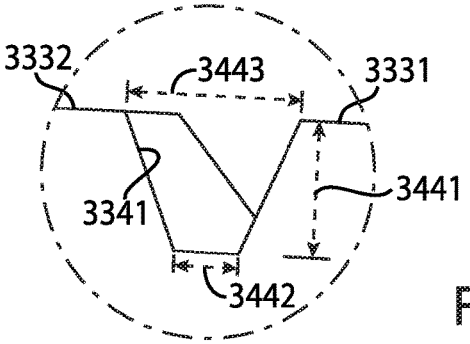
FIG. 35 depicts an enlarged view of area 35 of the face portion of FIG. 34.
Figure 36:
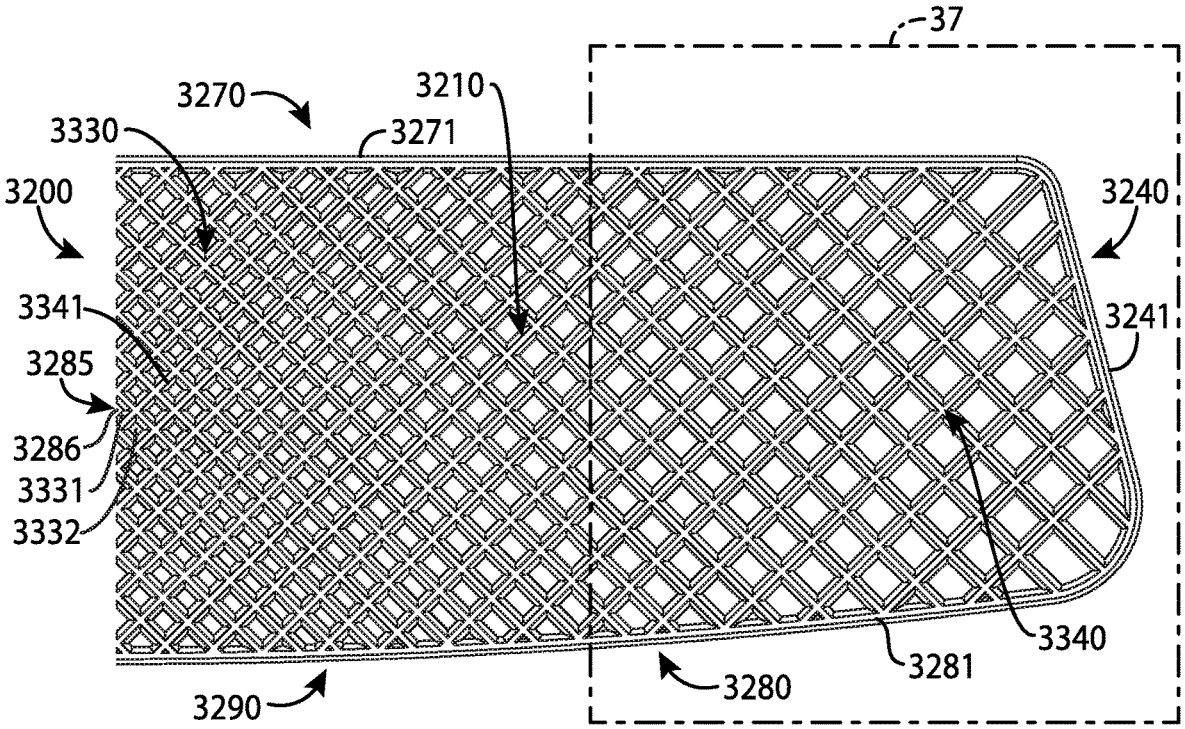
FIG. 36 depicts an enlarged view of area 36 of the face portion of FIG. 32.

In the example of FIGS. 32-38, each one of the plurality of projections 3330 may be separated from and linearly aligned with an adjacent projection by one of a plurality of grooves 3340 (e.g., one groove generally shown in FIGS. 34-36 as 3341). The plurality of grooves 3340 may be arranged on the strike portion 3210 of the face portion 3200 in a grid pattern with each grid cell corresponding to one of the plurality of projections 3330 (e.g., one projection shown in FIG. 38 as 3331). In other words, the plurality of projections 3330 may be configured on the strike portion 3210 of the face portion 3200 in an array defined by the plurality of grooves 3340. The apparatus, methods, and articles of manufacture described herein are not limited in this regard.

Figure 37:
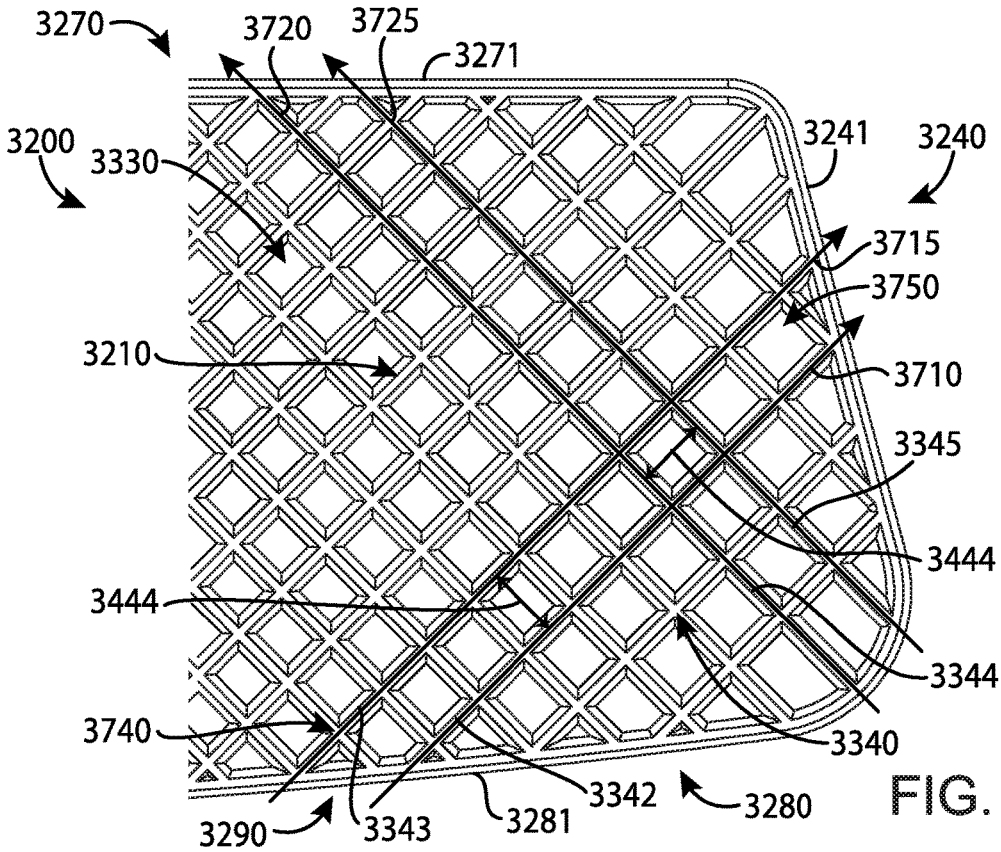
FIG. 37 depicts an enlarged view of area 37 of the face portion of FIG. 36.

In the example of FIGS. 32-38, the plurality of grooves 3340 may include a first plurality of grooves 3740 (FIG. 37) and a second plurality of grooves 3750 (FIG. 37). The first plurality of grooves 3740 may include two or more grooves (e.g., generally shown in FIG. 37 as grooves 3342 and 3343) extending across the strike portion 3210 in a first direction (e.g., as indicated in FIG. 37 by direction arrows 3710 and 3715 associated with grooves 3342 and 3343, respectively). The second plurality of grooves 3750 may include two or more grooves (e.g., generally shown in FIG. 37 as grooves 3344 and 3345) extending across the strike portion 3210 in a second direction (e.g., as indicated in FIG. 37 by direction arrows 3720 and 3725 associated with grooves 3344 and 3345, respectively). The second direction may be different from the first direction. In one example, the second direction may be transverse to the first direction. Each one of the first plurality of grooves 3740 (e.g., groove 3342) may be linear and may be parallel or substantially parallel with each other one of the first plurality of grooves 3740 (e.g., groove 3343). Similarly, each one of the second plurality of grooves 3750 (e.g., groove 3344) may be linear and may be parallel or substantially parallel with each other one of the second plurality of grooves 3750 (e.g., groove 3345). In another example (not shown), each one of the first plurality of grooves 3740 (e.g., groove 3342) may be non-linear and/or non-parallel with each other one of the first plurality of grooves 3740. Similarly, each one of the second plurality of grooves 3750 (e.g., groove 3344) may be non-linear and/or non-parallel with each other one of the second plurality of grooves 3750 (e.g., groove 3345). The first plurality of grooves 3740 may intersect with the second plurality of grooves 3750. In one example, one or more grooves of the first plurality of grooves 3740 and one or more grooves of the second plurality of grooves 3750 may intersect a horizontal centerline axis 3288 (FIG. 32) of the face portion 3200 at a 45 degree angle. In another example, one or more grooves of the first plurality of grooves 3740 and one or more grooves of the second plurality of grooves 3750 may intersect the horizontal centerline axis 3288 at a 60 degree angle. In yet another example, one or more grooves of the first plurality of grooves 3740 and one or more grooves of the second plurality of grooves 3750 may intersect the horizontal centerline axis 3288 at a 30 degree angle. In yet another example, one or more grooves of the first plurality of grooves 3740 and one or more grooves of the second plurality of grooves 3750 may intersect the horizontal centerline axis 3288 at any angle. The apparatus, methods, and articles of manufacture described herein are not limited in this regard.

In the example of FIGS. 32-38, and generally indicated in FIG. 37 by direction arrows 3710 and 3715, the first direction may include a first diagonal direction extending upwardly from left-to-right across the strike portion 3210. Accordingly, the first plurality of grooves 3740 may include grooves of the plurality of grooves 3340 extending in the first direction between the toe edge 3231 and the top edge 3271, between the sole edge 3281 and the top edge 3271, and between the sole edge 3281 and the heel edge 3241. The second direction, as generally indicated in FIG. 37 by direction arrows 3720 and 3725, may include a second diagonal direction extending upwardly from right-to-left across the strike portion 3210 of the face portion 3200. Accordingly, the second plurality of grooves 3750 may include grooves of the plurality of grooves 3340 extending in the second direction between the heel edge 3241 and the top edge 3271, between the sole edge 3281 and the top edge 3271, and between the sole edge 3281 and the toe edge 3231. The apparatus, methods, and articles of manufacture described herein are not limited in this regard.

Figure 38:
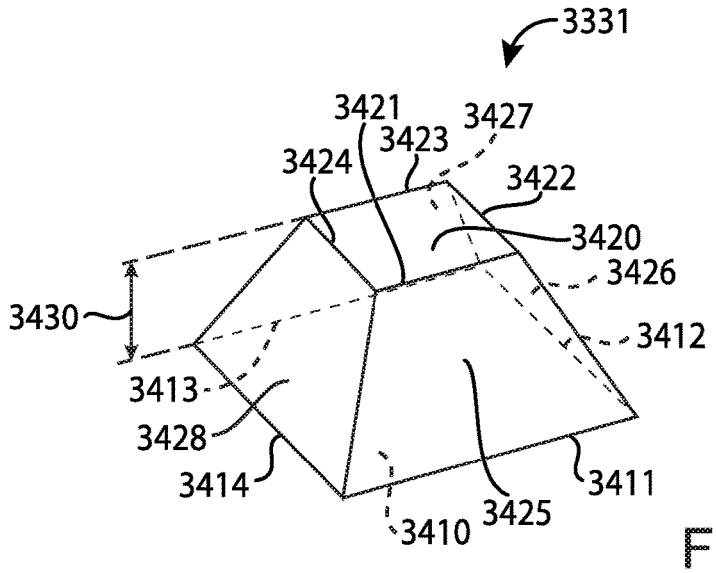
FIG. 38 depicts a perspective schematic view of a pyramidal frustum.

In one example, as shown in FIG. 35, a groove, generally shown as groove 3341, may have a truncated V-shaped cross section, or said differently, an inverted trapezoidal cross section. The groove 3341 may have a depth 3441 and a variable width that transitions from a lowermost width 3442 to an uppermost width 3443. In one example, the width of the groove 3341 linearly transitions from the lowermost width 3442 to the uppermost width 3443. The depth 3441 may be greater than or equal to approximately 0.010 inch (0.254 millimeters) and less than or equal to approximately 0.020 inch (0.508 millimeters). The lowermost width 3442, as measured between base portions (e.g., a base portion 3410 of projection 3331 is shown in FIG. 38) of adjacent projections (e.g., projections 3331 and 3332) of the plurality of projections 3330, may be greater than or equal to approximately 0.010 inch (0.254 millimeters) and less than or equal to approximately 0.012 inch (0.305 millimeters). The uppermost width 3443, as measured between peak portions (e.g., a peak portion 3420 of projection 3331 is shown in FIG. 38) of adjacent projections (e.g., projections 3331 and 3332), may be greater than or equal to approximately 0.021 inch (0.533 millimeters) and less than or equal to approximately 0.036 inch (0.914 millimeters).

In the example of FIGS. 32-38, each groove of the plurality of grooves 3340 may have a cross section similar to groove 3341. As described herein, the plurality of projections 3330 may be defined by the arrangement of the plurality of grooves 3340. In one example, the resulting geometric shape of each one of the plurality of projections 3330 may be a pyramidal frustum. The distance between adjacent projections of the plurality of projections 3330 may be defined by the width of a groove of the plurality of grooves 3340 extending therebetween. For example, the distance between adjacent projections 3331 and 3332 of the plurality of projections 3330 may be defined by the width of groove 3341 of the plurality of grooves 3340. In one example, each groove of the plurality of grooves 3340 may have the same or substantially the same width, whether the width be constant or variable. Accordingly, distances between adjacent projections of the plurality of projections 3330 may be similar or substantially similar. In another example (not shown), some or all of the grooves of the plurality of grooves 3340 may have different widths. Accordingly, the distance between adjacent projections of the plurality of projections 3330 may also be different. The apparatus, methods, and articles of manufacture described herein are not limited in this regard.

While not shown, the face portion 3200 may be configured such that one or more of the plurality of projections 3330 have other geometric shapes. For example, one or more of the plurality of projections 3330 may be a cube or cuboid. Accordingly, the corresponding grooves of the plurality of grooves 3340 may be an intersecting array of grooves that define one or more cubic or cuboidal grid cells. In another example, one or more of the plurality of projections 3330 may be a triangular pyramidal frustum. Accordingly, the corresponding grooves of the plurality of grooves 3340 may be an intersecting array of grooves that define one or more triangular grid cells. In yet another example, one or more of the plurality of projections 3330 may be a pentagonal pyramidal frustum. Accordingly, the corresponding grooves of the plurality of grooves 3340 may be an intersecting array of grooves that define one or more pentagonal grid cells. In yet another example, one or more of the plurality of projections 3330 may be a hexagonal pyramidal frustum. Accordingly, the corresponding grooves of the plurality of grooves 3340 may be an intersecting array of grooves that define one or more hexagonal grid cells. In yet another example, one or more of the plurality of projections 3330 may be any regular or irregular polygonal pyramidal frustum. In yet another example, one or more of the plurality of projections 3330 may be a conical frustum (e.g., having circular or elliptical base portion). The apparatus, methods, and articles of manufacture described herein are not limited in this regard.

In one example, as shown in FIG. 38, a projection, generally shown as projection 3331, may be a square or rectangular pyramidal frustum having a base portion 3410 proximal to the face portion 3200, a peak portion 3420 distal to the face portion 3200, and a height 3430. The base portion 3410 may include edges 3411, 3412, 3413, and 3414, and the peak portion 3420 may include edges 3421, 3422, 3423, and 3424. The length of edge 3411 or edge 3413 of the base portion 3410 may correspond to a distance (e.g., distance 3444 in FIG. 37) separating two successive grooves of one of the first plurality of grooves 3740 and the second plurality of grooves 3750. The length of edge 3412 or edge 3414 of the base portion 3410 may correspond to the distance separating two successive grooves of the other one of the first plurality of grooves 3740 and the second plurality of grooves 3750. The base portion 3410 may be connected to the peak portion 3420 via at least one side wall generally shown as side walls 3425, 3426, 3427, and 3428. The peak portion 3420 may be flat or textured and may have a smaller area than the base portion 3410. Accordingly, the projection 3331 may taper in a direction from the base portion 3410 to the peak portion 3420. For example, each of the side walls 3425, 3426, 3427, and 3428 may be trapezoidal and may extend inwardly from the base portion 3410 to the peak portion 3420. Said differently, the area of the projection 3331 may gradually diminish when transitioning from the base portion 3410 to the peak portion 3420. The apparatus, methods, and articles of manufacture described herein are not limited in this regard.

In the example of FIGS. 32-38, each projection of the plurality of projections 3330 may be oriented on the face portion 3200 such that the diagonals of the corresponding base portion 3410 and peak portion 3420 generally point in horizontal and vertical directions along the face portion 3200 when directly viewing the strike portion 3210. Accordingly, the projections of the plurality of projections 3330 may be linearly aligned in one or more diagonal directions across the strike portion 3210 of the face portion 3200. Linearly aligned projections of the plurality of projections 3330 may extend diagonally from the toe portion 3230 to the top portion 3270, from the toe portion 3230 to the sole portion 3280, from the top portion 3270 to the sole portion 3280, from the heel portion 3240 to the top portion 3270, from the heel portion 3240 to the sole portion 3280, or a combination thereof. As described herein, the grooves of the plurality of grooves 3340 may also extend diagonally from the toe portion 3230 to the top portion 3270, from the toe portion 3230 to the sole portion 3280, from the top portion 3270 to the sole portion 3280, from the heel portion 3240 to the top portion 3270, from the heel portion 3240 to the sole portion 3280, or a combination thereof. Additionally, or alternatively, the projections of the plurality of projections 3330 and the grooves of the plurality of grooves 3340 may be vertically and/or horizontally configured on the strike portion 3210 of the face portion 3200. For example, at least a portion of the projections of the plurality of projections 3330 may be substantially aligned in one or more horizontal and/or vertical directions across the strike portion 3210 of the face portion 3200. In another example, the projections of the plurality of projections 3330 and the grooves of the plurality of grooves 3340 may have curved configurations on the strike portion 3210 of the face portion 3200. The apparatus, methods, and articles of manufacture described herein are not limited in this regard.

In the example of FIGS. 32-38, the sizes (e.g., volumes) of the plurality of projections 3330 may change in any direction moving from the central strike portion 3285 to the perimeter 3290 of the face portion 3200. In one example, the areas of the peak portions 3420 of the plurality of projections 3330 may successively increase in any direction moving from the central portion 3285 to the perimeter 3290 of the face portion 3200. Additionally, or alternatively, the areas of the base portions 3410 of the plurality of projections 3330 may successively increase in any direction moving from the central strike portion 3285 to the perimeter 3290. Accordingly, a smallest one of the plurality of projections 3330 (e.g., projection 3331) may be located at the central strike portion 3285, and more particularly, at or proximate the geometric center 3286 of the face portion 3200, whereas a largest one of the plurality of projections 3330 may be located farthest from the central strike portion 3285, typically at or proximate the toe edge 3231 and/or the heel edge 3241. The apparatus, methods, and articles of manufacture described herein are not limited in this regard.

Figure 32:
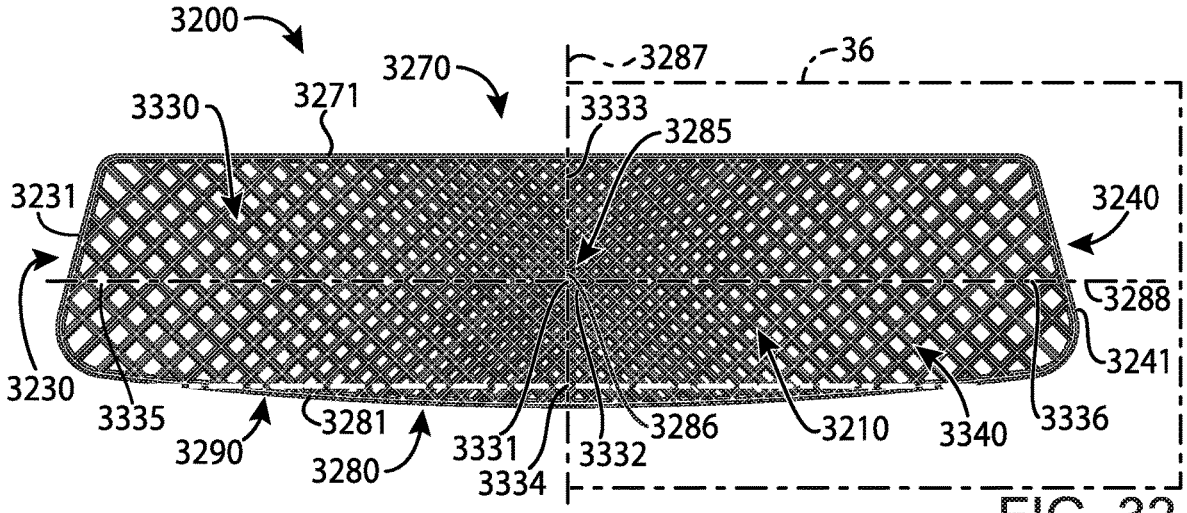
FIG. 32 depicts a front perspective view of a face portion of a golf club head according to an example of the apparatus, methods, and articles of manufacture described herein.
Figure 33:
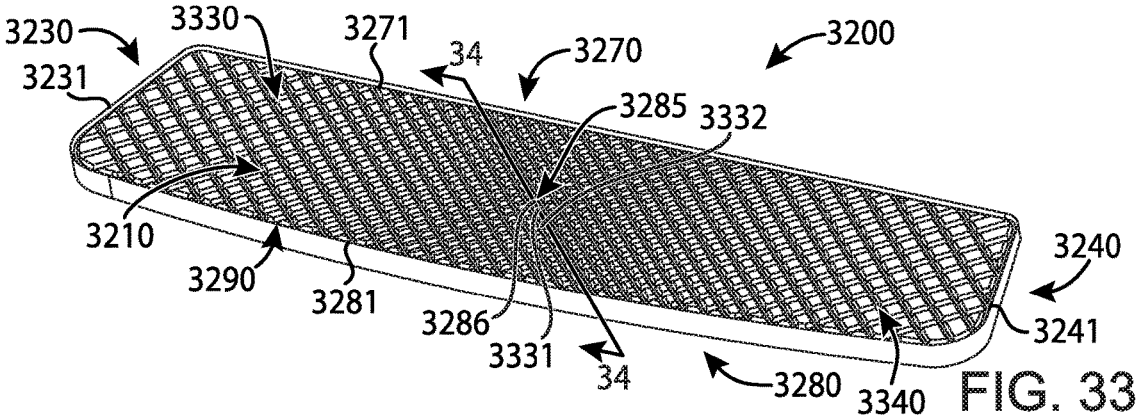
FIG. 33 depicts a side perspective view of the face portion of FIG. 32.

In the example of FIGS. 32-38, at least two projections of the plurality of projections 3330 may have similar sizes if they are located on a line passing through the geometric center 3286 and are equidistant to the geometric center 3286. For purposes of illustration, FIG. 32 shows a vertical centerline axis 3287 extending between the top edge 3271 and the sole edge 3281 and passing through the geometric center 3286. FIG. 32 also shows the horizontal centerline axis 3288 extending between the toe edge 3231 and the heel edge 3241 and passing through the geometric center 3286. At least two projections of the plurality of projections 3330 may have similar sizes due to being located on the vertical centerline axis 3287 and equidistant to the geometric center 3286. For example, the two projections of the plurality of projections 3330 may include a first projection 3333 on the vertical centerline axis 3287 at or proximate the top edge 3271 and a second projection 3334 on the vertical centerline axis 3287 at or proximate the sole edge 3281, the first and second projections 3333 and 3334 being equidistant to the geometric center 3286. Likewise, at least two projections of the plurality of projections 3330 may have similar sizes if they are located on the horizontal centerline axis 3288 and are equidistant to the geometric center 3286. For example, the two projections of the plurality of projections 3330 may include a first projection 3335 on the horizontal centerline axis 3288 at or proximate the toe edge 3231 and a second projection 3336 on the horizontal centerline axis 3288 at or proximate the heel edge 3241, the first and second projections 3335 and 3336 being equidistant to the geometric center 3286. The apparatus, methods, and articles of manufacture described herein are not limited in this regard.

In the example of FIGS. 32-38, each one of the plurality of projections 3330 may be a square or rectangular pyramidal frustum of similar height 3430. The total areas of the base portions 3410 and peak portions 3420 of the plurality of projections 3330 may be approximately 2.15 square inches (1387.09 square millimeters) and 1.04 square inches (670.97 square millimeters), respectively. Accordingly, the total areas of the peak portions 3420 may be less than half the total areas of the base portions 3410. Alternatively, the total areas of the peak portions 3420 may be equal to or greater than half the total areas of the base portions 3410. As described herein, the smallest one of the plurality of projections 3330 (e.g., projection 3331) may be located at the central strike portion 3285 and may be located at or proximate the geometric center 3286 of the face portion 3200. In one example, an area ratio between the base portion 3410 and the peak portion 3420 of the smallest one of the plurality of projections 3330 may be approximately 4.16 or more generally ranging from 4.0 to 5.0. However, area ratios outside the foregoing range are also possible. The largest one of the plurality of projections 3330 on the vertical centerline axis 3287 of the face portion 3200 may be located at or proximate the top edge 3271 and/or the sole edge 3281. For example, the largest one of the plurality of projections 3330 on the vertical centerline axis 3287 may correspond to two projections (e.g., projections 3333 and 3334) equidistant to the geometric center 3286 of the face portion 3200 and oppositely located at or proximate the top edge 3271 and the sole edge 3281, respectively. In one example, the area ratio between the base portion 3410 and the peak portion 3420 belonging to the largest one of the plurality of projections 3330 on the vertical centerline axis 3287 may be approximately 2.68 or more generally ranging from 2.0 to 3.0. However, area ratios outside the foregoing range are also possible. The largest one of the plurality of projections 3330 on the horizontal centerline axis 3288 of the face portion 3200 may be located at or proximate the toe edge 3231 and/or the heel edge 3241. For example, the largest one of the plurality of projections 3330 located on the horizontal centerline axis 3288 may correspond to two projections (e.g., projections 3335 and 3336) equidistant to the geometric center 3286 of the face portion 3200 and oppositely located at or proximate the toe edge 3231 and the heel edge 3241, respectively. In one example, the area ratio between the base portion 3410 and the peak portion 3420 belonging to the largest one of the plurality of projections 3330 on the horizontal centerline axis 3288 may be approximately 1.61 or more generally ranging from 1.0 to 2.0. However, area ratios outside the foregoing range are also possible. Accordingly, the area ratio between the base portion 3410 and the peak portion 3420 of a projection of the plurality of projections 3330 may be inversely related to the size of the projection. In other words, the larger a projection is, the smaller is the area ratio between the base portion 3410 and the peak portion 3420 of the projection. Said differently still, in examples where the base portions 3410 and the peak portions 3420 of the plurality of projections 3330 successively increase in any direction moving from the central strike portion 3285 to the perimeter 3290 of the face portion 3200, the corresponding area ratios between the base portions 3410 and the peak portions 3420 of the plurality of projections 3330 may successively decrease in any direction moving from the central strike portion 3285 to the perimeter 3290. The apparatus, methods, and articles of manufacture described herein are not limited in this regard.

In the example shown in FIGS. 32-38, at least one of the plurality of projections 3330 may be a different size compared to at least one other projection of the plurality of projections 3330 positioned adjacently leftward, rightward, above, below, or at a diagonal with respect thereto. The difference in sizing between two adjacent projections of the plurality of projections 3330 (e.g., projections 3331 and 3332) may result from differences between the areas of their base portions 3410 and/or peak portions 3420. Additionally, or alternatively, the difference in sizing between two adjacent projections of the plurality of projections 3330 may result from differences in height 3430. A change in size between two or more projections of the plurality of projections 3330 successively aligned in a substantially horizontal, vertical, or diagonal direction across the face portion 3200 may be based on a relative proximity between each of the two or more projections of the plurality of projections 3330 and the central strike portion 3285. In one example, the two or more successively aligned projections of the plurality of projections 3330 may successively increase in size in the substantially horizontal, vertical, or diagonal direction moving from the central strike portion 3285 to the perimeter 3290. In one example, Accordingly, the largest one of the plurality of projections 3330 may be located farthest from the central strike portion 3285, generally at or about the perimeter 3290 of the face portion 3200, and more particularly, at or proximate the toe edge 3231 or the heel edge 3241 of the face portion 3200. The apparatus, methods, and articles of manufacture described herein are not limited in this regard.

In one example, two or more of the plurality of projections 3330 may be similar or substantially similar in height such that the peak portions 3420 associated therewith may each provide a ball striking surface. In another example, the plurality of projections 3330 may increase in height 3430 in one or more directions moving from the central strike portion 3285 to the perimeter 3290 of the face portion 3200. In yet another example, the plurality of projections 3330 may decrease in height in one or more directions moving from the central strike portion 3285 to the perimeter 3290. In yet another example, the plurality of projections 3330 may increase, decrease, or otherwise vary in height in one or more directions on the face portion 3200. Accordingly, the depths 3441 of the plurality of grooves 3340 may vary based on the heights 3430 of the plurality of projections 3330, or vice versa. The apparatus, methods, and articles of manufacture described herein are not limited in this regard.

In the example of FIGS. 32-38, a rate of change of the areas of the peak portions 3420 and/or base portions 3410 of the plurality of projections 3330 may be similar in a direction moving from the central strike portion 3285 to the toe edge 3231 and in a direction moving from the central strike portion 3285 to the heel edge 3241. In another example, the rate of change of the areas of the peak portions 3420 and/or base portions 3410 of the plurality of projections 3330 may be similar in a direction moving from the central strike portion 3285 to the top edge 3271 and in a direction moving from the central strike portion 3285 to the sole edge 3281. In yet another example, the rate of change of the areas of the peak portions 3420 and/or base portions 3410 of the plurality projections 3330 may be similar in a direction moving from the central strike portion 3285 to the toe edge 3231, in a direction moving from the central strike portion 3285 to the heel edge 3241, in a direction moving from the central strike portion 3285 to the top edge 3271, and in a direction moving from the central strike portion 3285 to the sole edge 3281. In yet another example, the rate of change of the areas of the peak portions 3420 and/or base portions 3410 of the plurality of projections 3330 may be similar and/or vary in any direction (e.g., horizontal, vertical, diagonal, etc.) moving from the central strike portion 3285 to any location on the perimeter 3290. The apparatus, methods, and articles of manufacture described herein are not limited in this regard.

In one example, the change in areas of the peak portions 3420 and/or base portions 3410 of the plurality of projections 3330 in one or more directions moving from the central strike portion 3285 to the perimeter 3290 of the face portion 3200 may be a function of a distance between the location of the plurality of projections 3330 on the face portion 3200 and the central strike portion 3285. Accordingly, the areas of the peak portions 3420 and/or base portions 3410 of the plurality of projections 3330 may successively increase moving from the central strike portion 3285 to the perimeter 3290 according to a function based on the distance of the projections 3330 from the central strike portion 3285. In one example, the change in areas of the peak portions 3420 and/or base portions 3410 of the plurality of projections 3330 in one or more directions moving from the central strike portion 3285 to the perimeter 3290 of the face portion 3200 may be a linear function of a distance between the location of the plurality of projections 3330 on the face portion 3200 and the central strike portion 3285. In another example, the change in areas of the peak portions 3420 and/or base portions 3410 of the plurality of projections 3330 in one or more directions moving from the central strike portion 3285 to the perimeter 3290 of the face portion 3200 may be a polynomial function (e.g., a quadratic function or cubic function) of a distance between the location of the plurality of projections 3330 on the face portion 3200 and the central strike portion 3285. The areas of the peak portions 3420 and/or base portions 3410 may vary from the central strike portion 3285 to the toe portion 3230, the heel portion 3240, the top portion 3270, and/or the sole portion 3280 according to any relationship based on any physical property of the face portion 3200 and/or any physical property of a portion of the face portion 3200 (e.g., a location on the face portion 3200) relative to the central strike portion 3285. The apparatus, methods, and articles of manufacture described herein are not limited in this regard.

In the example of FIGS. 32-38, the change in areas of the peak portions 3420 and/or base portions 3410 of the plurality of projections 3330 in one or more directions moving from the central strike portion 3285 to the perimeter 3290 may be defined by the change in a distance 3444 (FIG. 37) between successive grooves of the first plurality of grooves 3740 extending in the first direction and between successive grooves of the second plurality of grooves 3750 extending in the second direction. In one example, the distance 3444 between successive grooves of the first and second plurality of grooves 3740 and 3750 may successively increase in any direction moving from the central strike portion 3285 to the perimeter 3290 of the face portion 3200. In other words, the distance 3444 between successive grooves of the first and second plurality of grooves 3740 and 3750 may successively increase moving from the central strike portion 3285 to the toe edge 3231, from the central strike portion 3285 to the heel edge 3241, moving from the central strike portion 3285 to the top edge 3271, and moving from the central strike portion 3285 to the sole edge 3281. In one example, the distance 3444 between successive grooves of the first and second plurality of grooves 3740 and 3750 may increase linearly from the central strike portion 3285 to the perimeter 3290 of the face portion 3200. The distance 3444 between successive grooves of the first and second plurality of grooves 3740 and 3750 may be a linear function of a distance between the location of the first and second plurality of grooves 3740 and 3750 on the face portion 3200 and the central strike portion 3285. In another example, the distance 3444 between successive grooves of the first and second plurality of grooves 3740 and 3750 may be a polynomial function (e.g., a quadratic function or cubic function) of a distance between the location of the first and second plurality of grooves 3740 and 3750 on the face portion 3200 and the central strike portion 3285. In another example, the distance 3444 between successive grooves of the first and second plurality of grooves 3740 and 3750 may successively increase in one or more directions moving from the central strike portion 3285 toward the perimeter 3290 of the face portion 3200. In other words, the distance 3444 between successive grooves of the first and second plurality of grooves 3740 and 3750 may successively increase in one or more of the following directions: from the central strike portion 3285 to the toe edge 3231, from the central strike portion 3285 to the heel edge 3241, from the central strike portion 3285 to the top edge 3271, and from the central strike portion 3285 to the sole edge 3281. In yet another example, the distance 3444 between successive grooves of the first and second plurality of grooves 3740 and 3750 may successively increase at a similar or different rate in one or more directions moving from the central strike portion 3285 toward the perimeter 3290 of the face portion 3200. Accordingly, the change in the distance 3444 between successive grooves of the first and second plurality of grooves 3740 and 3750 located at or proximate to the toe portion 3230, at or proximate to the heel portion 3240, at or proximate to the top portion 3270, and/or at or proximate to the sole portion 3280 may be similar or may vary. The apparatus, methods, and articles of manufacture described herein are not limited in this regard.

The shape of the plurality of projections 3330, the configuration of the plurality of grooves 3340, and/or the change in size (e.g., increase in area of the peak portions 3420 and/or base portions 3410) of the plurality of projections 3330 from the central strike portion 3285 to the perimeter 3290 may affect ball speed, control, sound, and/or spin. Striking a golf ball with the face portion 3200 as described herein may: (1) improve stroke consistency; (2) result in lower ball speeds, which may result in decreased ball roll out distance; (3) result in heel and toe shots to have decreased ball speeds, which may also result in shorter ball roll out distance; (4) allow relatively lower and higher handicap players to strike the ball with different locations on the face portion 3200; and/or, (5) minimize the amount of ball speed loss for off-center hits toward the toe and/or heel, thereby producing more consistent ball roll out distances for center, toe, and heel shots. The apparatus, methods, and articles of manufacture described herein are not limited in this regard.

While the example of the face portion 3200 shown in FIGS. 32-38 generally includes a plurality of projections 3330 increasing in size in any direction moving from the center strike portion 3285 to the perimeter 3290 of the face portion 3200, other examples (not shown) of the face portion 3200 may feature the plurality of projections 3330 decreasing in size in any direction moving from the center strike portion 3285 to the perimeter 3290 of the face portion 3200. For instance, the areas of the peak portions 3420 and/or base portions 3410 may successively decrease in any direction moving from the central portion 3285 to the perimeter 3290 of the face portion 3200. Accordingly, a largest one of the plurality of projections 3330 may be located at the central strike portion 3285, and more particularly, at or proximate the geometric center 3286 of the face portion 3200, whereas a smallest one of the plurality of projections 3330 may be located at or proximate the toe edge 3231 and/or the heel edge 3241. The apparatus, methods, and articles of manufacture described herein are not limited in this regard.

A rate of change of the areas of the peak portions 3420 and/or base portions 3410 of the plurality of projections 3330 may be similar in a direction moving from the central strike portion 3285 to the toe edge 3231 and in a direction moving from the central strike portion 3285 to the heel edge 3241. In another example, the rate of change of the areas of the peak portions 3420 and/or base portions 3410 of the plurality of projections 3330 may be similar in a direction moving from the central strike portion 3285 to the top edge 3271 and in a direction moving from the central strike portion 3285 to the sole edge 3281. In yet another example, the rate of change of the areas of the peak portions 3420 and/or base portions 3410 of the plurality of projections 3330 may be similar in a direction moving from the central strike portion 3285 to the toe edge 3231, in a direction moving from the central strike portion 3285 to the heel edge 3241, in a direction moving from the central strike portion 3285 to the top edge 3271, and in a direction moving from the central strike portion 3285 to the sole edge 3281. In yet another example, the rate of change of the areas of the peak portions 3420 and/or base portions 3410 of the plurality of projections 3330 may be similar and/or vary in any direction (i.e., horizontal, vertical, diagonal, etc.) moving from the central strike portion 3285 to any location on the perimeter 3290. The change in areas of the peak portions 3420 and/or base portions 3410 of the plurality of projections 3330 from the central strike portion 3285 to the perimeter 3290 of the face portion 3200 may be a linear or polynomial function (e.g., a quadratic function or cubic function) of a distance between the location of the plurality of projections 3330 on the face portion 3200 and the central strike portion 3285. Additionally, or alternatively, the plurality of projections 3330 may decrease in height 3430 at a fixed or variable rate from the central strike portion 3285 to the perimeter 3290 of the face portion 3200. The apparatus, methods, and articles of manufacture described herein are not limited in this regard.

The change in areas of the peak portions 3420 and/or base portions 3410 of the plurality of projections 3330 from the central strike portion 3285 to the perimeter 3290 may be defined by the change in the distance 3444 between successive grooves of the first plurality of grooves 3740 extending in the first direction and between successive grooves of the second plurality of grooves 3750 extending in the second direction. In one example, the distance 3444 between successive grooves of the first and second plurality of grooves 3740 and 3750 may successively decrease in any direction moving from the central strike portion 3285 to the perimeter 3290 of the face portion 3200. In other words, the distance 3444 between successive grooves of the first and second plurality of grooves 3740 and 3750 may successively decrease moving from the central strike portion 3285 to the toe edge 3231, moving from the central strike portion 3285 to the heel edge 3241, moving from the central strike portion 3285 to the top edge 3271, and moving from the central strike portion 3285 to the sole edge 3281. The distance 3444 between successive grooves of the first and second plurality of grooves 3740 and 3750 may be a linear or polynomial function (e.g., a quadratic function or cubic function) of a distance between the location of the first and second plurality of grooves 3740 and 3750 on the face portion 3200 and the central strike portion 3285. In another example, the distance 3444 between successive grooves of the first and second plurality of grooves 3740 and 3750 may successively decrease in any direction moving from the central strike portion 3285 toward the perimeter 3290 of the face portion 3200. In other words, the distance 3444 between successive grooves of the first and second plurality of grooves 3740 and 3750 may successively decrease in one or more of the following directions: from the central strike portion 3285 to the toe edge 3231, from the central strike portion 3285 to the heel edge 3241, from the central strike portion 3285 to the top edge 3271, and from the central strike portion 3285 to the sole edge 3281. The distance 3444 between successive grooves of the first and second plurality of grooves 3740 and 3750 may successively decrease at a similar or different rate in one or more directions moving from the central strike portion 3285 toward the perimeter 3290 of the face portion 3200. Accordingly, the decrease in the distance 3444 between successive grooves of the first and second plurality of grooves 3740 and 3750 located at or proximate to the toe portion 3230, at or proximate to the heel portion 3240, at or proximate to the top portion 3270, and/or at or proximate to the sole portion 3280 may be similar or vary. The apparatus, methods, and articles of manufacture described herein are not limited in this regard.

Figure 39:
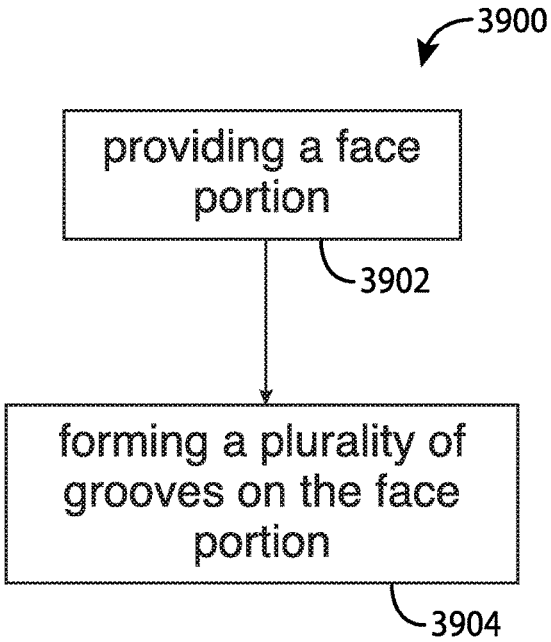
FIG. 39 depicts a method of manufacturing a face portion according to an example of the apparatus, methods and articles of manufacture described herein.
Figure 40:
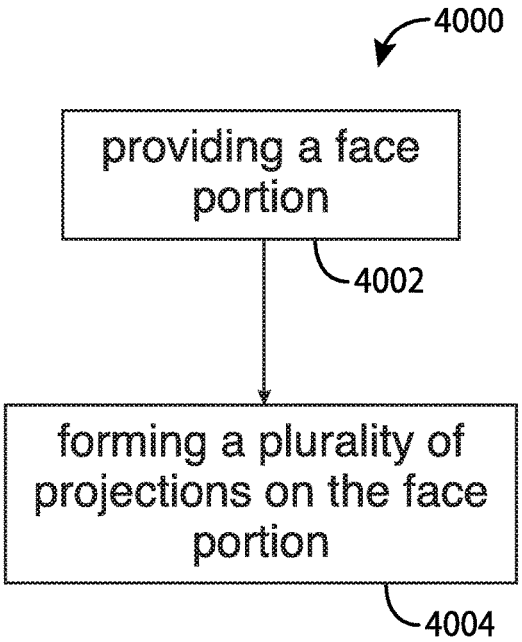
FIG. 40 depicts another method of manufacturing a face portion according to an example of the apparatus, methods and articles of manufacture described herein.
Figure 41:
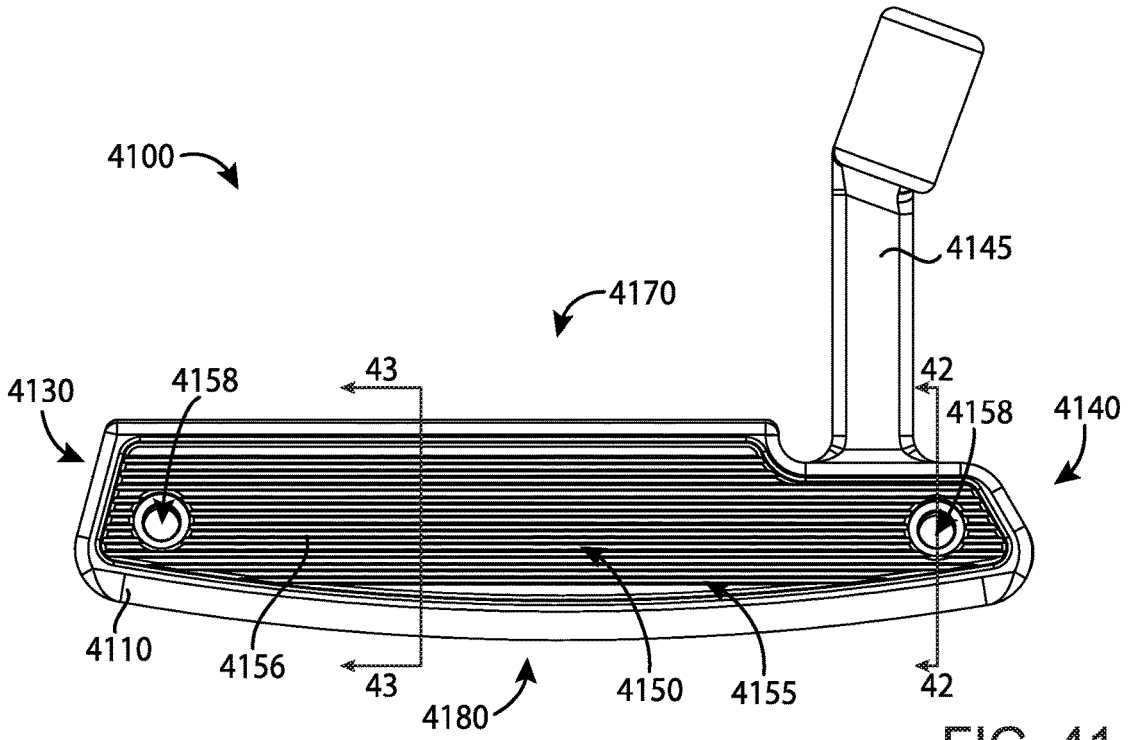
FIG. 41 depicts a front view of a golf club head according to another example of the apparatus, methods, and articles of manufacture described herein.

In one example, as shown in FIG. 39, a process 3900 of manufacturing the face portion 3200 may include providing a face portion (block 3902) having a planar strike portion (i.e., without any grooves). In one example, the face portion 3200 may be an integral part of a golf club head. In another example, the face portion 3200 may be a separate face insert that may be coupled to a front portion of a golf club head by using adhesive, tape, welding, soldering, fasteners and/or other suitable methods and devices. The process 3900 may include forming a plurality of grooves on the strike portion of the face portion (block 3904) with distances between successive grooves of the plurality of grooves changing (e.g., increasing or decreasing) in any direction moving from a center strike portion to a perimeter of the face portion. Alternatively, in another example, as shown in FIG. 40, a process 4000 of manufacturing the face portion 3200 may include providing a face portion (block 4002) having a planar strike portion (i.e., without any grooves), and forming a plurality projections on the strike portion of the face portion (block 4004) with the size of the plurality of projections changing (e.g., increasing or decreasing) in any direction from a center strike portion to a perimeter of the face portion. As described herein, each one of the plurality of projections may include a peak portion separated from a base portion by a height. In one example, two or more of the plurality of projections may be pyramidal frustums. The change in size may include a change to the areas of the peak portions of the plurality of projections, a change to the areas of the base portions of the plurality of projections, and/or a change in height of the plurality of projections. The apparatus, methods, and articles of manufacture described herein are not limited in this regard.

In one example, the plurality of grooves may be manufactured by milling the face portion. Accordingly, the portions of the face portion that are not milled may form the plurality of projections (e.g., residual portion(s)). In another example, the plurality of grooves may be stamped onto the face portion. In yet another example, the face portion including the plurality of projections and/or the plurality of grooves may be manufactured by forging. In yet another example, the face portion including the plurality of projections and/or the plurality of grooves may be manufactured by casting. In yet another example, the plurality of projections and/or the plurality of grooves may be manufactured by press forming. In yet another example, the plurality of projections and/or the plurality of grooves may be manufactured by laser and/or thermal etching or eroding of the face material. In yet another example, the plurality of projections and/or the plurality of grooves may be manufactured by chemically eroding the face material using photo masks. In yet another example, the plurality of projections and/or the plurality of grooves may be manufactured by electro/chemically eroding the face material using a chemical mask such as wax or a petrochemical substance. In yet another example, the plurality of projections and/or the plurality of grooves may be manufactured by abrading the face material using air or water as the carry medium of the abrasion material such as sand. Any one or a combination of the methods discussed above can be used to manufacture one or more of the plurality of projections and/or the plurality of grooves on the face portion. The apparatus, methods, and articles of manufacture described herein are not limited in this regard.

In the example of FIGS. 41-47, a golf club head 4100 may include a body portion 4110 having a toe portion 4130, a heel portion 4140, a front portion 4150, a rear portion 4160 having a back wall portion 4184 (shown in FIG. 43), a top portion 4170, and a sole portion 4180. The body portion 4110 may include a hosel portion 4145 configured to receive a shaft (not shown) with a grip (not shown). The golf club head 4100 and the grip may be located on opposite ends of the shaft to form a golf club. The front and rear portions 4150 and 4160, respectively, may be on opposite ends of the body portion 4110. The front portion 4150 may include a face portion 4155 (e.g., a strike face). The face portion 4155 may be used to impact a golf ball and may be similar in configuration to any face portion described herein including face portion 3200. The face portion 4155 may be associated with a loft plane that defines the loft angle of the golf club head 4100. The golf club head 4100 may be manufactured by any of the methods described herein and from any one or more of the materials described herein or associated with any of the golf club heads described herein. Although FIGS. 41-43 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

Figure 42:
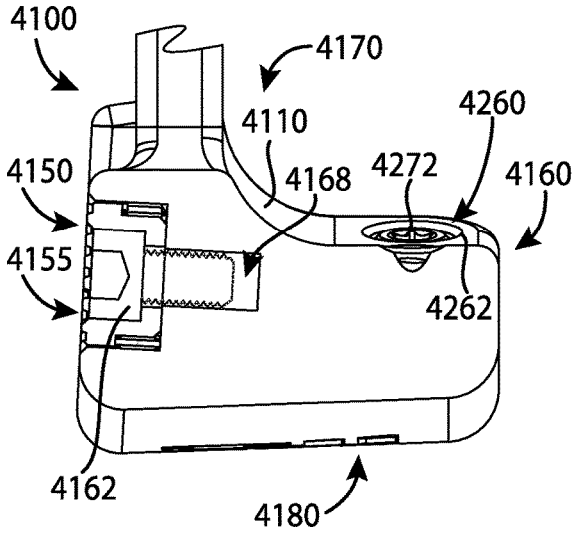
FIG. 42 depicts a cross-sectional view of the golf club head of FIG. 41 taken at lines 42-42 of FIG. 41.
Figure 43:
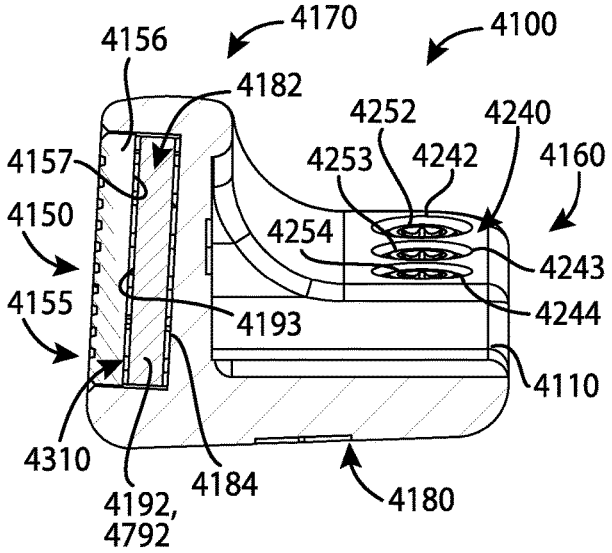
FIG. 43 depicts a cross-sectional view of the golf club head of FIG. 41 taken at lines 43-43 of FIG. 41.
Figure 44:
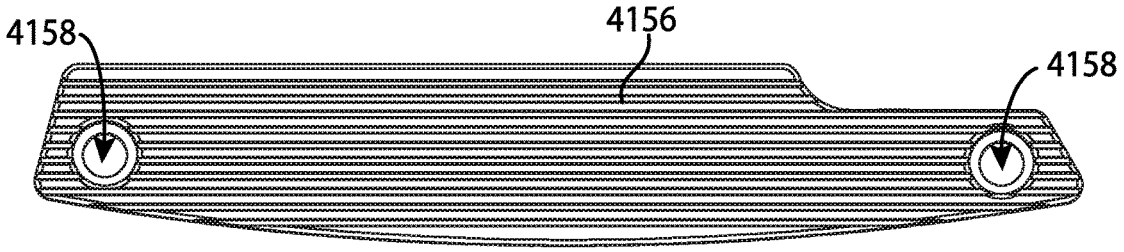
FIG. 44 depicts a front view of a face insert of the golf club head of FIG. 41 according to an example of the apparatus, methods, and articles of manufacture described herein.

The body portion 4110 may include one or more weight ports and one or more weight portions. In the example of FIGS. 41-47, the body portion 4110 may include a first set of weight ports 4240 (shown in FIG. 43 as weight ports 4242, 4243, and 4244) proximate to the toe portion 4130 and extending between the toe portion 4130 and the heel portion 4140 and configured to receive weight portions 4252, 4253, and 4254. The body portion 4110 may also include a second set of weight ports 4260 (one weight port 4262 is shown in FIG. 42) proximate to the heel portion 4140 and extending between the toe portion 4130 and the heel portion 4140 and configured to receive weight portions (one weight portion 4272 is shown in FIG. 42). The golf club head 4100 may include any number of weight ports and weight portions at any location on the body portion 4110. The configurations of the weight ports and the weight portions (e.g., inner diameter, outer diameter, size, shape, distance from an adjacent weight port or weight portion, etc.) of the golf club head 4100 may be similar in many respects to the weight ports and weight portions of any of the golf club heads described herein. Alternatively, the body portion 4110 may not include any weight ports and/or weight portions. The apparatus, methods, and articles of manufacture described herein are not limited in this regard.

In the example of FIGS. 41-47, the face portion 4155 may include a face insert 4156, which may be attached to the front portion 4150 via any manufacturing methods and/or processes (e.g., a bonding process, a welding process, a brazing process, a mechanical locking method, a mechanical fastening method, any combination thereof, or other suitable types of manufacturing methods and/or processes). In the example of FIGS. 41-47, the face insert 4156 may include two fastener holes 4158 proximate to the toe portion and heel portion of the face insert 4156. Each of the fastener holes 4158 may be configured to receive a fastener 4162 for attachment of the face insert 4156 to the body portion 4110. The fasteners 4162 may have similar or different weights to balance and/or provide heel or toe weight bias for the golf club head 4100. The body portion 4110 may include two fastener ports 4168 (one fastener port 4168 shown in FIG. 42) configured to receive the fasteners 4162. Each fastener port 4168 may have internal threads that are configured to engage external threads on the fasteners 4162. As described herein, the face portion 4155 may include a peripheral recessed portion (not shown) configured to receive the face insert 4156 so that the face insert 4156 is positioned flush or substantially flush with the face portion 4155. The face insert 4156 may be attached to the face portion 4155 by any of the methods described herein. The apparatus, methods, and articles of manufacture described herein are not limited in this regard.

The body portion 4110 may include an interior cavity 4182 extending between the front portion 4150 and the rear portion 4160 and between the toe portion 4130 and the heel portion 4140. In the example of FIGS. 41-47, the interior cavity 4182 may be defined by a recess in the front portion 4150 that is covered by the face insert 4156. The interior cavity 4182 may extend from near the toe portion 4130 to near the heel portion 4140 and from near the top portion 4170 to near the sole portion 4180. Alternatively, the interior cavity 4182 may extend between the fastener ports 4168 of the body portion 4110. In one example, the interior cavity 4182 may be located at and/or near the regions of the face portion 4155 that generally strike a golf ball. The physical characteristics of the interior cavity 4182 such as interior cavity height relative to the physical characteristics of the body portion 4110 such as the height of the body portion 4110 may be similar in many respects to any of the golf club heads described herein. The apparatus, methods, and articles of manufacture described herein are not limited in this regard.

In one example, the interior cavity 4182 may be unfilled (i.e., empty space). Alternatively, the interior cavity 4182 may be partially or entirely filled with a filler material 4192 to absorb shock, isolate vibration, and/or dampen noise when the face portion 4155 strikes a golf ball. The filler material 4192 may be an elastic polymer or elastomer material similar to any of the filler materials described herein. For example, at least 50% of the interior cavity 4182 may be filled with a TPE material to absorb shock, isolate vibration, and/or dampen noise when the golf club head 4100 strikes a golf ball via the face portion 4155. In one example, the filler material 4192 may be injected into the interior cavity 4182 by any of the methods described herein (e.g., from one or more of the weight ports). In another example, the filler material 4192 may be in the form of an insert having a shape that is similar to the shape of the interior cavity 4182. The insert, exemplarily shown in FIG. 47 as filler insert 4792, may be placed in the interior cavity 4182 prior to the face insert 4156 being fastened to the face portion 4155. The apparatus, methods, and articles of manufacture described herein are not limited in this regard.

In one example, the body portion 4110 may include a bonding portion 4310. The bonding portion 4310 may provide connection, attachment, and/or bonding of the filler material 4192 or filler insert 4792 to the face insert 4156. The bonding portion 4310 may be a bonding agent, a combination of bonding agents, one or more bonding structures or attachment devices, a combination of bonding structures and/or attachment devices, and/or a combination of one or more bonding agents, one or more bonding structures, and/or one or more attachment devices. For example, the golf club head 4100 may include a bonding agent to improve adhesion and/or mitigate delamination between the face insert 4156 and any filler material or filler insert to fill the interior cavity 4182 of the golf club head 4100. In one example, the filler material 4192 or filler insert 4792 may include bonding or adhesive properties to bond or adhere to the body portion 4110. The apparatus, methods, and articles of manufacture described herein are not limited in this regard.

In one example, the bonding portion 4310 may include a bonding agent having a low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In another example, the bonding portion 4310 may include a bonding agent having LOCTITE® materials manufactured by Henkel Corporation, Rocky Hill, Conn. The apparatus, methods, and articles of manufacture are not limited in this regard.

Figure 45:
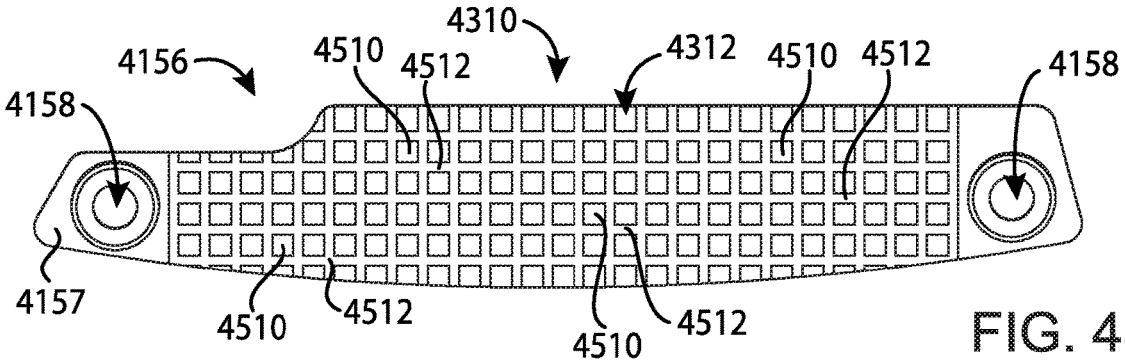
FIG. 45 depicts a back view of the face insert of FIG. 44.
Figure 46:
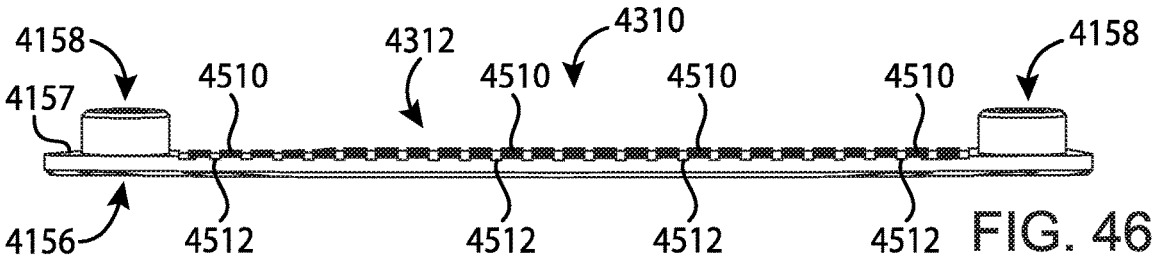
FIG. 46 depicts a bottom view of the face insert of FIG. 44.

In one example, as shown in FIGS. 45 and 46, the bonding portion 4310 may include a bonding structure 4312 on a back side 4157 of the face insert 4156 and/or on a front side 4193 (shown in FIG. 43) of the filler material 4192, which may include filler insert 4792. In one example, as shown in FIGS. 45 and 46, the back side 4157 of the face insert 4156 may include a plurality of projections 4510 defining a plurality of channels 4512 between the projections 4510. The projections 4510 may have any shape, size, height, configuration, arrangement, spacing, or other features. In the example of FIGS. 45 and 46, the projections 4510 may have a generally rectangular shape or square shape that may be arranged in a rectangular array (i.e., rows and columns) on the back side 4157 of the face insert 4156. Accordingly, the channels 4512 may extend in a direction from the toe portion 4130 to the heel portion 4140 and in a direction from the top portion 4170 to the bottom portion 4180. The channels 4512 may have any orientation, size, shape, configuration, arrangement, spacing, and/or other features that may depend on the physical properties of the projections 4510 and the arrangement of the projections 4510 on the back side 4157 of the face insert 4156. The apparatus, methods, and articles of manufacture described herein are not limited in this regard.

In one example, when the filler material 4192 is an elastic polymer or an elastomer material, the filler material 4192 may be injection molded in the interior cavity 4182. When the filler material 4192 is injection molded in the interior cavity 4182, the filler material 4192 may surround the projections 4510 and may fill the channels 4512 to increase the bonding area between the filler material 4192 and the back side 4157 of the face insert 4156. Accordingly, the bonding structure 4312 may provide a stronger bond between the filler material 4192 and the face insert 4156. In one example, a bonding agent (not shown), such as any of the bonding agents described herein, may be applied to the back side 4157 of the face insert 4156 before injection molding the filler material 4192 in the interior cavity 4182 to provide further bonding strength between the filler material 4192 and the back side 4157 of the face insert 4156. The bonding process may include single or multiple stage time and/or temperature curing of the bonding agent. The apparatus, methods, and articles of manufacture described herein are not limited in this regard.

Figure 47:
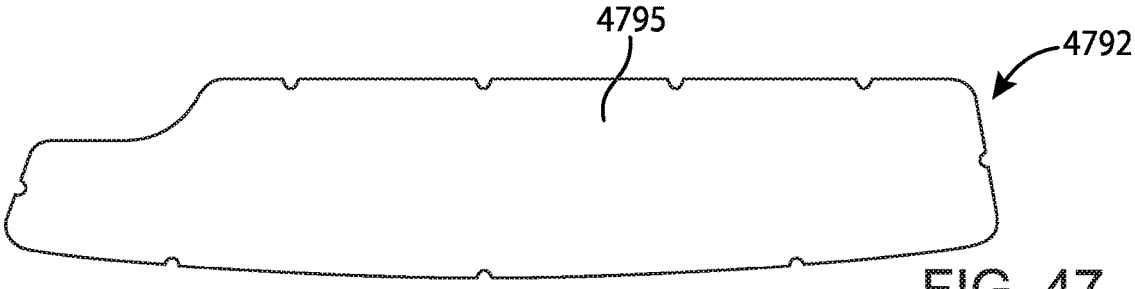
FIG. 47 depicts a back view of a filler insert of the golf club head of FIG. 41 according to an example of the apparatus, methods, and articles of manufacture described herein.

In one example, as shown in FIG. 47, the filler material 4192, which may be constructed from an elastic polymer material or an elastomer material, may be in the form of the filler insert 4792, which may be molded or formed outside of the interior cavity 4182 and placed in the interior cavity 4182 prior to attachment of the face insert 4156 to the face portion 4155. The back side 4157 of the face insert 4156 or the front side 4193 of the filler insert 4792 (i.e., the side facing the face insert 4156) may include the bonding structure 4212 (not shown for the filler insert 4792 of FIG. 47) as described herein to increase the bonding strength between the face insert 4156 and the filler insert 4792 after a bonding agent is applied to the back side 4157 of the face insert 4156 and/or the front side 4193 of the filler insert 4792. In one example (not shown), both the back side 4157 of the face insert 4156 and the front side 4193 of the filler insert 4792 may include one or more bonding structures similar to any of the bonding structures described herein. For example, the back side 4157 of the face insert 4156 may include the bonding structure 4312 as described herein and the front side 4193 of the filler insert 4792 may include a mating and/or a complementary structure to the bonding structure 4312. The apparatus, methods, and articles of manufacture described herein are not limited in this regard.

In one example, the face insert 4157 may be bonded to the elastic polymer or elastomer filler insert 4792 before being attached to the body portion 4110 of the golf club head 4100. A bonding agent, such as any of the bonding agents described herein may be applied to the back side 4157 of the face insert 4156 and/or the front side 4193 of the filler insert 4792. The face insert 4156 may then be attached and bonded to the filler insert 4792. The bonding process may include single or multiple stage time and/or temperature curing of the bonding agent. The attached face insert 4156 and the filler insert 4792 may then be attached to the body portion 4110 as described herein. The apparatus, methods, and articles of manufacture described herein are not limited in this regard.

In one example, the face insert 4156 may be constructed from one or more metals or metal alloys such as steel, aluminum, titanium, tungsten or alloys thereof. Accordingly, the filler material 4192 or the filler insert 4792 may be constructed from an elastic polymer material or an elastomer material as described herein to absorb shock, isolate vibration, and/or dampen noise when the face portion 4155 strikes a golf ball. The face insert 4156 may be constructed from a non-metallic material such as a composite material, plastic material, or a polymer material. In one example, the face insert 4156 may be constructed from a thermoplastic polyurethane (TPU) material (hereinafter referred to for this example as the TPU face insert 4156). The filler insert 4792 may be constructed from metal or metal alloys such as steel, aluminum, titanium, tungsten or alloys thereof. In one example, the filler insert 4792 may be constructed form aluminum or an aluminum alloy (hereinafter referred to for this example as the aluminum filler insert 4792). The TPU face insert 4156 may absorb shock, isolate vibration, and/or dampen noise when the face portion 4155 strikes a golf ball. The aluminum filler insert 4792 may limit the deflection of the TPU face insert 4156 and provide structural support for the TPU face insert 4156 when the TPU face insert 4156 strikes a golf ball. The apparatus, methods, and articles of manufacture described herein are not limited in this regard.

The back side 4157 of the TPU face insert 4156 or the front side 4193 of the aluminum filler insert 4792 may include the bonding structure 4312 as described herein and shown in FIGS. 45 and 46. In another example, both the back side 4157 of the TPU face insert 4156 and the front side 4193 of the aluminum filler insert 4792 may include the bonding structure 4312 as described herein. In one example, only the back side 4157 of the TPU face insert 4156 may include the bonding structure 4312 while the front side 4193 of the aluminum filler insert 4792 may not include a bonding structure. The bonding structure 4312 may provide increased bonding strength when the TPU face insert 4156 is attached to the aluminum filler insert 4792 with a bonding agent as described herein. The apparatus, methods, and articles of manufacture described herein are not limited in this regard.

In one example, the TPU face insert 4156 may be bonded to the aluminum filler insert 4792 before being attached to the body portion 4110 of the golf club head 4100. A bonding agent, such as any of the bonding agents described herein may be applied to the back side 4157 of the TPU face insert 4156 and/or the front side 4193 of the aluminum filler insert 4792. The TPU face insert 4156 may then be attached and bonded to the aluminum filler insert 4792. The bonding process may include single or multiple stage time and/or temperature curing of the bonding agent. The attached TPU face insert 4156 and the aluminum filler insert 4792 may then be attached to the body portion 4110 as described herein. The apparatus, methods, and articles of manufacture described herein are not limited in this regard.

As described herein, the back side 4157 of the face insert 4156 or the front side 4193 of the filler insert 4792 (i.e., the side facing the face insert 4156) may include the bonding structure 4312 to increase the bonding strength between the face insert 4156 and the filler insert 4792 after a bonding agent is applied to the back side 4157 of the face insert 4156 and/or the front side 4193 of the filler insert 4792. In one example, both the back side 4157 of the face insert 4156 and the front side 4193 of the filler insert 4792 may include one or more bonding structures similar to any of the bonding structures described herein. For example, the back side 4157 of the face insert 4156 may include the bonding structure 4312 as described herein and the front side 4193 of the filler insert 4792 may include a mating and/or a complementary structure to the bonding structure 4312. The apparatus, methods, and articles of manufacture described herein are not limited in this regard.

In one example, a back side 4795 (shown in FIG. 47) of the filler insert 4792 may also include a bonding structure (not shown), such as any of the bonding structures described herein, to attach the filler insert 4792 to the walls of the interior cavity 4182. For example, a bonding agent such as any of the bonding agents described herein may be applied to one or more walls of the interior cavity 4182 and/or the bonding structure on the back side 4795 of the filler insert 4792. The filler insert 4792 may then be bonded to the walls of the interior cavity 4182. The apparatus, methods, and articles of manufacture described herein are not limited in this regard.

With the support of the back wall portion 4184 (shown in FIG. 43) of the body portion 4110 and the filler material 4792, the face insert 4156 may be relatively thin without degrading the structural integrity, sound, and/or feel of the golf club head 4100. In one example, the face insert 4156 may have a thickness of less than or equal to 0.075 inch (1.905 millimeters). In another example, the face insert 4156 may have a thickness of less than or equal to 0.060 inch (1.524 millimeters). In yet another example, the face insert 4156 may have a thickness of less than or equal to 0.050 inch (1.270 millimeters). Further, the face insert 4156 may have a thickness of less than or equal to 0.030 inch (0.762 millimeters). The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion including a toe portion, a heel portion, a top portion, a sole portion, a front portion, and a rear portion;

a face portion located at the front portion, the face portion comprising:

a perimeter defined by a toe edge, a heel edge, a top edge, and a sole edge;

a central strike portion located inside the perimeter and including a geometric center of the face portion;

a plurality of grooves including:

a first plurality of grooves spaced across at least a portion of the face portion; and a second plurality of grooves spaced across at least a portion of the face portion and extending in a different direction than the first plurality of grooves; and a plurality of projections defined by portions of the face portion between the plurality of grooves, wherein the grooves of the first and second plurality of grooves have the same or substantially the same width and depth, wherein the grooves of the first plurality of grooves are increasingly spaced apart in a first direction from the central strike portion toward the toe edge and a second direction from the central strike portion toward the heel edge;

wherein the grooves of the second plurality of grooves are increasingly spaced apart in the first direction and the second direction, and wherein the plurality of projections become increasingly larger in a first outward direction from the central strike portion toward the toe edge, a second outward direction from the central strike portion toward the heel edge, a third outward direction from the central strike portion toward the top edge, and a fourth outward direction from the central strike portion toward the sole edge.

2. The golf club head as defined in claim 1, wherein the grooves of the first and second plurality of grooves have a truncated V-shaped cross section.

3. The golf club head as defined in claim 1, wherein the grooves of the first and second plurality of grooves have a width that transitions from a lowermost width to an uppermost width, wherein the lowermost width is greater than or equal to 0.010 inch, and wherein the uppermost width is greater than or equal to 0.021 inch.

4. The golf club head as defined in claim 1, wherein the grooves of the first and second plurality of grooves have a width that transitions from a lowermost width to an uppermost width, wherein the lowermost width is less than or equal to 0.012 inch, and wherein the uppermost width is less than or equal to 0.036 inch.

5. The golf club head as defined in claim 1, wherein the grooves of the first and second plurality of grooves have a depth that is greater than or equal to 0.010 inch and less than or equal to 0.020 inch.

6. The golf club head as defined in claim 1, wherein a smallest one of the plurality of projections is located at or proximate the geometric center of the face portion.

7. The golf club head as defined in claim 1, wherein a largest one of the plurality of projections is located at or proximate at least one of the toe edge and the heel edge.

8. A golf club head comprising:

a body portion including a toe portion, a heel portion, a top portion, a sole portion, a front portion, and a rear portion;

a face portion located at the front portion, the face portion comprising:

a perimeter defined by a toe edge, a heel edge, a top edge, and a sole edge;

a central strike portion located inside the perimeter and including a geometric center of the face portion;

a vertical centerline axis extending between the top edge and the sole edge and passing through the geometric center;

a plurality of grooves including:

a first plurality of grooves spaced across at least a portion of the face portion and extending in a first diagonal direction; and a second plurality of grooves spaced across at least a portion of the face portion and extending in a second diagonal direction that is transverse to the first diagonal direction; and a plurality of projections defined by portions of the face portion between the plurality of grooves, wherein the grooves of the first and second plurality of grooves have the same or substantially the same width and depth, wherein the grooves of the first plurality of grooves are increasingly spaced apart in a first direction from the vertical centerline axis toward the toe edge and a second direction from the vertical centerline axis toward the heel edge;

wherein the grooves of the second plurality of grooves are increasingly spaced apart in the first direction and the second direction, and wherein the plurality of projections become increasingly larger in a first outward direction from the central strike portion toward the toe edge, a second outward direction from central strike portion toward the heel edge, a third outward direction from the central strike portion toward the top edge, and a fourth outward direction from central strike portion toward the sole edge.

9. The golf club head as defined in claim 8, wherein the grooves of the first and second plurality of grooves have an inverted trapezoidal cross section.

10. The golf club head as defined in claim 8, wherein the grooves of the first and second plurality of grooves have a width that transitions from a lowermost width to an uppermost width, wherein the lowermost width is greater than or equal to 0.010 inch, and wherein the uppermost width is greater than or equal to 0.021 inch.

11. The golf club head as defined in claim 8, wherein the grooves of the first and second plurality of grooves have a width that transitions from a lowermost width to an uppermost width, wherein the lowermost width is less than or equal to 0.012 inch, and wherein the uppermost width is less than or equal to 0.036 inch.

12. The golf club head as defined in claim 8, wherein the grooves of the first and second plurality of grooves have a depth that is greater than or equal to 0.010 inch and less than or equal to 0.020 inch.

13. The golf club head as defined in claim 8, wherein a smallest one of the plurality of projections is located on the vertical centerline axis.

14. The golf club head as defined in claim 8, wherein at least a portion of the plurality of projections are pyramidal frustums.

15. A golf club head comprising:

a body portion including a toe portion, a heel portion, a top portion, a sole portion, a front portion, and a rear portion;

a face portion located at the front portion, the face portion comprising:

a perimeter defined by a toe edge, a heel edge, a top edge, and a sole edge;

a central strike portion located inside the perimeter and including a geometric center of the face portion;

a plurality of grooves arranged in a crisscross pattern across at least a portion of the face portion including the central strike portion; and a plurality of projections defined by portions of the face portion between the plurality of grooves, the plurality of projections including a smallest projection of the plurality of projections and a remainder of the plurality of projections that are larger than the smallest projection, wherein the grooves of the plurality of grooves have the same or substantially the same width and depth, wherein the smallest projection of the plurality of projections is located at or proximate the geometric center of the face portion, wherein the remainder of the plurality of projections become increasingly larger moving outwardly from the smallest projection of the plurality of projections toward the toe edge, wherein the remainder of the plurality of projections become increasingly larger moving outwardly from the smallest projection of the plurality of projections toward the heel edge, wherein the remainder of the plurality of projections become increasingly larger moving outwardly from the smallest projection of the plurality of projections toward the top edge, and wherein the remainder of the plurality of projections become increasingly larger moving outwardly from the smallest projection of the plurality of projections toward the sole edge.

16. The golf club head as defined in claim 15, wherein at least a portion of the plurality of projections are pyramidal frustums.

17. The golf club head as defined in claim 15, wherein parallel grooves of the plurality of grooves are spaced farther apart toward the toe and heel edges and are more closely spaced at the central strike portion.

18. The golf club head as defined in claim 15, wherein the plurality of grooves have a truncated V-shaped cross section.

19. The golf club head as defined in claim 15, wherein the plurality of grooves have a lowermost width that is greater than or equal to 0.010 inch and less than or equal to 0.012 inch, and wherein the plurality of grooves have an uppermost width that is greater than or equal to 0.021 inch and less than or equal to 0.036 inch.

20. The golf club head as defined in claim 15, wherein the crisscross pattern occupies a substantial entirety of the face portion.

* * * * *